US012774072B1

(12) United States Patent
Roske et al.

(10) Patent No.: US 12,774,072 B1
(45) Date of Patent: Oct. 27, 2026

(54) MARINE DRIVES HAVING BACKFLOW PREVENTATIVE VALVE DEVICE

(71) Applicant: Brunswick Corporation, Mettawa, IL (US)

(72) Inventors: Daniel A. Roske, Milford, NH (US); Daniel J. Guse, West Bend, WI (US); Andrew C. Gunderson, Fond du Lac, WI (US); Brett Bielefeld, Fond du Lac, WI (US); David A. Kobilic, Oakfield, WI (US)

(73) Assignee: Brunswick Corporation, Mettawa, IL (US)

( * ) Notice: Subject to any disclaimer, the term of this patent is extended or adjusted under 35 U.S.C. 154(b) by 513 days.

(21) Appl. No.: 18/462,568

(22) Filed: Sep. 7, 2023

(51) Int. Cl.
*B63H 20/26* (2006.01)

(52) U.S. Cl.
CPC ..... *B63H 20/26* (2013.01)

(58) Field of Classification Search
CPC ..... B63H 20/26; B63H 21/14; B63H 1/02; B63H 3/02; B63H 7/00; B63H 23/08; B63H 11/107; B63H 20/20; B63H 20/28; B63H 20/285; B63H 1/20; B63H 1/14; B63H 20/24; B63H 21/38; Y02T 70/50; Y02T 10/12
USPC ..... 440/89 A, 89 R, 88 A, 89 J, 89 E, 89 F; 416/93 A
See application file for complete search history.

(56) References Cited

U.S. PATENT DOCUMENTS 1,329,559 A * 2/1920 Tesla ..... F15D 1/02 137/842
2,082,059 A * 6/1937 Irgens ..... F01N 13/12 440/89 R
2,375,613 A 5/1945 Clements
2,670,757 A 3/1954 Delany
2,864,394 A 12/1958 Hempel
2,867,213 A 1/1959 Thomas
3,292,658 A 12/1966 Domer
3,374,630 A 3/1968 Davison
3,871,324 A * 3/1975 Snyder ..... B63H 23/34 416/169 A (Continued)

FOREIGN PATENT DOCUMENTS

DE 69834979 T2 10/2006

OTHER PUBLICATIONS

Notice of Allowance issued in U.S. Appl. No. 18/462,576, dated May 5, 2026.

*Primary Examiner* — Lars A Olson
*Assistant Examiner* — Eric Anthony Starck
(74) *Attorney, Agent, or Firm* — Andrus Intellectual Property Law, LLP

(57) ABSTRACT

A marine drive is for propelling a marine vessel in water, the marine drive having a housing configured to support a propulsor for generating a thrust force in the water, an outlet configured to discharge air, exhaust and/or other gas(es) to ventilate the water proximate the propulsor, an outlet passage for conveying a flow of the air, exhaust and/or other gas(es) through the housing to the outlet, and a valve device that permits flow of the air, exhaust and/or other gas(es) out to the water at least when the marine drive is operated in a forward gear, but at least partially prevents a backflow the water past the valve device at least when the marine drive is operated in reverse gear.

20 Claims, 28 Drawing Sheets

(56) References Cited

U.S. PATENT DOCUMENTS

| | | | | |
|---|---|---|---|---|
| 4,178,873 | A * | 12/1979 | Bankstahl | F01N 13/12 440/89 R |
| 4,492,361 | A | 1/1985 | Jacquet et al. | |
| 4,767,366 | A | 8/1988 | Lang | |
| 4,925,412 | A | 5/1990 | Karls | |
| 5,165,891 | A | 11/1992 | Young et al. | |
| 5,577,941 | A | 11/1996 | Chartier | |
| 5,846,105 | A | 12/1998 | Baker et al. | |
| 5,876,258 | A | 3/1999 | Gray | |
| 6,004,175 | A | 12/1999 | McCoy | |
| 6,033,272 | A | 3/2000 | Whiteside | |
| 6,089,272 | A | 7/2000 | Brand et al. | |
| 6,098,661 | A | 8/2000 | Yim et al. | |
| 6,273,771 | B1 | 8/2001 | Buckley et al. | |
| 6,325,683 | B1 | 12/2001 | Yocom | |
| 6,439,939 | B1 * | 8/2002 | Jaeger | F01P 3/207 440/88 N |
| 6,511,355 | B1 * | 1/2003 | Woodward | F01N 13/085 440/89 C |
| 6,532,909 | B2 | 3/2003 | Stauder et al. | |
| 6,899,575 | B1 | 5/2005 | Rothe et al. | |
| 7,377,826 | B1 | 5/2008 | Wengren, Jr. | |
| 8,651,908 | B1 * | 2/2014 | Glodowski | F01N 13/085 440/89 R |
| 8,714,200 | B2 | 5/2014 | Bushman et al. | |
| 9,334,034 | B1 | 5/2016 | Waldvogel et al. | |
| 10,011,341 | B1 | 7/2018 | Tuchscherer et al. | |
| 10,232,923 | B1 | 3/2019 | Novak et al. | |
| 10,800,502 | B1 | 10/2020 | Alby et al. | |
| 10,940,929 | B2 * | 3/2021 | Eatwell | F01N 13/004 |
| 11,352,937 | B1 | 6/2022 | Dreyer et al. | |
| 11,459,078 | B1 | 10/2022 | Fregonese et al. | |
| 2006/0009097 | A1 | 1/2006 | Roos | |
| 2009/0056951 | A1 | 3/2009 | Mosher et al. | |
| 2016/0245189 | A1 | 8/2016 | Raimbault et al. | |
| 2020/0318584 | A1 | 10/2020 | Clark | |

* cited by examiner

MARINE DRIVES HAVING BACKFLOW PREVENTATIVE VALVE DEVICE

FIELD

The present disclosure relates to marine drives for propelling a marine vessel in water, and particularly to marine drives having a cooling water intake for cooling at least one component of the marine drive.

BACKGROUND

The following U.S. Patents provide background and are incorporated herein by reference:

U.S. Pat. No. 11,459,078 discloses a propeller device having a propeller hub which is elongated along the rotational axis and a propeller blade which radially extends from the propeller hub. The propeller hub and propeller blade are configured so that when the propeller device is forwardly rotated, a first portion of the propeller hub on a first side of the propeller blade encounters a positive pressure and a second portion of the propeller hub on an opposite, second side of the blade encounters a relatively lower pressure or suction, and further so that when the propeller device is reversely rotated, the second portion of the propeller hub encounters a positive pressure and the first portion of the propeller hub encounters a relatively lower pressure or suction. An exhaust vent hole is in the first portion of the propeller hub and configured to vent exhaust gases from the marine drive via the propeller hub as the propeller device is reversely rotated, thereby enhancing reverse thrust performance of the propeller device.

U.S. Pat. No. 10,232,923 discloses a marine drive having exhaust passage that conveys exhaust gas through the lower gearcase to an underwater discharge outlet. The exhaust passage includes a first leg that conveys the exhaust gas downwardly in the lower gearcase and a second leg that redirects the exhaust gas laterally from the first leg to the underwater discharge outlet. The propeller shaft bearing hub comprises curved vanes that laterally redirect the exhaust gas from the first leg towards the underwater discharge outlet.

U.S. Pat. No. 10,011,341 discloses a marine drive having an exhaust outlet on the upper portion of the gearcase housing configured to discharge exhaust gas from the exhaust passage to the water. The exhaust outlet faces the propulsor so that the exhaust gas is discharged into the water and towards the propulsor so as to aerate the water encountered by the propulsor.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

A marine drive is for propelling a marine vessel in water, the marine drive comprising a housing configured to support a propulsor for generating a thrust force in the water, an outlet configured to discharge air, exhaust and/or other gas(es) to ventilate the water proximate the propulsor, an outlet passage for conveying a flow of the air, exhaust and/or other gas(es) through the housing to the outlet, and a valve device that permits flow of the air or exhaust out to the water at least when the marine drive is operated in a forward gear, but at least partially prevents a backflow the water past the valve device at least when the marine drive is operated in reverse gear.

In non-limiting examples, the valve device comprises a ball valve. Optionally, at least one of gravity and the air, exhaust and/or other gas(es) forces the ball valve into an open position in which the ball valve permits the flow of the air, exhaust and/or other gas(es) and wherein an inflow of the water to the housing forces the ball valve into a closed position preventing the backflow of water back past the valve device. Optionally, the ball valve comprises a ball and a seat, and can further comprise a cage which contains the ball.

In non-limiting examples, the valve device comprises a tesla valve. Optionally the tesla valve comprises a serpentine path for the flow of air, exhaust and/or other gas(es) and a redirecting path for redirecting the backflow of water towards the outlet. Optionally the serpentine path is centrally in the tesla valve and the redirecting path is one of a pair of redirecting paths located on opposite sides of the serpentine path. Optionally the redirecting path is centrally in the tesla valve and the serpentine path is one of a pair of serpentine paths located on opposite sides of the redirecting path.

In non-limiting examples, the marine drive comprises an upper housing on which the lower housing is suspended, and wherein the valve device is in the upper housing. In non-limiting examples, the outlet is formed through the propulsor and the valve device is coupled to or formed with the propulsor.

In non-limiting examples, the valve device comprises a duckbill valve. Optionally the air, exhaust and/or other gas(es) forces the duckbill valve into an open position in which duckbill valve permits the flow of the air, exhaust and/or other gas(es) and wherein a natural resiliency of the duckbill valve forces the duckbill valve into a closed position preventing the backflow of water back past the valve device. Optionally the duckbill valve comprises a plurality of lips having a shape and natural resiliency which cause the duckbill valve to normally remain in the closed position until the air, exhaust and/or other gas(es) forces the plurality of lips apart. Optionally, the duckbill valve is coupled to the propulsor. Optionally the duckbill valve comprises a plurality of fins which facilitate a swirling flow of water relative to the propulsor. Optionally, the propulsor comprises a propeller comprising a hub and a plurality of blades on the hub, and wherein the valve device is coupled to the hub. Optionally the duckbill valve is coupled to an outer end of the hub. Optionally the duckbill valve is disposed at least partially inside the hub.

In certain non-limiting embodiments, a marine drive is for propelling a marine vessel in a body of water, the marine drive having a housing configured to support a propulsor for generating a thrust force in the body of water, and a cooling water intake configured to intake cooling water from the body of water to the housing, wherein the housing is configured to route a backflow of water received from the body of water to clear debris from the cooling water intake. Optionally, the cooling water intake comprises a screen that filters the debris from the cooling water and wherein the backflow of water clears the debris from the screen. Optionally there is at least one channel which redirects the backflow of water to the cooling water intake. The at least one channel may be defined through the housing. The at least one channel may be defined in an insert in the cooling water intake.

In non-limiting embodiments, the marine drive may further comprise a valve which in a closed position prevents the backflow of water from clearing the debris from the cooling water intake and in an open position permits the backflow of water to clear the debris from the cooling water intake. The valve may be normally in the closed position and is forced into the open position by ram pressure of the backflow of water received from the body of water. The valve may comprise a flapper.

In non-limiting embodiments, the housing may comprise an outlet passage configured to discharge air, exhaust and/or other gas(es) to ventilate the body of water proximate the propulsor, at least during forward operation of the marine drive, wherein the housing is configured so that the backflow of water is received via the outlet passage, at least during reverse operation of the marine drive. In these examples, the marine drive may comprise a valve which in a closed position prevents the cooling water from entering the outlet passage and in an open position permits the backflow of water to clear the debris. The marine drive may have a cooling water intake passage that conveys the cooling water from the cooling water intake, wherein the valve in the closed position prevents the cooling water from exiting the cooling water intake passage to the outlet passage, and in the open position permits the backflow of water to enter the cooling water intake passage from the outlet passage. The valve may normally be in the closed position and is forced into the open position by ram pressure of the water that is taken into the outlet passage. The valve may comprise a flapper.

In non-limiting embodiments, a marine drive for propelling a marine vessel in a body of water comprises a housing configured to support a propulsor for generating a thrust force in the body of water, a cooling water intake configured to intake cooling water from the body of water to the housing, and a pump configured to draw the cooling water into the cooling water intake during forward operation of the marine drive, wherein the marine drive is configured to route a backflow of water received from the body of water to clear debris from the cooling water intake. The marine drive may be configured to route a backflow of water received from the body of water to clear debris from the cooling water intake when the pump is not drawing the cooling water into the cooling water intake. The marine drive may be configured to route the backflow of water regardless of whether the pump is drawing cooling water into the cooling water intake.

In non-limiting embodiments, a marine drive is for propelling a marine vessel in a body of water and comprises a housing configured to support a propulsor for generating a thrust force in the body of water, a cooling water intake configured to intake cooling water from the body of water to the housing, and a valve which in a closed position prevents water from the body of water from clearing debris from the cooling water intake and in an open position permits the water to clear the debris from the cooling water intake, wherein the valve is normally in the closed position and is forced into the open position by ram pressure from the body of water. The valve may comprise a flapper.

In non-limiting embodiments disclosed herein, a method is for clearing debris from a cooling water intake on a housing of a marine drive, the method comprising rerouting a backflow of water received in the housing to the cooling water intake so that the backflow of water clears the debris from the cooling water intake.

Various other features, objects, and advantages will be made apparent from the following description taken together with the drawings.

BRIEF DESCRIPTION OF THE DRAWINGS

The present disclosure is described with reference to the following drawings.

DETAILED DISCLOSURE

Figure 1:
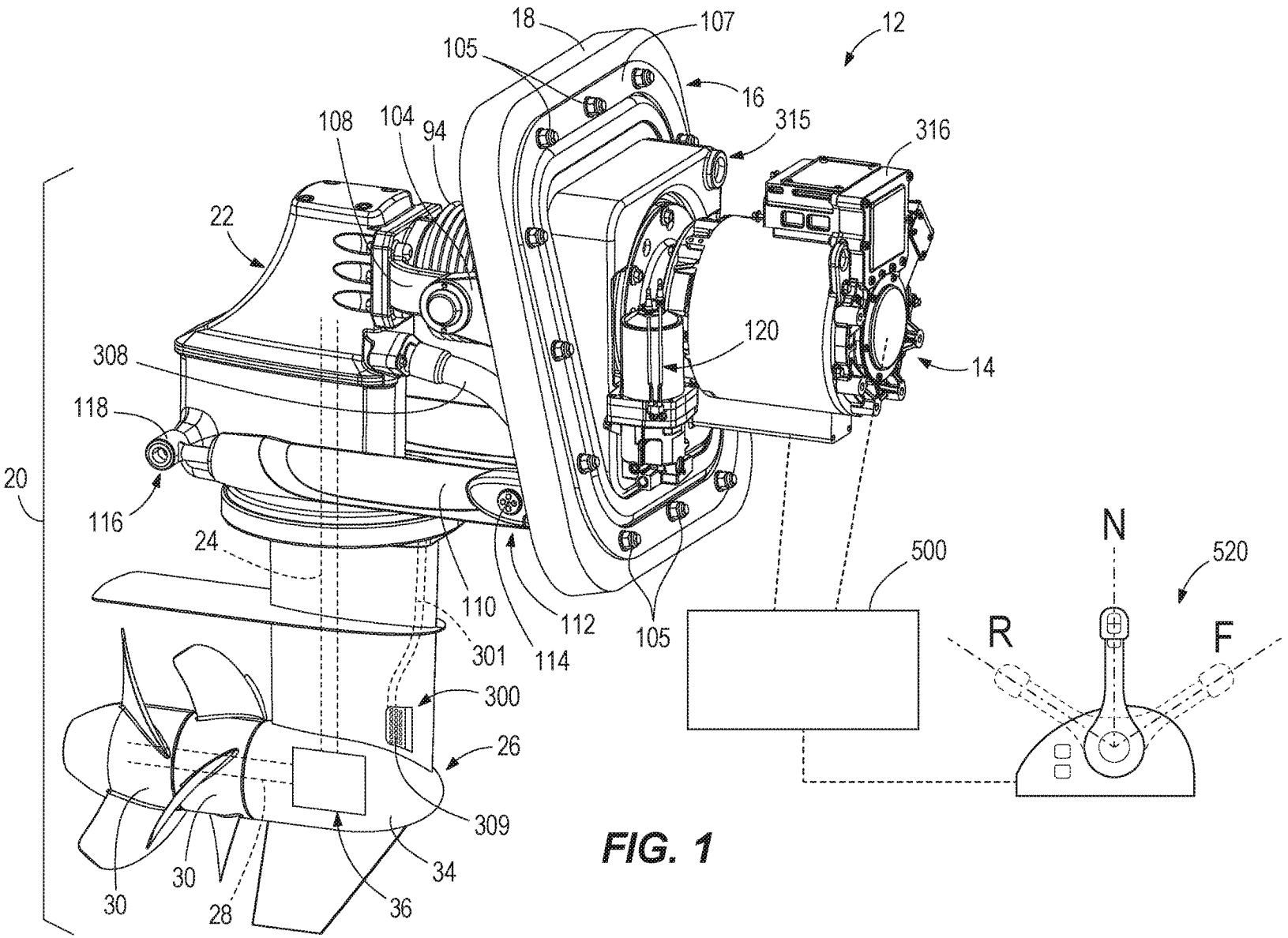
FIG. 1 is a starboard side perspective view of a marine drive according to a non-limiting first embodiment of the present disclosure.

FIGS. 1-4 illustrate a marine drive, such as a stern drive 12, for propelling a marine vessel in a body of water. The example shown in the figures is not limiting, however, and the present invention is applicable to a wide variety of marine drives, including but not limited to outboard motors. Referring to FIG. 1, the stern drive 12 has a powerhead, which in the illustrated example is an electric motor 14, a mounting assembly 16 which affixes the electric motor 14 to and suspends the electric motor 14 from the transom 18 of the marine vessel, and a drive assembly 20 coupled to the mounting assembly 16. The illustrated powerhead is not limiting however and in other examples the powerhead may include an engine and/or a combination of an engine and an electric motor, and/or any other suitable means for powering a marine drive. The mounting assembly 16 is configured so that the powerhead which in the illustrated example is an electric motor 14 is suspended (i.e., cantilevered) from the interior of the transom 18, above the bottom of the hull of the marine vessel. The drive assembly 20 is trimmable up and down relative to the mounting assembly 16, including in non-limiting examples wherein a majority or an entirety of the drive assembly 20 is raised completely out of the water.

The drive assembly 20 has a driveshaft housing 22 containing a driveshaft 24 and a gearcase housing 26 containing one or more output shaft(s) 28 (see FIG. 1), e.g., one or more propulsor shaft(s). The output shaft(s) 28 extends from the rear of the gearcase housing 26 and supports a propulsor 30 configured to generate thrust in the water for propelling the marine vessel. The output shaft(s) 28 extend generally transversely to the driveshaft 24. In the illustrated example, propulsor 30 includes two counter-rotating propellers. However this is not limiting and the present disclosure is applicable to other arrangements, including arrangements wherein one or more output shaft(s) 28 are not counter-rotating and/or wherein the one or more output shaft(s) 28 extend from the front of the gearcase housing 26, and/or wherein the propulsor 30 includes one or more impellers and/or any other mechanism for generating a propulsive force in the water.

The drive assembly 20 (FIG. 1) is operable in one or more propulsion modes. The type and number of propulsion modes can vary, and in one non-limiting examples, the drive assembly 20 is operable in a neutral mode in which the drive assembly 20 is not generating thrust or generates very little thrust, a forward mode in which the drive assembly 20 is generating a forward thrust force in the body of water, and in a reverse mode for generating a reverse thrust force in the body of water.

The gearcase housing 26 is steerable about a steering axis S (see FIG. 4) relative to the driveshaft housing 22. The gearcase housing 26 (see FIG. 1) has a steering kingpin 32 (see FIG. 4) which extends upwardly into the driveshaft housing 22, as well as a torpedo housing 34 which extends from the gearcase housing 26. A bevel gearset 36 (see FIG. 1) in the torpedo housing 34 operably couples the lower end of the driveshaft 24 to the output shaft(s) 28 so that rotation of the driveshaft 24 causes rotation of the output shaft(s) 28, which in turn causes rotation of the propulsor 30.

Figure 4:
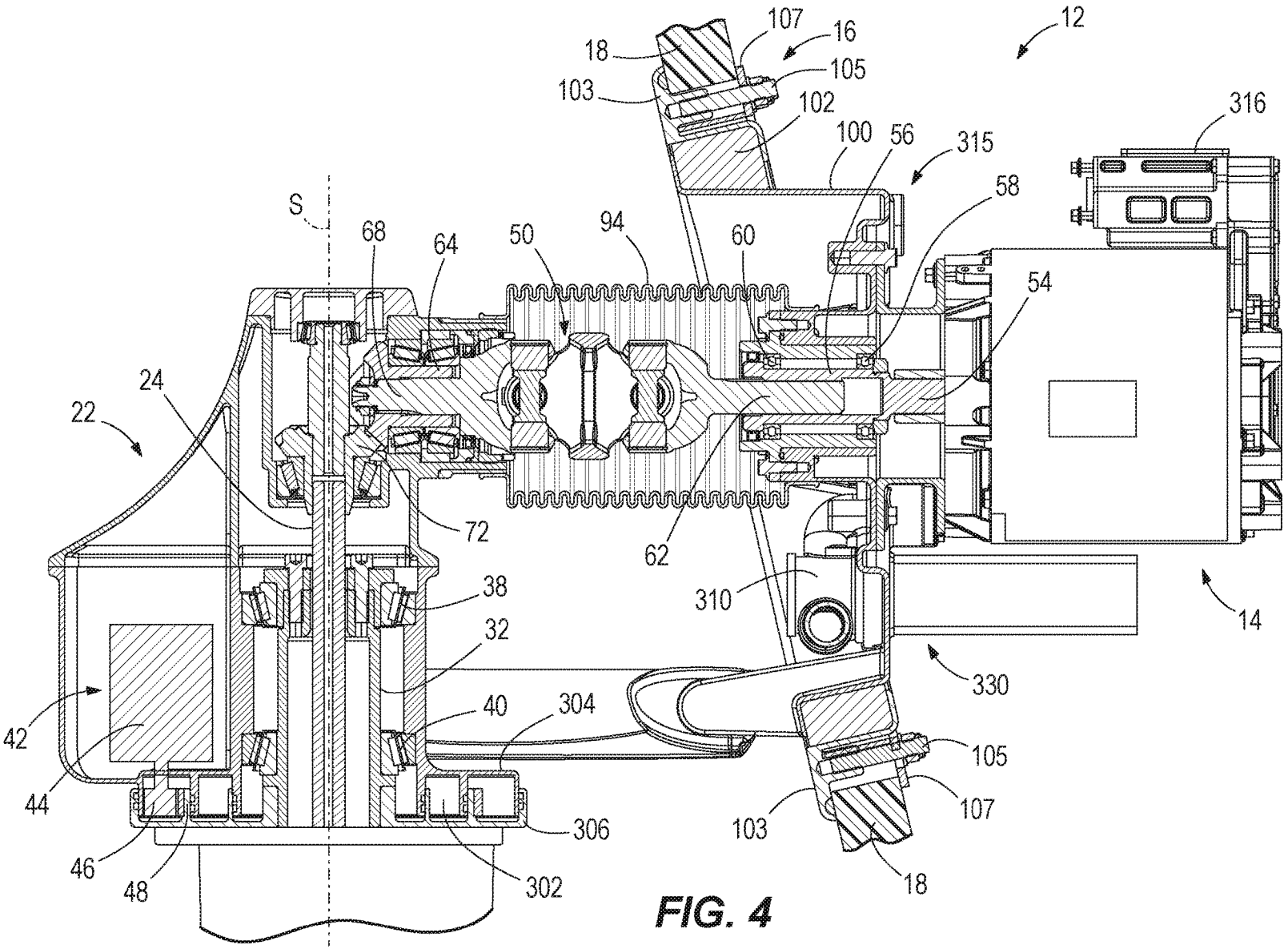
FIG. 4 is a starboard side cross-sectional view of the marine drive.

Referring to FIG. 4, upper and lower bearings 38, 40 are disposed radially between the steering kingpin 32 and the driveshaft housing 22. The upper and lower bearings 38, 40 rotatably support the steering kingpin 32 relative to the driveshaft housing 22. A steering actuator 42 is configured to cause rotation of the gearcase housing 26 relative to the driveshaft housing 22. In the illustrated example, the steering actuator 42 is an electric motor 44 located in the driveshaft housing 22. The electric motor 44 has an output gear 46 which is meshed with a ring gear 48 on the steering kingpin 32 so that rotation of the output gear 46 causes rotation of the gearcase housing 26 about the steering axis S. Operation of the electric motor 44 can be controlled via a user input device located at the helm of the marine vessel or elsewhere, which facilitates control of the steering angle of the gearcase housing 26 and associated propulsors(s) 30. This facilitates steering control of the marine vessel. The type and configuration of the steering actuator 42 can vary from what is shown, and in other examples, the steering actuator 42 can include one or more hydraulic actuators, electro-hydraulic actuators, and/or any other suitable actuator for causing rotation of the gearcase housing 26. Other suitable examples are disclosed in U.S. Pat. No. 10,800,502, which is hereby incorporated by reference in its entirety.

A universal joint 50 (FIG. 4) couples the electric motor 14 to the driveshaft 24 so that operation of the electric motor 14 causes rotation of the driveshaft 24, which in turn causes rotation of the output shaft(s) 28 (FIG. 1). The universal joint 50 is also advantageously configured to facilitate trimming of the drive assembly 20 an amount sufficient to raise at least a majority of the drive assembly 20 out of the water, for example during periods of non-use.

An internally splined sleeve 56 is rotatably supported in the mounting assembly 16 by inner and outer bearings 58, 60. The output shaft 54 of the electric motor 14 is fixed to the splined sleeve 56 so that rotation of the output shaft 54 causes rotation of the splined sleeve 56. The externally-splined input shaft 62 of the universal joint 50 extends into meshed engagement with the splined sleeve 56 so that rotation of the splined sleeve 56 causes rotation of the externally splined input shaft 62. The output shaft 68 of the universal joint 50 is coupled to the driveshaft 24 by a bevel gearset 72 located in the driveshaft housing 22 and configured so that rotation of the output member 64 causes rotation of the driveshaft 24. Thus, it will be understood that operation of the electric motor 14 causes rotation of the universal joint 50, which in turn causes rotation of the driveshaft 24 and output shaft(s) 28. The splined engagement between the externally splined input shaft 62 and splined sleeve 56 also advantageously permits telescoping movement of the externally splined input shaft 62 during trimming of the drive assembly 20. A flexible bellows 94 encloses the universal joint 50 relative to the mounting assembly 16 and the driveshaft housing 22.

The mounting assembly 16 is configured to couple the drive assembly 20 to the transom 18 outside of the marine vessel and suspend the electric motor 14 from the transom 18 inside of the marine vessel. The mounting assembly 16 has a rigid mounting plate 100, a vibration dampening (e.g., rubber or other pliable and/or resilient material) mounting ring 102, and a rigid mounting ring 103 which is fastened to the transom 18 by fasteners 105 and a fastening ring 107 to couple the vibration dampening mounting ring 102 and rigid mounting plate 100 to the transom 18.

Figure 2:
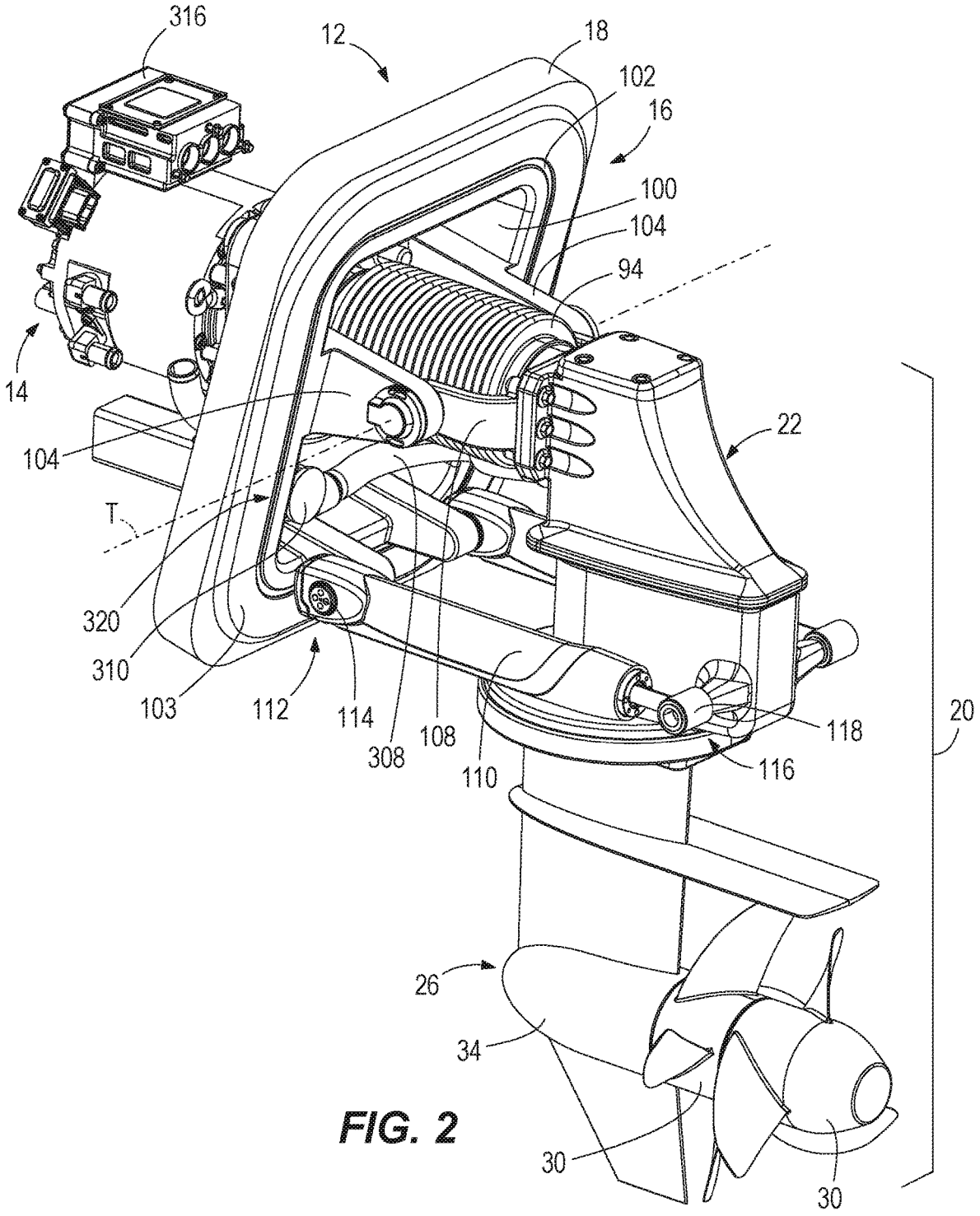
FIG. 2 is a port side perspective view of the marine drive shown in FIG. 1.

Referring now to FIG. 2, a pair of rigid mounting arms 104 (FIG. 2) extends rearwardly from the rigid mounting plate 100 (FIG. 2) and is pivotably coupled to a rigid, U-shaped mounting bracket 108 (FIG. 2) extending forwardly from the top of the driveshaft housing 22. The pivot joint between the rigid mounting arms 104 and the mounting bracket 108 defines a trim axis T (see FIG. 2) about which the drive assembly 20 is pivotably (trimmable), up and down relative to the mounting assembly 16. The type and configuration of mounting assembly 16 can vary from what is shown.

Trim cylinders 110 (see also FIG. 1) are located on opposite sides of the mounting assembly 16. The trim cylinders 110 have a first end 112 pivotably coupled to the rigid mounting plate 100 at a first pivot joint 114 and an opposite, second end 116 pivotably coupled to the drive assembly 20 at a second pivot joint 118. A hydraulic actuator 120 (see FIG. 1; which in this example includes a pump and associated valves and line components) is mounted to the interior of the rigid mounting plate 100. The hydraulic actuator 120 is hydraulically coupled to the trim cylinders 110 via a least one internal passage through the mounting assembly 16 and the first pivot joint 114, advantageously so that there are no other hydraulic lines located on the exterior of the stern drive 12, or otherwise outside the marine vessel so as to be subjected to wear and/or damage from external elements. The hydraulic actuator 120 is operable to supply hydraulic fluid to the trim cylinders 110 via the noted internal passage to cause extension of the trim cylinders 110 and alternately to cause retraction of the trim cylinders 110. Extension of the trim cylinders 110 pivots (trims) the drive assembly 20 upwardly relative to the mounting assembly 16 and retraction of the trim cylinders 110 pivots (trims) the drive assembly 20 downwardly relative to the mounting assembly 16. Examples of a suitable hydraulic actuator are disclosed in U.S. Pat. No. 9,334,034, which is hereby incorporated by reference in its entirety. The universal joint 50 advantageously facilitates trimming of the drive assembly 20 about the trim axis T (see FIG. 2) while maintaining operable connection between the electric motor 14 and the output shaft(s) 28.

Figure 5:
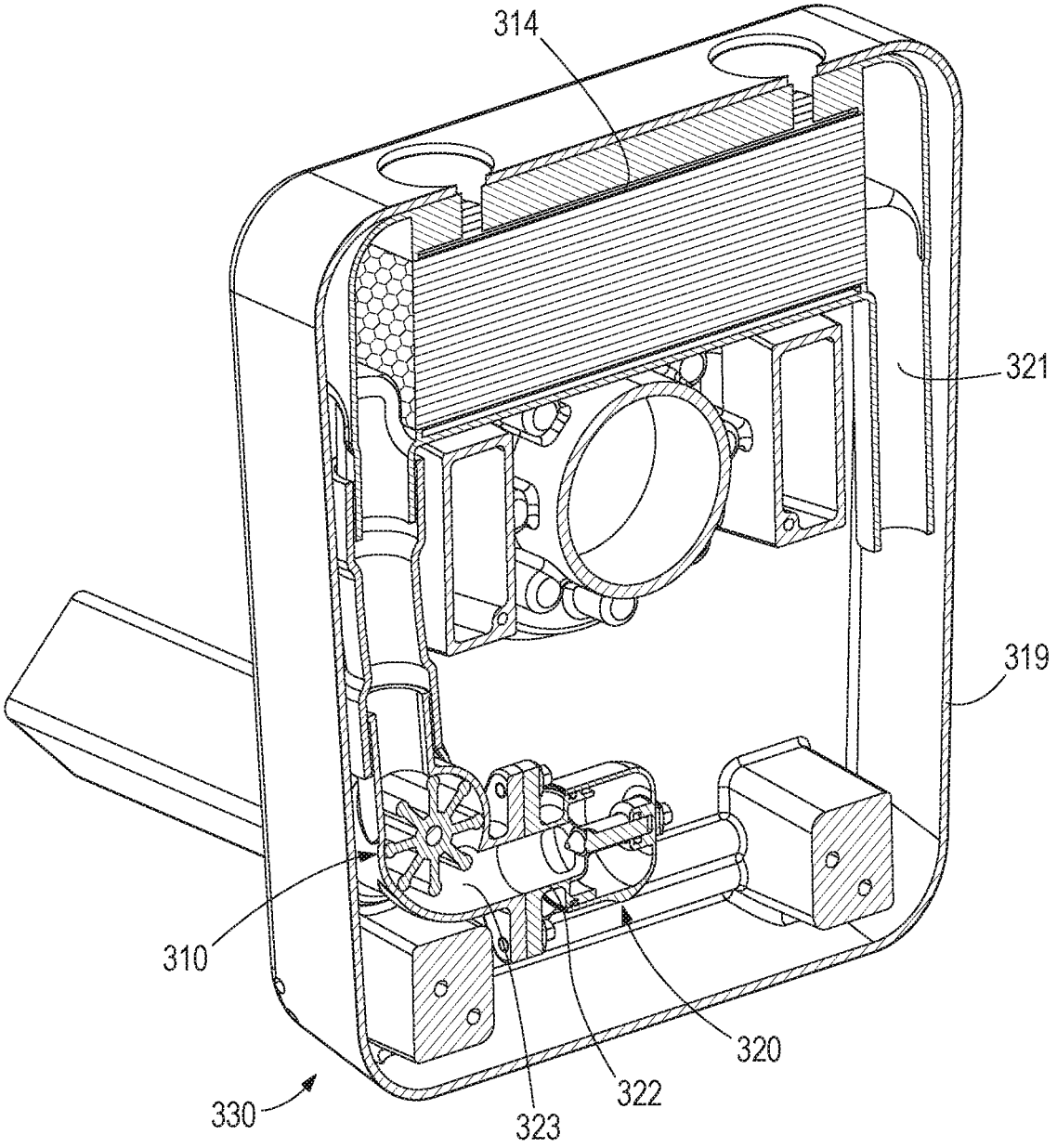
FIG. 5 is a cross-sectional view of an example cooling system of a marine drive according to the present disclosure.

Referring to FIGS. 1 and 5, the stern drive 12 has a cooling system 330 for cooling various components of the stern drive 12, including but not limited to the electric motor 14 and related components. In a non-limiting example, the cooling system 330 includes an open loop cooling circuit for circulating cooling water from the body of water in which the stern drive 12 is situated to various components of the stern drive 12 and then discharging the spent cooling water back to the body of water. The open loop cooling circuit comprises a water intake 300 (see FIG. 1) on the gearcase housing 26 which is connected via a conduit 301 to a cooling channel 302 (FIG. 4) defined between a lower annular flange 304 on the lower end of the driveshaft housing 22 and a second annular flange 306 on the top of the gearcase housing 26. Reference is made to the above-incorporated U.S. Pat. No. 10,800,502 which teaches this type of cooling conduit.

A flexible conduit 308 (FIG. 1) is coupled to the driveshaft housing 22 and configured to convey the cooling water from the cooling channel 302 (FIG. 4) to an electric pump 310 (FIG. 4) mounted on the mounting assembly 16. The electric pump 310 is configured to draw the cooling water in via the water intake 300, see FIG. 1, through the cooling channel 302, and through the flexible conduit 308. In certain examples, the electric pump 310 is powered by an electrical power source, such as a rechargeable battery, and further controlled by a control system 500 such that the operational speed of the electric pump 310 can be modified to vary the flow direction and/or the flow rate of the water being pumped by the electric pump 310 (described in greater detail herein below). In certain examples, the electric pump 310 is an electric pump however this is not limiting.

The electric pump 310 pumps the cooling water to a heat exchanger 314 (see FIG. 5) and then to an outlet, such as the outlet 315 shown in FIG. 1. Note that the stern drive 12 can further include a closed loop cooling circuit having a pump for pumping cooling fluid such as a mixture of water and ethylene glycol through the heat exchanger 314 thereby exchanging heat with the cooling water in the open loop cooling circuit. The mixture of water and ethylene glycol is circulated past the electric motor 14, an associated inverter 316 (FIG. 1), and/or one or more batteries for powering the electric motor 14, thus cooling these components. This cooling system is not limiting however and the stern drive 12 may include a wide variety of other components which are cooled by the system and the system may have a wide variety of other configurations.

Referring now to FIG. 5, a non-limiting example open loop cooling circuit for the cooling system 330 is partially depicted. The electric pump 310 is coupled to the mounting assembly 16 (see FIG. 1). The conduit 308 (FIG. 2) is coupled to a swivel joint 320 (FIG. 5) that is configured to rotate as the drive assembly 20 moves and/or trims thereby maintaining a fluid connection between the conduit 308 and a mounting boss 322. The electric pump 310 pumps the water through the swivel joint 320 and a conduit 323 (FIG. 5) to the heat exchanger 314 to thereby cool the cooling fluid in the closed cooling loop and the electric motor 14, the inverter 316 (FIG. 1), and/or one or more batteries, as noted above. The water passes out of the heat exchanger 314 and through an outlet conduit 321 to the environment in a manner known in the art.

The Applicant has recognized that during operation of the stern drive 12, the water intake 300 (FIG. 1), specifically the holes thereof, can become clogged (e.g., seaweed) due to the normal flow of water into the cooling system 330. The debris that is mixed with the incoming water can be strained by the water intake 300 as the water flows into the cooling system 330 and thereby clog the water intake 300. Furthermore, the debris may flow with the water into the other portions of the cooling system 330, such as the cooling channel 302 and/or the heat exchanger 314, such that clogs develop therein. These clogs can prevent efficient operation of the cooling system 330 by reducing the flow of cool water to heat exchanger 314 and/or heat-generating components of the stern drive 12. If not properly cooled, heat exchanger 314 and/or the other heat-generating components of the stern drive 12 may malfunction and/or require repair. In addition, the clogs can decrease the flow rate of the water and thus the electric pump 310 may operate for longer periods of time to thereby supply enough cooling water to the heat exchanger 314 and/or other heat-generating components of the stern drive 12. As such, the efficiency and/or life of the electric pump 310 is reduced.

The present Applicant has noted if screens or screen inserts 309 are optionally provided at the water intake 300 to prevent debris from clogging components of the cooling system 330, maintenance may be required to clean the screens or screen inserts 309 (e.g., scrubbing the screens or screen inserts 309, removing the screen inserts 309 for cleaning or replacement). The screens or screen inserts 309 may strain debris at the water intake 300, and the vacuum created by the electric pump 310 may hold the debris to the water intake 300 and/or the screens or screen inserts 309 thereby creating a restriction to water flow (e.g., a pocket defined between the screen inserts 309 and the gearcase housing 26 may trap debris that should be cleared). To avoid these problems, the present Applicant has developed the methods of the present disclosure which facilitate clearing debris from the holes of the water intake 300 and/or the screens or screen inserts 309 thereby reducing maintenance requirements related to clearing debris and/or cleaning the water intake 300 and/or the screens or screen inserts 309. The present Applicant has also recognized that the methods of the present disclosure can also be utilized in conjunction with water intakes 300 and/or screens or screen inserts 309 by automatically changing the speed and/or a direction of the electric pump 310 to clear debris therefrom.

The present Applicant has further noted that the diameter of the inlet holes of the conventional water intakes are often greater than the diameter of the tubes in the heat exchanger through which the cooling water flows. As such, debris passing through the inlet holes of the water intake may become lodged at the header or in the tubes of the heat exchanger. Enlarging the diameter of the tubes in the heat exchanger may disadvantageously result in increasing the size of the heat exchanger required to provide adequate cooling and/or decreasing the efficiency of the heat exchanger. As such, the Applicant developed the methods of the present disclosure which facilitate clearing debris from the holes of the water intake 300 and prevent clogging of the tubes of the heat exchanger 314 such that the diameter of the holes of the water intake 300 can be reduced to prevent large debris from entering the cooling system 330 and/or utilize compact, efficient heat exchangers 314 that take up less space on the marine vessel. The present Applicant also developed the methods of the present disclosure such that smaller holes in the water intake can be utilized to thereby prevent large debris from entering the cooling system via the water intake (i.e., reducing the size of the holes prevents debris larger than the holes from entering the cooling system). By reducing the size of the holes in the water intake and preventing ingress of large debris, heat exchangers with small diameter tubes can be utilized. The methods of the present disclosure advantageously clear debris from water intake with small holes and the heat exchangers with small diameter tubes requires less space on the marine vessel.

In addition, the present Applicant has recognized that debris may also be held on or over the water intake 300 due to the fluid pressure forces (e.g., vacuum forces) of the water flowing into the cooling system 330 via the water intake 300. As such, the debris covers or blocks at least a portion of the water intake 300 thereby reducing the flow of water into the cooling system 330. Note that fluid pressure forces holding the debris over the water intake 300 may be greater than the flow of water flowing past the water intake 300 as the marine vessel is moving through the body of water. As such, the movement of the marine vessel through the water may not clear the debris from the water intake 300. The debris covering the water intake 300 can prevent the efficient operation of the cooling system 330 and/or the electric pump 310 as noted above with respect to the debris that may clog the water intake 300 and/or other components of the cooling system 330.

Figure 3:
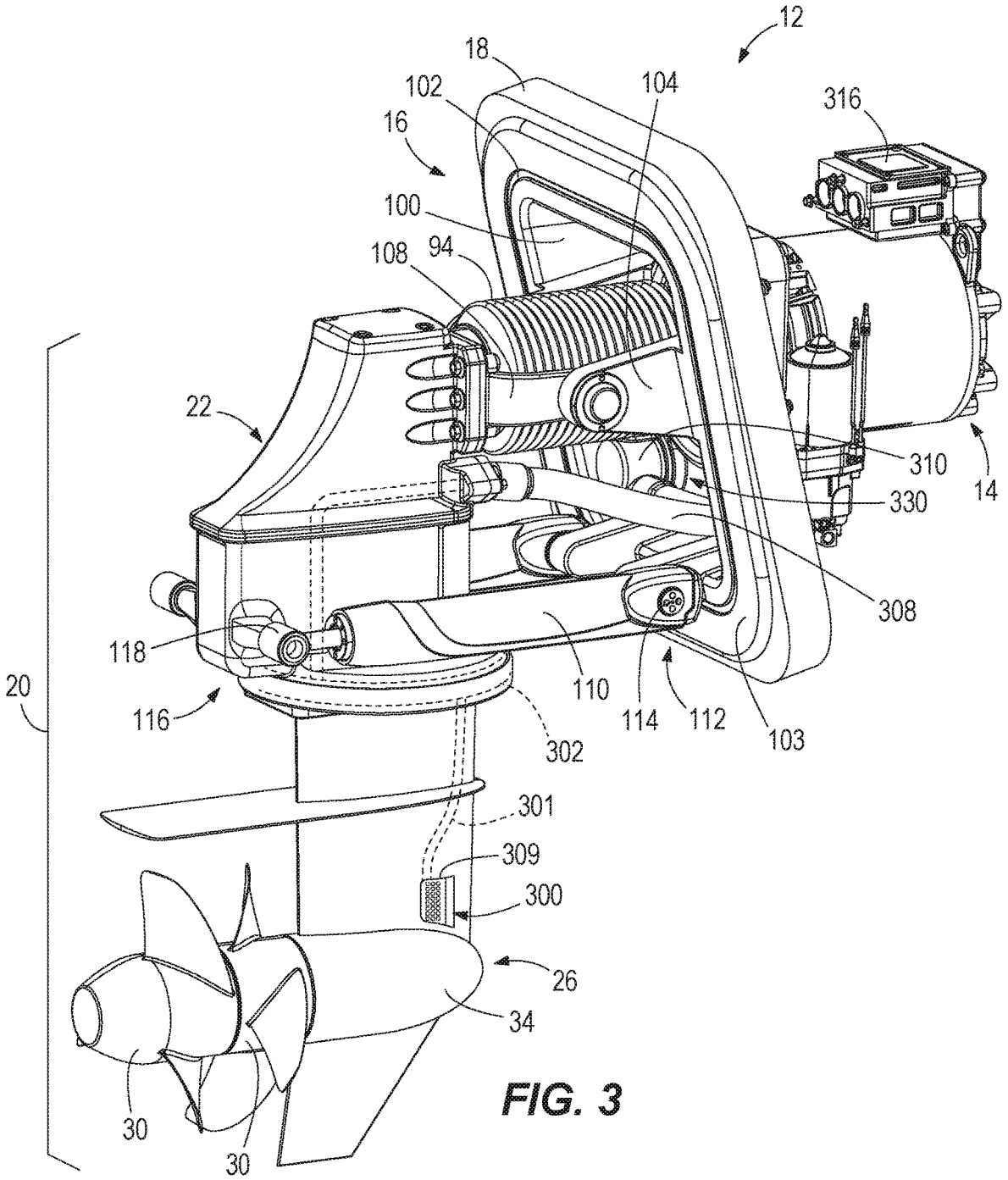
FIG. 3 is a starboard side perspective view of the marine drive.

Accordingly, the Applicant endeavored to develop systems and methods for operating the marine drive 12 that prevent or eliminate debris clogs and debris that block the water intake 300. As such, through experimentation and research, the present inventors have developed the presently disclosed methods of operating a marine drive which advantageously leverage versatile operational features of marine drive which are available by way of incorporation of the electrically-operated components, such as the electric pump 310 (FIG. 3). As such the marine drives of the present disclosure are capable of varying the flow rate and/or the flow direction of the cooling water into or out of the water intake 300.

Figure 6:
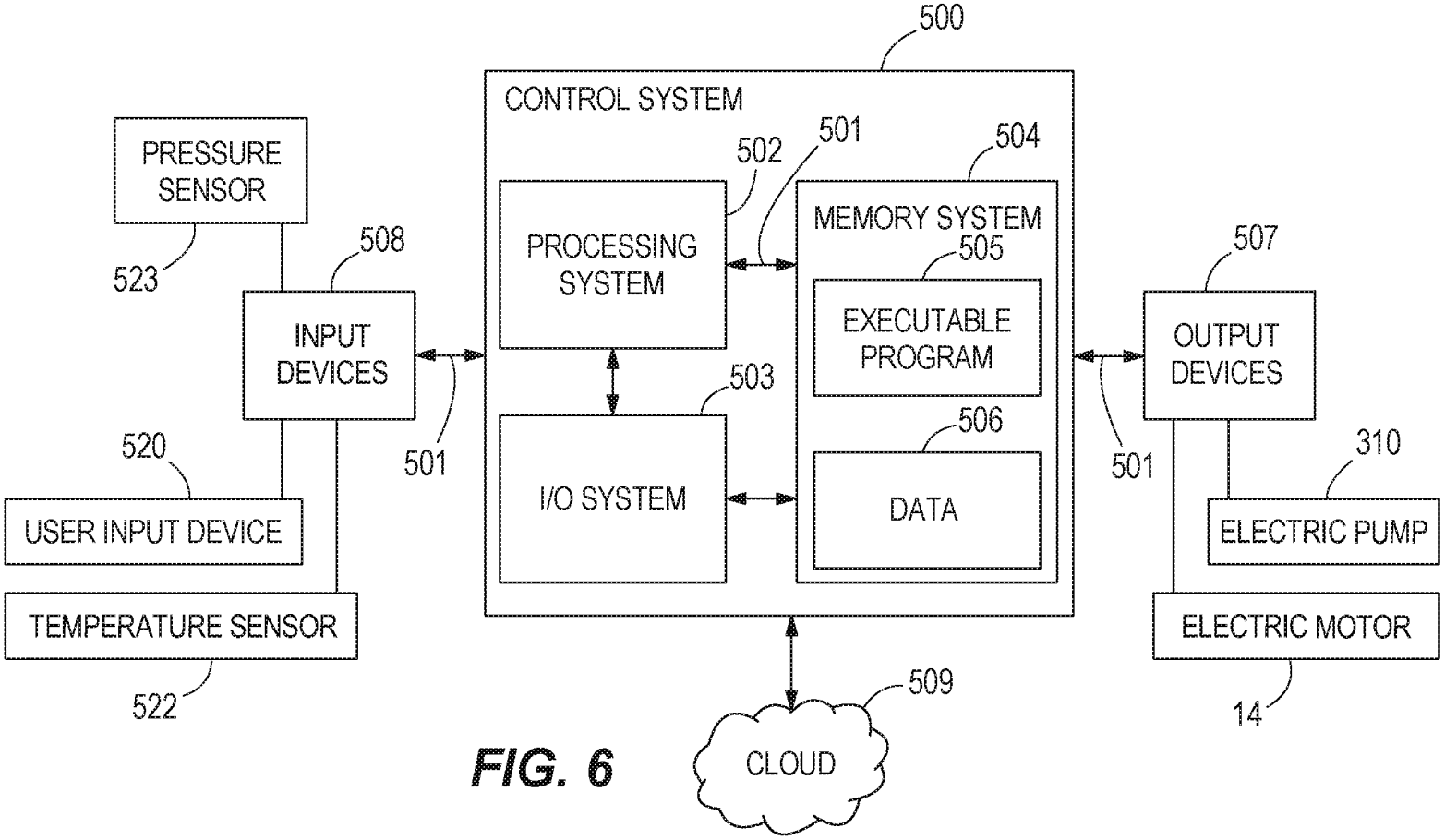
FIG. 6 is a schematic view of a control system of the marine drive according to the present disclosure.

Referring now to FIG. 6, the drive assembly 20 (FIG. 1) is operable in one or more propulsion modes (as noted above) and a control system 500 is configured to change the propulsion mode based on inputs received via user inputs received into the control system 500. The control system 500 is also further configured to control operation of the electric pump 310 to thereby vary the flow direction and/or the flow rate of the water into and out of the water intake 300 and facilitate clearance of debris from the water intake 300 and/or the associated cooling system 330. For instance, the control system 500 is configured to automatically modify a speed and/or a direction of the electric pump 310 to facilitate clearance of debris from the water intake 300. This example operation of the electric pump 310, and other example operations of the electric pump 310, are described herein below in more detail.

FIG. 6 depicts an example control system 500 for controlling various components of the stern drive 12. The control system 500 is in communication with the electric motor 14 and the electric pump 310, and the control system 500 is configured to control operation of the electric motor 14 and the electric pump 310. More specifically, the control system 500 is configured to control a speed and a direction of the electric motor 14 for rotating the universal joint 50 which rotates the driveshaft 24 and the output shaft(s) 28 to thereby control the thrust force generated by the propulsor 30 in the water. The control system 500 is also configured to control the speed and/or the direction of the electric pump 310 to thereby change the flow rate and/or the flow direction of the water being pumped by the electric pump 310.

Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

In certain examples, the control system 500 communicates with each of the one or more components of the stern drive 12 via a communication link 501, which can be any wired or wireless link. The control system 500 is capable of receiving information and/or controlling one or more operational characteristics of the stern drive 12 and its various sub-systems by sending and receiving control signals via the communication links 501. In one example, the communication link 501 is a controller area network (CAN) bus; however, other types of links could be used. In certain examples, the control system 500 is part of a larger control network such as a controller area network (CAN) or CAN Kingdom network, such as disclosed in U.S. Pat. No. 6,273,771, which is hereby incorporated by reference in its entirety.

It will be recognized that the extent of connections and the communication links 501 may in fact be one or more shared connections, or links, among some or all of the components in the stern drive 12. Moreover, the communication link 501 lines are meant only to demonstrate that the various control elements are capable of communicating with one another, and do not represent actual wiring connections between the various elements, nor do they represent the only paths of communication between the elements. Additionally, the stern drive 12 may incorporate various types of communication devices and systems, and thus the illustrated communication links 501 may in fact represent various different types of wireless and/or wired data communication systems.

The control system 500 may be a computing system that includes a processing system 502, memory system 504, and input/output (I/O) system 503 for communicating with other devices, such as input devices 508 (e.g., user input devices 520, temperature sensors 522, pressure sensors 523) and output devices 507 (e.g., electric pump 310), either of which may also or alternatively be stored in a cloud 509. The processing system 502 loads and executes an executable program 505 from the memory system 504, accesses data 506 stored within the memory system 504, and directs the stern drive 12 to operate as described in further detail below.

The processing system 502 may be implemented as a single microprocessor or other circuitry, or be distributed across multiple processing devices or sub-systems that cooperate to execute the executable program 505 from the memory system 504. Non-limiting examples of the processing system include general purpose central processing units, application specific processors, and logic devices.

The memory system 504 may comprise any storage media readable by the processing system 502 and capable of storing the executable program 505 and/or data 506. The memory system 504 may be implemented as a single storage device, or be distributed across multiple storage devices or sub-systems that cooperate to store computer readable instructions, data structures, program modules, or other data. The memory system 504 may include volatile and/or non-volatile systems, and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

During operation of the marine vessel, the control system 500 is configured to send signals (e.g., electric control signals) to the electric motor 14 which cause the electric motor 14 to operate in a first direction to rotate the universal joint 50, the driveshaft 24, and the output shaft(s) 28 in a first direction such that the drive assembly 20 generates a first (e.g., forward) thrust force in the water via the propulsor 30 (see FIGS. 1 and 4). Accordingly, the drive assembly 20 is in the forward mode (noted above). Alternately, the control system 500 sends signals to the electric motor 14 which cause the electric motor 14 to operate in an opposite, second direction, to rotate the universal joint 50, the driveshaft 24, and the output shaft(s) 28 in an opposite direction such that the drive assembly 20 generates a second (e.g., reverse) thrust force in the water via the propulsor 30. Accordingly, the drive assembly 20 is in the reverse mode (noted above). It will be understood to those skilled in the art that the control system 500 may send signals to the electric motor 14 which cause the electric motor 14 to cease operation, i.e., cease rotation of universal joint 50, the driveshaft 24, and the output shaft(s) 28, such that the drive assembly 20 does not generate thrust force in the water. The electric motor 14 can also be configured to cease operation when no signals are received from the control system 500 (e.g., when a joystick or a throttle lever as the user input device 520 are in a neutral position).

Note that the drive assembly 20 undergoes a shift change as the propulsion mode of the drive assembly 20 changes (e.g., between forward mode, reverse mode, and neutral mode). For example, a shift change occurs as the drive assembly 20 changes from the neutral mode to the forward mode. The shift change occurs in response to a request for the shift change generated by a user input device 520 or the control system 500 more generally (e.g., for station keeping or waypoint tracking). In the example of providing a command via a user input device 520, the user input device 520 sends a shift change signal to the control system 500 which in turn controls operation of the electric motor 14. In a conventional manner, the user input device 520 is any device capable of receiving an input from the operator of the marine vessel, and in certain examples, the user input device 520 included one or more levers, joysticks, switches, or touch screens, and/or the like. Note that the example shift changes noted above may be for shifting gears or the like for any type of suitable marine drive. For example, shift changes can occur in marine drives having gearcases that utilize gears to achieve propulsor rotation, gearcases with fixed gears in the gearcase, single and multi-speed clutched transmissions, and/or crash box style transmissions/gearcases that are shiftable when the marine drive is off.

As noted above, the control system 500 is further configured to control the electric pump 310 (FIG. 3) to control the speed and/or the direction of the electric pump 310 and thereby change the flow rate and/or the flow direction of the water being pumped by the electric pump 310. Such operation of the electric pump 310 is advantageous to facilitate a clearance of debris from the water intake 300 (FIG. 3). For example, the control system 500 is configured to automatically modify the speed and/or the direction of the electric pump 310 to facilitate clearance of debris from the water intake 300. The automatic modification may be provided in accordance with the program saved in the memory system 504 (FIG. 6) which defines when this modification should occur, for how long, and the speeds and/or directions for operating the electric pump 310. In certain examples, the logic for automatic modification further includes considerations of other inputs or conditions such as a velocity of the marine vessel, a pressure of the cooling system 330, a water temperature, or others. The logic may be stored as an algorithm, a data table, and/or other forms within the memory system 504. In certain instances, the control system 500 is configured to send signals to the electric pump 310 to increase the speed thereof which results in an increased flow and flow rate of water through the water intake 300. As such, additional cooling water cools components of the stern drive 12 (FIG. 1), as described above.

In other instances, the control system 500 sends signals to the electric pump 310 to decrease the speed thereof which results in decreased flow of water through the water intake 300. Decreasing the flow of water through the water intake 300 also reduces the fluid pressure forces holding the debris over the water intake 300, and as such, the debris tends to fall away from the water intake 300. Furthermore, the water moving past the drive assembly 20 (FIG. 1), for example as the drive assembly 20 moves from the neutral mode to the reverse mode such that the propulsors 30 direct water past the water intake 300, may act to push or sweep the debris from the water intake 300.

In certain examples, the control system 500 is also configured to automatically modify the speed of the electric pump 310 based upon whether the drive assembly 20 undergoes a shift change or a request for shift change is received by the control system 500 via the user input device 520 from the neutral mode to either the forward mode and the reverse mode. In these examples, the change in speed of the electric pump 310 will advantageously result in a clearing of debris from the water intake 300 (as noted above). In further examples, the direction of the electric pump 310 is also or alternatively modified automatically, also based on the shift change or request for shift change.

In certain examples, the control system 500 is configured to determine whether the drive assembly 20 undergoes a shift change by comparing a current throttle amount or requested throttle amount to a stored throttle amount. These throttle amounts may be provided or percentages of the throttle position relative to the neutral position (e.g., 0.0% throttle in forward, 100.0% for full throttle in forward, −100.0% in reverse). The stored throttle amount corresponds to one or more throttle amounts at which a shift change occurs (e.g., the percentage of throttle lever position which the vessel will shift from neutral to forward) or example, if the stored throttle amount is zero throttle and the current throttle amount and/or the requested throttle amount is determined by the control system 500 to be greater than zero (such that the drive assembly 20 is in the forward mode or the reverse mode), the control system 500 determines that the drive assembly 20 has undergone a shift change. In certain examples, the modification of the speed of the electric pump 310 by the control system 500 can comprise slowing the speed of the electric pump 310 or stopping the electric pump 310 to reduce the fluid pressure forces that are acting to hold the debris to the water intake 300.

In certain examples, the control system 500 is configured to automatically revert the speed of the electric pump 310 to a predetermined speed after having automatically modified operation of the electric pump 310, such as after expiration of a predetermined time period stored in the memory system 504. The predetermined time period can be any amount of time (e.g., 0.001 seconds, 0.500 seconds, 1.0 seconds, 5.0 seconds). The predetermined speed is also stored in the memory system 504. In certain examples, the predetermined speed corresponds to a normal operating speed of the electric pump 310 at which the electric pump 310 pumps a sufficient amount of water to thereby properly cool the components of the stern drive. In other examples, the predetermined speed corresponds to the speed of the electric pump 310 before the control system 500 modifies the speed of the electric pump 310 to clear debris from the water intake 300 (as described above). In one non-limiting example, 3.000 seconds after the control system 500 reduces the speed of the electric pump 310 based on a determined shift change of the drive assembly 20 (as noted above), the control system 500 automatically reverts the speed of the electric pump 310 back to a normal operating speed. In other non-limiting examples, the control system 500 is configured to stop the electric pump for a predetermined time period (e.g., 5.000 seconds) each time the drive assembly 20 undergoes a shift change or a request for shift change when changing from the forward mode, the reverse mode, and/or the neutral mode.

In certain examples, the control system 500 is configured to automatically revert to the speed of the electric pump 310 after a temperature of at least one component (e.g., electric motor) of the stern drive 12 reaches a threshold temperature stored in the memory system 504. The threshold temperature can be any temperature (e.g., 180.0 degrees Fahrenheit), and the temperature is measured by one or more temperature sensors 522 configured to sense temperature of one or more components of the stern drive 12. The temperature sensors 522 are in communication with the control system 500. When the control system 500 determines that the sensed temperature, which is sensed by the temperature sensor 522, is equal to or greater than the threshold temperature, the control system 500 automatically reverts the speed and/or the direction of the electric pump 310 back to a normal operating speed. By reverting the speed of the electric pump 310 back to a normal operating speed, the control system 500 may increase the flow of water to heat-sensitive components of the stern drive 12 and thereby provide sufficient cooling to these components to prevent damage thereto. Note that in certain examples, the temperature sensor 522 can be configured to sense the temperature of the water discharged from the heat exchanger 314 or the outlet 315 (FIG. 1), and the control system 500 may adjust the speed of the electric pump 310 based on the temperature of the water. For instance, if the temperature of the water is greater than a threshold temperature, the control system 500 may increase the speed of the electric pump 310 examples of how much to increase in RPM and/or as a percentage of maximum speed to thereby increase flow of cooling water to heat-sensitive components of the stern drive 12 thereby cooling these components. In another instance, if the temperature of the water is less than a threshold temperature, the control system 500 may maintain or decrease the speed of the electric pump 310 to thereby provide ample flow of water and cooling to heat-sensitive components of the stern drive 12 without unnecessarily operating the electric pump 310 at higher than necessary speeds to maintain the temperature of the water below the threshold temperature. Note that the control system 500 could also stop the speed of the electric pump 310 when the temperature of the water is less than the threshold temperature thereby reducing power consumption and electric pump operation.

Note that in certain examples, the control system 500 can be configured to change the speed of the electric pump 310 to facilitate clearance of debris from the water intake 300 based on other operational parameters of the marine vessel. For instance, the control system 500 may modify the speed of the electric pump 310 based on cooling system pressure, motor rpm, motor direction, temperature of the inverter, boat speed, trim position, throttle position at the helm, when the marine vessel is above a minimum speed, when the marine vessel is executing a turn, and/or steering position. The control system 500 can also be configured to automatically revert the speed of the electric pump 310 to a predetermined speed (e.g., normal operating speed) of the electric pump 310 when the drive assembly 20 undergoes a shift change or a request for shift change from the least one of the forward mode and the reverse mode back to the neutral mode. In this way, changing the speed of the electric pump 310 as the drive assembly 20 changes from the forward mode or the reverse mode to the neutral mode automatically clears debris from the water intake 300 (also described above). In certain examples, a timer or rev counter included with the control system 500 is utilized during operation and control of the electric pump 310. In certain instances, after a shift change and the control system 500 waits for a predetermined time to pass (e.g., 5.000 second) or for a predetermined number of revs to be counted (e.g., 80.0 revs) before modifying the speed and/or the direction of the electric pump 310).

In certain examples, the electric pump 310 is a bidirectional electric pump and the control system 500 is configured to facilitate the clearance of debris from the water intake 300 by causing the electric pump to temporarily pump cooling water in a direction out of the water intake 300 instead of a direction into the water intake 300. As such, the cooling water clears debris from the water intake 300.

The control system 500 can also be configured to facilitate the clearance of debris from the water intake 300 by causing the electric pump 310 to pulse cooling water flow in a direction into or a direction out of the water intake 300 by respectively decreasing and then increasing the speed the electric pump 310 (e.g., pulsing the cooling water flow includes controlling the speed of the electric pump 310 to 0.0% of maximum speed for 1.0 seconds and 80.0% maximum speed for 3.0 seconds for 2.0 seconds, repeated three times) in one non-limiting instance. In another example, the control system 500 is configured to cycle the electric pump 310 'on' and 'off' to facilitate the clearance of debris from the water intake 300 by changing the flow of the water into the water intake 300.

In certain examples, the control system 500 is configured to automatically modify the speed of the electric pump 310 based on comparison of pressure of the cooling water relative to a predetermined threshold pressure which is stored on the memory system 504. The pressure of the cooling water may be sensed by the pressure sensor 532 upstream or downstream of the electric pump 310. The pressure sensor 523 is in communication with the control system 500. For example, when the control system 500 determines that the sensed pressure, which is sensed by the pressure sensor 532, is less than the threshold pressure the control system 500 automatically modifies the speed and/or the direction of the electric pump 310 to facilitate clearance of debris from the water intake 300. Note that in other examples, the control system 500 automatically modifies the speed and/or the direction of the electric pump 310 to facilitate clearance of debris from the water intake 300 when the sensed pressure is equal to or greater than the threshold pressure. In still other examples, the control system 500 is configured to compare the sensed pressure to one or more look-up tables and/or algorithms. The control system 500 can be configured to determine if the speed and/or the direction of the electric pump 310 should be modified based on an operational characteristic of the electric pump 310 (e.g., pump RPM), the speed of the marine vessel, and/or the sensed pressure. In one instance, for known pump RPM and/or marine vessel speed and the sensed pressure, the control system 500 will utilize one or more look-up tables and/or algorithms to thereby determine if the speed and/or the direction of the electric pump 310 should be changed to facilitate clearance of the water intake 300. For example, during normal operation of the electric pump 310 the speed is 1400.0 RPM with pressure of the cooling water in the cooling system 330 being 80.0 kpa. If the sensed pressure drops of 50.0 kpa while the speed of the electric pump 310 remains at 1400.0 RPM, the control system 500 determines that the water intake 300 is blocked and thereby changes the speed of the electric pump 310 to clear the blockage.

Figure 7:
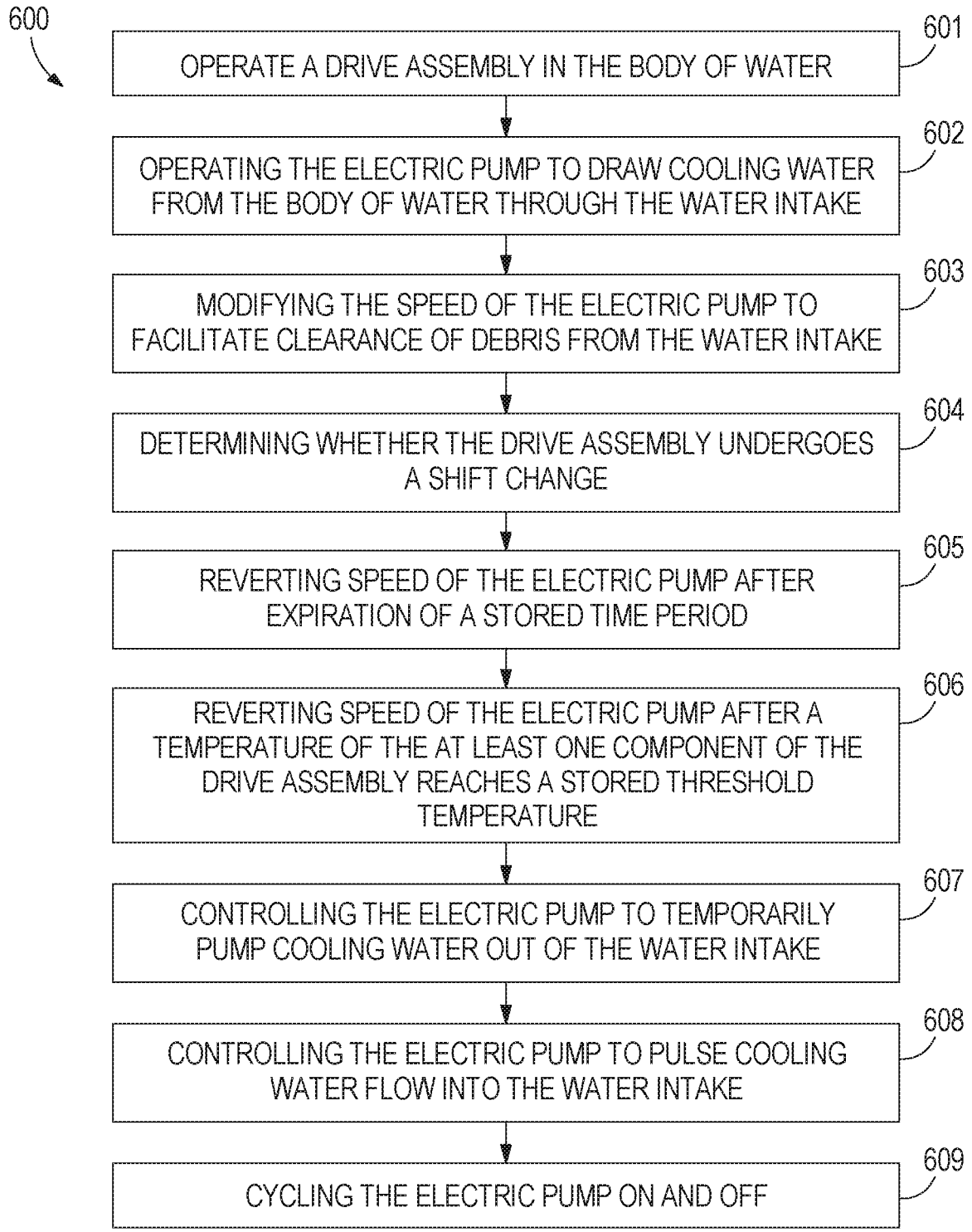
FIG. 7 is a flow chart depicting an example operation of the marine drive according to the present disclosure.

FIG. 7 depicts an example method 600 for operating an example cooling system 330 of a marine drive, such as the stern drive 12 noted above with respect to FIGS. 1-5.

In the example method 600 depicted in FIG. 7, the method 600 includes at step 601 operating a drive assembly 20 in one of a neutral mode, in the forward mode for generating a forward thrust force in a body of water, and in the reverse mode for generating a reverse thrust force in the body of water. At step 602, the electric pump 310 is operated to draw cooling water from the body of water through the water intake 300 for cooling at least one component (e.g., the electric motor 14) of the stern drive 12. To facilitate clearance of debris from the water intake 300 (as noted above), at step 603, the control system 500 modifies the speed of the electric pump 310 such that the flow rate of the cooling water received through the water intake 300 changes. In certain examples, the control system 500 modifies the speed of the electric pump 310 by slowing or stopping the electric pump. The method 600 can further optionally include, at step 604, determining whether the drive assembly 20 undergoes a shift change between one of the propulsion modes (described above) by comparing a current throttle amount to a stored throttle amount (noted above). In certain examples, the control system 500 may control the electric pump to revert the speed of the electric pump 310 when the drive assembly 20 undergoes the shift change or after a predetermined amount of time passes after the shift change.

In certain examples, the method 600 optionally includes reverting speed of the electric pump 310 to the predetermined speed of the electric pump 310 after the expiration of a stored time period (described above), at step 605. In certain examples, the method 600 optionally includes reverting the speed of the electric pump 310 to a predetermined speed after a temperature of the at least one component of the drive assembly 20 reaches a stored threshold temperature (described above), at step 606. In certain examples, the method 600 optionally includes, at step 607, controlling the electric pump 310 to facilitate the clearance of debris from the water intake by causing the electric pump 310 to temporarily pump cooling water out of the water intake. In certain examples, the method 600 optionally includes, at step 608, controlling the electric pump 310 to facilitate the clearance of debris from the water intake by causing the electric pump to pulse cooling water flow into the water intake 300 by decreasing and then increasing the speed of the electric pump 310. In certain examples, the method 600 optionally includes, at step 609, cycling the electric pump 310 on and off to facilitate the clearance of debris from the water intake 300.

Through research and development in the field of marine drives, the present inventors realize that submerged, moving bodies experience drag from the shear stress of the water dragging on the wetted surface of the body, and pressure or form drag caused by the pressure differential between the fore and aft submerged portions of the body. Form drag is mainly caused by a wake region generated behind the body. In this region, the boundary layer is detached and a region of low pressure is developed, "sucking" the body backwards. To reduce the pressure or form drag on the body, marine drives having internal combustion typically vent exhaust from the aft portion of the body. The ventilated exhaust increases the local pressure on the aft portion body of the drive, and streamlines the flow around the submerged portion of the drive, thereby improving the performance of the marine drive. In marine drives utilizing an electric motor, however, the present inventors have realized that there is no exhaust that can be vented from the marine drive. In lieu of exhaust, the inventors have also determined that atmospheric air may be routed from the upper housing of the marine drive, into the gearcase housing, through the propulsor, and into the wake region behind the gearcase, thus achieving the functional advantages discussed above.

The inventors have further determined that, when the marine drive is operated in a reverse gear, air, exhaust, and/or other gas(es) vented from the aft portion of the submerged portion of the marine drive may increase the pressure at the fore portion of the gearcase (i.e., in front of the reverse direction of travel of the submerged portion of the marine drive), thereby impeding the performance of the reversing marine drive. Thus, it may be advantageous to prevent the air, exhaust, and/or other gas(es) from venting from the marine drive while the marine drive is operating in the reverse gear. Furthermore, when the marine drive is operated in the reverse gear, water may enter into an outlet passage in the gearcase for conveying the air, exhaust, and/or other gas(es) to the ventilation outlets proximate the propulsor. The present inventors have thus also determined that it would be advantageous to inhibit the flow of water into interior portions of the marine drive via the outlet passage while still allowing the air, exhaust and/or other gas(es) to travel through the outlet passage when the marine drive is operated in the forward direction.

Figure 8:
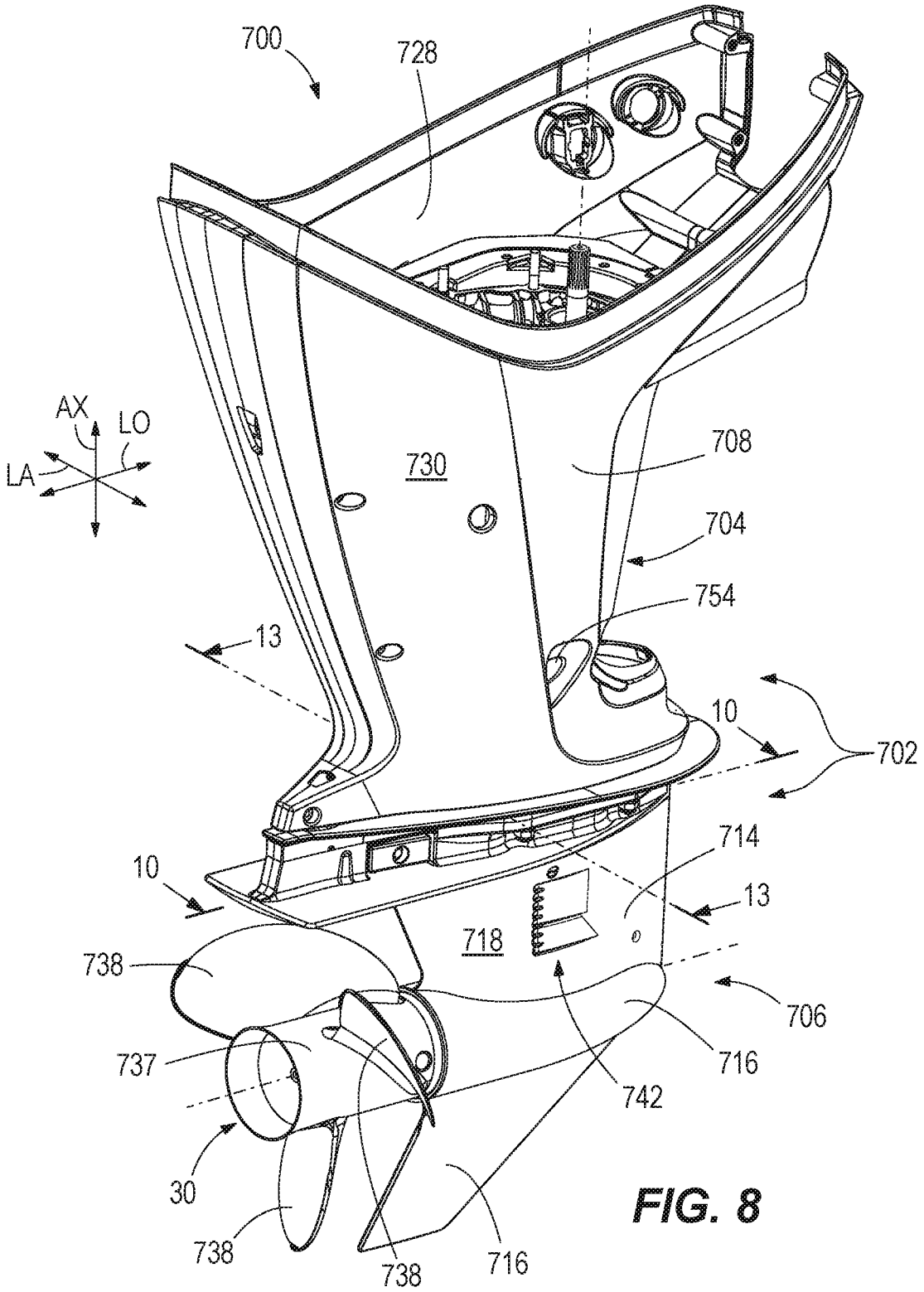
FIG. 8 is a rear perspective view of a lower portion of a second embodiment of a marine drive according to the present disclosure.
Figure 9:
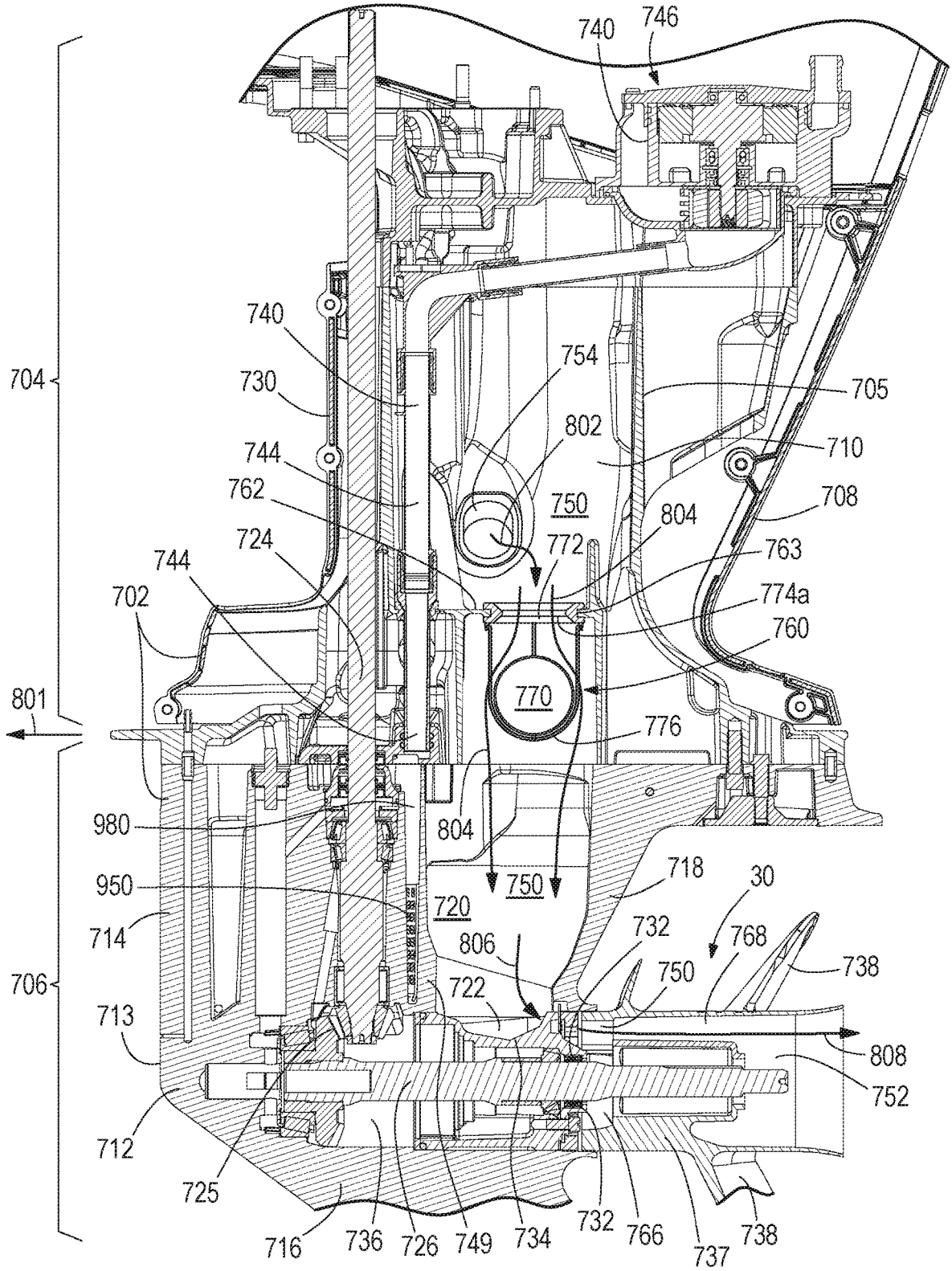
FIG. 9 is a sectional view of the marine drive.
Figure 12:
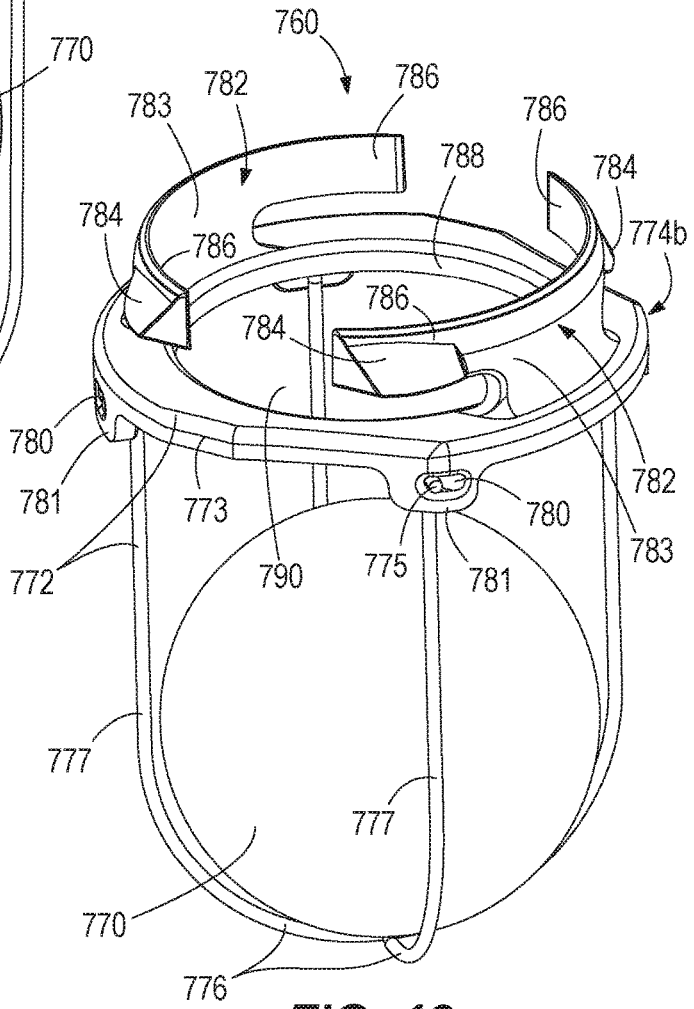
FIG. 12 is an isometric view of a ball valve in an open position.
Figure 13:
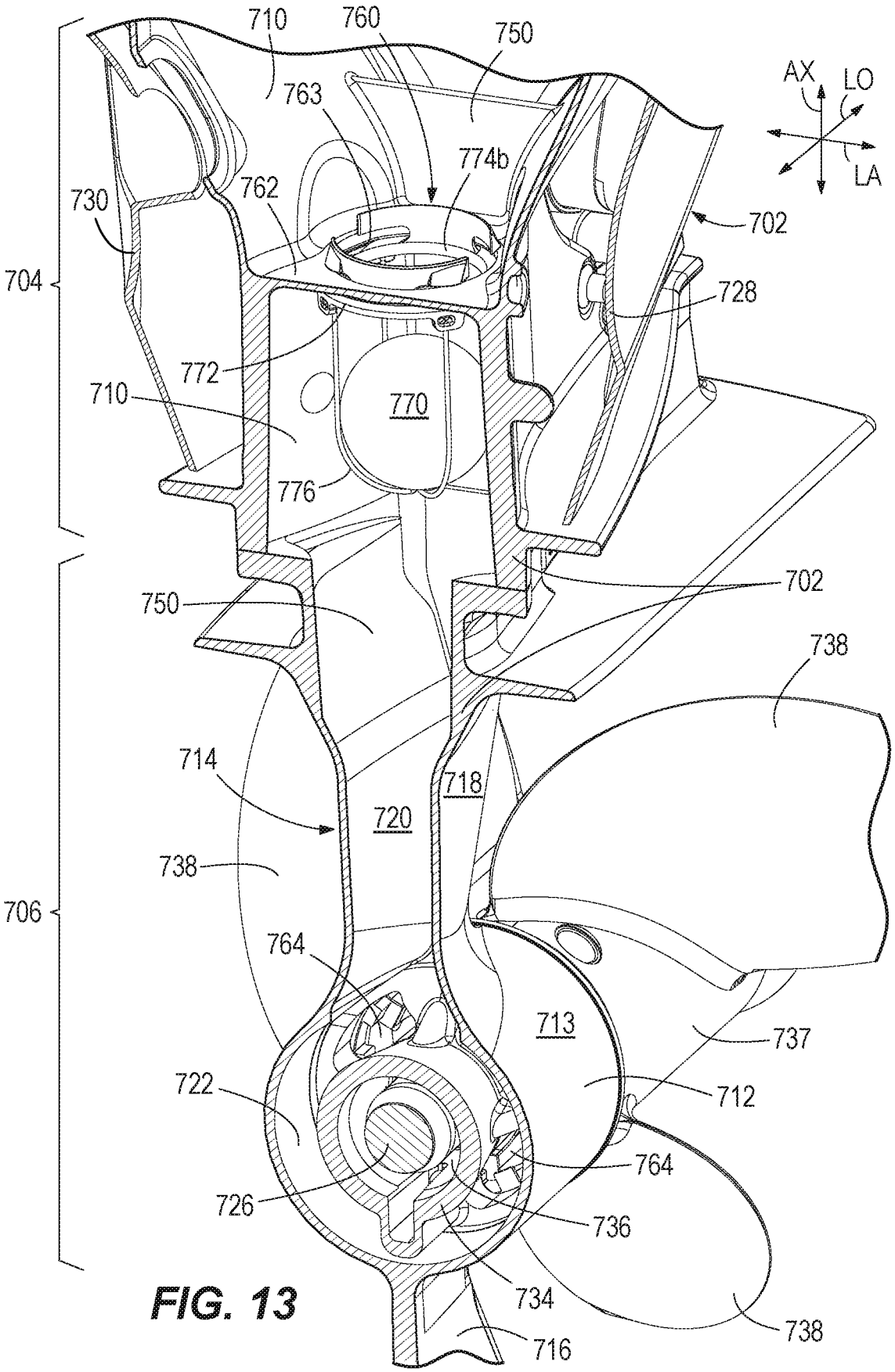
FIG. 13 is a view of section 13-13, taken in FIG. 8.

Referring to FIGS. 8, 9, and 13, embodiments of a marine drive may include an upper unit (not shown) and a lower unit 700 supported by the upper unit. In some embodiments, the upper unit may be configured as a powerhead including an internal combustion engine, an electric motor, batteries, electrical components, and/or any other componentry or systems for operating the marine drive. In the illustrated embodiment, the lower unit 700 extends from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO. In embodiments of a marine drive configured as a stern drive (e.g., the stern drive 10 of FIGS. 1-3) the lower unit of the stern drive may be suspended from the driveshaft housing. In embodiment of a marine drive configured as an outboard motor (e.g., the marine drive of FIGS. 8-20), the lower unit 700 may be suspended from the upper unit, which may include a motor, batteries, and/or other componentry. In the illustrated embodiments, the lower unit 700 includes a housing 702 configured to support a propulsor 30 for generating a thrust force in the water. The housing 702 includes an upper housing 704 extending downwardly in the axial direction AX from the upper unit and a lower housing 706 suspended from a bottom end of the upper housing 704.

It should be appreciated that, in some embodiments, at least a portion of the upper housing 704 and/or the lower housing 706 may be configured as a part of the upper unit of a marine drive. For example, the upper housing 704 may be configured as an extension leg that is part of the upper unit and extends downwardly from a powerhead. Additionally or alternatively, at least a portion of the illustrated upper housing 704 may be configured as part of the lower housing 706, and/or a portion of the lower housing 706 may be configured as part of the upper housing 704. In some embodiments, the upper housing 704 and the lower housing 706 may be configured as a single, unitary housing.

With continued reference to FIGS. 8, 9, and 13, the upper housing 704 includes a support leg 705 extending downward from the upper unit and a perimeter wall 708 (FIG. 8) formed by a port side housing panel 728 and a starboard side housing panel 730. The port and starboard side housing panels 728, 730 are suspended from the support leg 705. A generally hollow interior passage 710 extends through the support leg 705 from the top to the bottom of the upper housing 704. In some embodiments, the perimeter wall 708 may be formed by more than two cowling panels, while other embodiments may be configured with a monolithic perimeter wall.

The lower housing 706 includes a gearcase housing 712 with a smooth outer surface 713 which transitions to an upwardly extending stem 714 and a downwardly extending skeg 716. The stem 714 extends upwards from the gearcase housing 712 to the bottom end of the upper housing 704 and is suspended therefrom. Similar to the upper housing 704, the stem 714 has perimeter side wall 718 that defines a hollow interior passage 720 (FIG. 13) that extends from a top end of the stem 714 to the gearcase housing 712 of the lower housing 706. The interior passage 720 formed through the stem 714 is generally aligned with the interior passage 710 formed through upper housing 704. Thus, a continuous passage extends through housing 702 of the lower unit 700 from the upper unit of the marine drive to the gearcase housing 712.

Referring to FIGS. 9 and 13, the gearcase housing 712 defines an interior cavity 722 that is connected to the interior passage 720 extending through the stem 714. A driveshaft 724 (FIG. 9) extends vertically from the upper unit, through the interior passages 710, 720 in the upper housing 704 and the stem 714 to a propulsor shaft 726 that extends out from the aft side of the gearcase housing 712 and supports the propulsor 30. The interior cavity 722 may be configured to house an angled gearset 725 (FIG. 9) that operatively connects the driveshaft 724 to the propulsor shaft 726 such that rotation of the driveshaft 724 causes rotation of the propulsor shaft 726, thereby rotating the propulsor 30 to create a thrust force to propel the marine vessel through the water. The propulsor 30 is configured as a propeller comprising a hub 337 supported on the propulsor shaft 726 and a plurality of blades 738 spaced circumferentially around the radially outer surface of the hub 737. The propulsor shaft 726 is rotatably supported by at least one bearing 732 (FIG. 9) positioned in a bearing carrier 734. The bearing carrier 734 is positioned in the interior cavity 722 of the gearcase housing 712 and is sealed against the interior surfaces of the interior cavity 722, thereby defining a lubricant cavity 736 that is sealed off from the interior passages 710, 720 in the housing 702. As discussed in further detail below, at least the interior passages 710, 720 in the housing 702, the interior cavity 722 of the gearcase housing 712, and channels 764, 766, 768 extending into and through the propulsor 30 provide an outlet passage 750 for conveying a flow of air, exhaust, and/or other gas(es) to an outlet opening 752 (FIG. 9) configured to discharge the air, exhaust and/or other gas(es) to ventilate the water proximate the propulsor 30.

Referring to FIG. 9, the embodiments of a marine drive may be configured with a cooling system 740 for cooling various components of the marine drive including but not limited to a battery, an electric motor and related components, and/or any other componentry positioned in the upper unit or lower unit 700. In a non-limiting example, the cooling system 740 includes an open loop cooling circuit for circulating cooling water from the body of water in which the marine drive is situated to various components of the marine drive before discharging the spent cooling water back to the body of water. The open loop cooling circuit comprises at least one water intake 742 (FIG. 8) on the gearcase housing 712. The illustrated lower unit 700 includes water intakes 742 formed in the opposite port and starboard sides of the stem 714. As will be discussed in further detail below, the water intakes 742 may include a screen 950 configured to filter debris from the inflowing cooling water, and a backflow of water through into the lower unit 700 clears the debris from the screen 950. The water intakes 742 are connected via a conduit 744 to a cooling water pump 746 (FIG. 9) positioned proximate a top end of the upper housing 704. Some embodiments, however, may be configured with a cooling water pump 746 positioned at a different location in the lower unit 700 and/or in the upper unit of the marine drive. As illustrated in FIG. 9, the conduit 744 extends through the upper housing 704 and the lower housing 706 proximate the front side of the lower unit 700 and generally parallel to the interior passages 710, 720 and the driveshaft 724. Some embodiments, however, may include a differently configured conduit 744 extending between a water intake 742 and the cooling water pump 746.

The cooling water pump 746 is configured to draw the cooling water into the marine drive via the water intake 742, through the cooling water intake passage 980, and to a heat exchanger (not shown) via the conduit 744. In some embodiments, the marine drive may include a closed loop cooling circuit having a pump for pumping cooling fluid, such as a mixture of water and ethylene glycol, through the heat exchanger, thereby exchanging heat with the cooling water in the open loop cooling circuit.

As previously mentioned, embodiments of the lower unit 700 of a marine drive may include an outlet passage 750 (FIGS. 9, 10, and 13) configured to convey air through the upper and lower housings 704, 706 in order to vent the air from the aft portion of the lower unit 700 through an outlet opening 752 (FIGS. 9 and 10) proximate the propulsor 30 and/or positioned in the propulsor 30. In the embodiments of FIGS. 8-20, the lower unit 700 is configured for use with an electric marine drive which intakes air from the exterior of the housing 702 via at least one air intake 754 in order to vent said air via the outlet opening 752. It should be appreciated that some embodiments of a marine drive may be configured to vent a different gas composition from an outlet opening 752 to improve performance of the marine drive. For example, a marine drive utilizing an internal combustion engine may be configured to route exhaust through the outlet passage 750 to be vented through an outlet opening 752.

Figure 10:
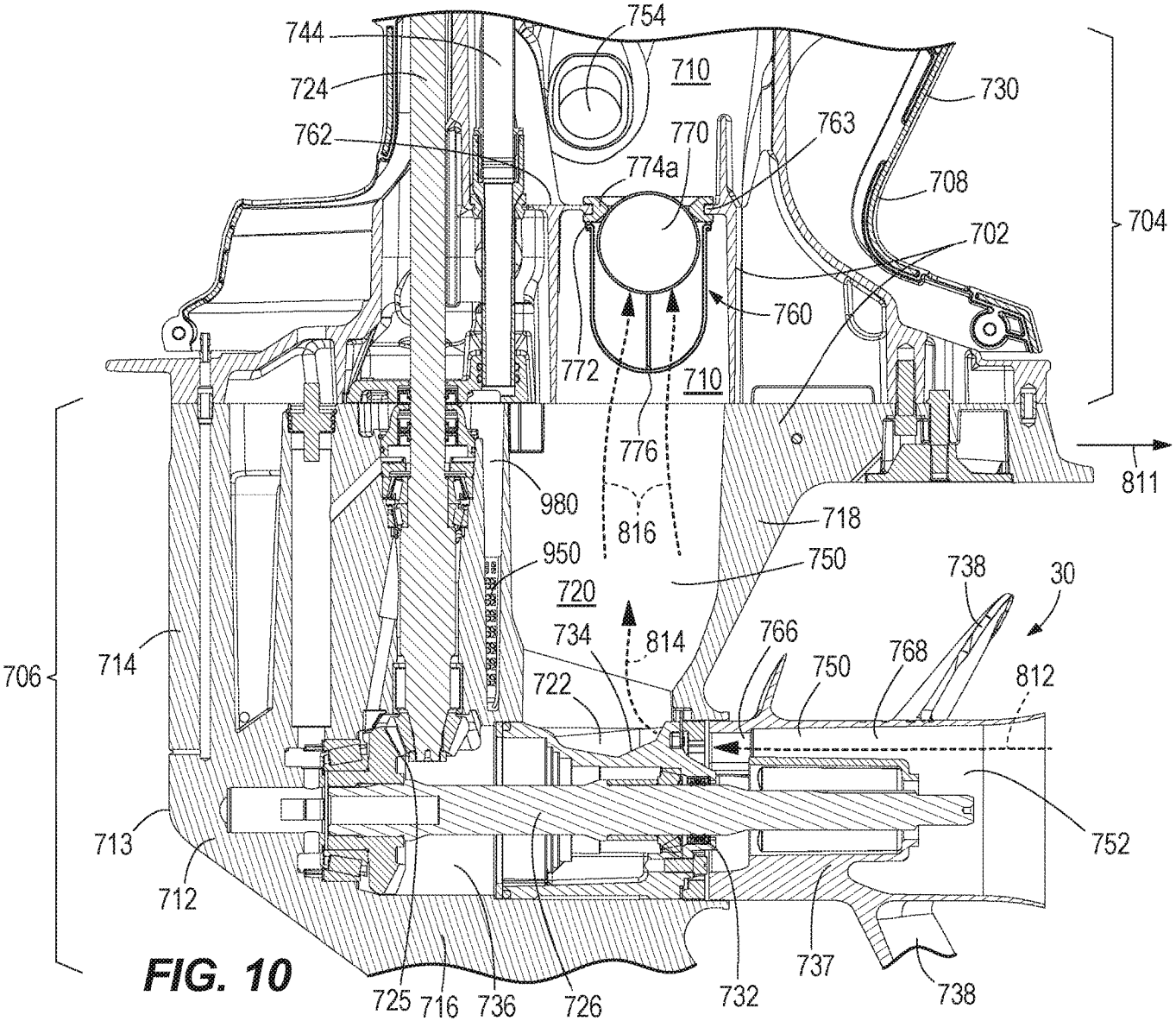
FIG. 10 is a view of section 10-10, taken in FIG. 8.

Referring to FIGS. 9, 10, and 13, at least one air intake 754 formed through the port side housing panel 728 and/or the starboard side housing panel 730 of the upper housing 704 allows air to enter into the interior passage 710 in the upper housing 704. In some embodiments, air may be forced/drawn into and through the air intakes 754 as the marine drive propels the marine vessel in a forward direction through the water. The outlet passage 750 extends from the interior passage 710 in the upper housing 704, through a valve device 760 positioned in a generally horizontal bulkhead 762 formed in the interior passage 710, through the interior passage 720 in the stem 714, and into the interior cavity of the gearcase housing 712. The outlet passage 750 then extends around the bearing carrier 734 via at least one channel 764. In the embodiments of FIGS. 8, 9, and 11-16, the outlet passage 750 includes a number of channels, for example four channels extending around opposite sides of the bearing carrier 734 (See FIG. 13). Some embodiments may include more or less channels. The channels 764 open into an annular channel 766 which formed circumferentially around the propulsor shaft 726 in the hub 737 of the propulsor 30. The outlet passage 750 continues through a linear channel 768 extending parallel to the propulsor shaft 726. The linear channel 768 extends through the hub 737 from the annular channel 766 to the outlet opening 752 formed in the back end of the hub 737 of the propulsor 30. Thus, the air, exhaust, and/or other gas(es) conveyed through the outlet passage 750 is vented through an outlet opening 752 formed in the propulsor 30.

Embodiments of the valve device 760 are configured to allow the flow of the air, exhaust, and/or other gas(es) out to the water at least when the marine drive is operated in a forward gear. However, when the marine drive is operated in the reverse gear, the valve device 760 at least partially prevents a backflow the water past the valve device 760. In the embodiments of FIGS. 9, 10, and 13, the valve device 760 is configured as a ball valve 760 positioned in the bulkhead 762 and movable between an open position (FIGS. 9 and 13) and a closed position (FIG. 10).

Figure 11:
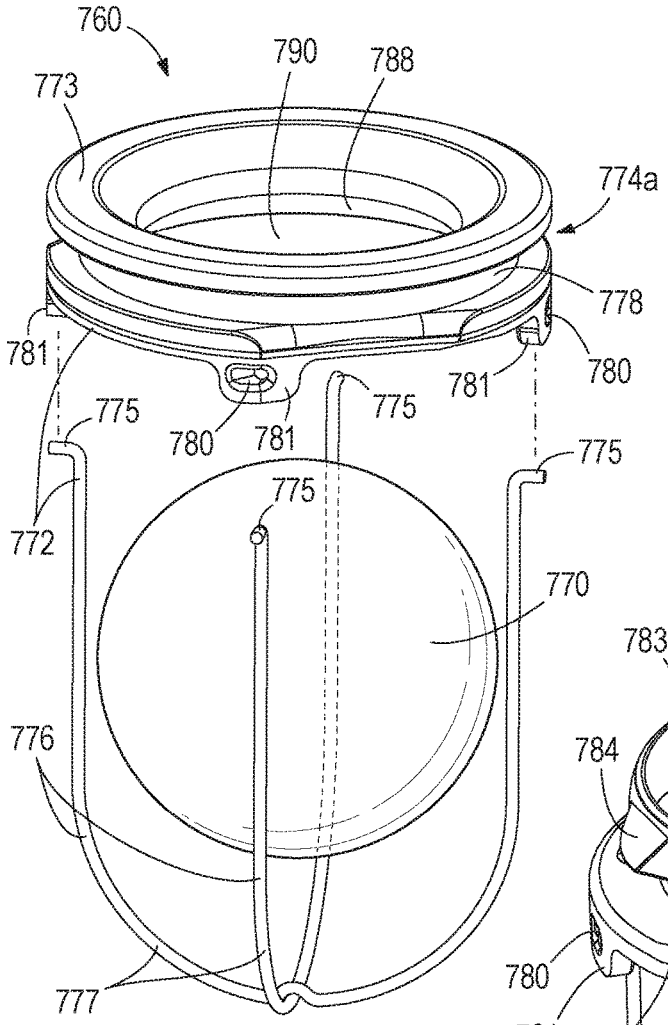
FIG. 11 is an exploded view of a ball valve.

Referring to FIGS. 11 and 12, embodiments of a ball valve 760 may include a ball 770 that is received in a seat 772 such that the ball 770 is movable within the seat 772 into and between the open and closed positions. For example, referring to FIGS. 11 and 12, embodiments of a ball valve 760 may include a seat 772 having a retainer ring 774*a*, 774*b* configured to support the ball valve 760 in the bulkhead 762, and a cage 776 suspended from the retainer ring 774*a*, 774*b* below the bulkhead 762. The retainer ring 774*a*, 774*b* is received in an opening 763 (FIGS. 9, 10, and 13) formed through the bulkhead 762.

Referring to FIG. 11, embodiments of a seat 772 may include a generally cylindrical retainer ring 774*a* with a through bore 790 extending through a body 773 of the retainer ring 774*a* from top to bottom. An annular channel 778 is formed into the radially outer surface of the retainer ring 774*a*. The annular channel 778 is configured to receive the radially inner edge of the opening 763 through the bulkhead 762 to secure the retainer ring 774*a* therein, as illustrated in FIGS. 9 and 10. The cage 776 is formed by wire members 777 that are generally U-shaped. Distal ends 775 of the wire members 777 are received in openings 780 formed through mounting flanges 781 that extend downward form the retainer ring 774*a* to suspend the wire members 777 from the retainer ring 774*a*. In the illustrated embodiments, the cage 776 includes two wire members 777 which are disconnected from each other. Some embodiments, however, may be differently configured. For example, a cage 776 may include more than two wire members 777, and/or at least two wire members 777 may be joined in a unitary wire structure.

Referring to FIG. 12, another non-limiting embodiment of a seat may include a generally cylindrical retainer ring 774*b* with a through bore 790 extending through the body 773 of the retainer ring 774*b* from top to bottom. Similar to the retainer ring 774*a* of FIG. 11, the retainer ring 774*b* of FIG. 12 includes mounting flanges 781 that project downward from the body of the retainer ring 774*b* and are configured to be engaged by the cage 776 to suspend the cage 776 therefrom. To secure the retainer ring 774*b* of FIG. 12 to the bulkhead 762 in the outlet passage 750, the retainer ring 774*b* includes opposing snap fit members 782. Each snap fit member 782 includes a center portion 783 that extends upwards from the body 773 of the retainer ring 774*b*. Lateral arms 786 extend from opposite sides of the center portion 783 and generally follow the curvature of the through bore 790. Ramped projections 784 project radially outward from each of the lateral arms 786 proximate the distal ends of the lateral arms 786. The illustrated retainer ring 774*b* of FIG. 12 may be inserted into the opening 763 through the bulkhead 762 from below. As the retainer ring 774 is pressed upwards, engagement between the edge of the opening 763 and the ramped projections 784 presses the lateral arms 786 radially inward so that they can pass through the opening 763. Once the ramped projections 784 pass though the opening 763, the lateral arms 786 move radially outward towards their original positions, thereby sandwiching the edge of the opening 763 in the bulkhead 762 between the body 773 of the retainer ring 774*b* and the bottom surfaces of the ramped projections 784 to secure the retainer ring 774*b* in the opening 763, as illustrated in FIG. 13.

In non-limiting embodiments of a lower unit 700 utilizing a ball valve 760 according to FIG. 11 (e.g., FIGS. 9 and 10) or the ball valve 760 according to FIG. 12 (e.g., FIG. 13), the ball 770 is retained in the seat 772 by the cage 776 and the retainer ring 774*a*, 774*b*. Horizontal movement of the ball 770 in the lateral direction LA and the longitudinal direction LO is restricted by the wire members 777 of the cage 776. The range of vertical movement in the axial direction AX of the ball 770 is bound by the cage 776 and the retainer ring 774*a*, 774*b* such that the ball 770 can move vertically between an open position (FIGS. 9 and 13) and a closed position (FIG. 10). The ball 770 has a density which is lower than the density of water such that the ball 770 has a positive buoyancy and will float in water. This may be useful, for example, to transition the ball valve 760 from the open position towards the closed position.

As illustrated in FIG. 9, when the ball valve 760 is in the open position, the ball 770 rests at the bottom of the cage 776 such that air, exhaust and/or other gas(es) may flow through the bulkhead 762 via the through bore 790 formed through the retainer ring 774*a* (Or retainer ring 774*b*). As illustrated in FIG. 10, when the ball valve 760 is in the closed position, the ball is pressed upwards against the bottom of the retainer ring 774*a*. In this position, the outer surface of the ball 770 abuts the radially inner surface 788 (FIG. 11) of the through bore 790 formed in the retainer ring 774*a*. Thus, in the closed position of the ball valve 760, the ball 770 forms a seal against the radially inner surface 788, thereby sealing the through bore 790 and preventing the flow of any fluid(s) through the ball valve 760.

To control the flow of fluid(s) through the outlet passage 750 via the ball valve 760, the ball 770 is configured to automatically move between the open position and the closed position in response to the normal operation of the marine drive. Referring to FIG. 9, when an electric marine drive including the lower unit 700 is operated in a forward gear, the marine drive propels the marine vessel in the forward direction indicated by arrow 801. As the marine vessel and marine drive move in the forward direction indicated by 801, air introduced into the housing 702 via at least one air intake 754 flows through the outlet passage 750 and is ventilated from the lower unit 700 proximate the propulsor 30. In the illustrated embodiments, air is drawn through the air intake 754 and into the interior passage 710 of the upper housing 704, for example along the path indicated by arrow 802, via a vacuum created by propulsor-induced velocity and/or the low pressure zone created behind the forwardly moving unit. In other examples, air may be forced into the air intake 754 and interior passage 710 via positive (ram) pressure. The flow of air into the interior passage 710 in the upper housing 704 would the air pressure in the interior passage 710, thereby causing the air to flow through the outlet passage 750.

With continued reference to FIG. 9, air flows from the interior passage 710 of the upper housing 704 to the interior passage 720 in the stem 714 via the ball valve 760, for example along the paths indicated by arrows 804. If the ball valve 760 is in the closed position (FIG. 10) as air begins to flow through the outlet passage 750, the air forces the ball 770 downward out of engagement with the retainer ring 774*a* and towards the bottom of the cage 776, thereby moving the ball valve 760 into the open position (FIG. 9). Additionally or alternatively, the force of gravity may pull the ball 770 downwards to force the ball valve 760 into the open position alone or in conjunction with the downward flow of air. Thus, operating the marine drive in a forward gear automatically moves the ball valve 760 into an open position so that the flowing air is permitted to flow around the ball 770 and through the ball valve 760.

Continued inflow of air through the air intake 754 maintains a pressure gradient that forces the air to flow further through the outlet passage 750. With continued reference to FIG. 9, after flowing past the ball valve 760, the air continues to flow downward through the outlet passage 750 in the direction of arrows 804. The flowing air travels through the lower portion of the interior passage 710 in the upper housing 704, through the interior passage 720 in the stem 714 of the lower housing 706, and into the interior cavity 722 in the gearcase housing 712, for example along the flow path indicated by arrow 806. Continuing through outlet passage 750, the air in the interior cavity 722 of the gearcase housing 712 flows around the bearing carrier 734 via the channels 764 (FIG. 13). Air exiting the channels 764 exits the back end of the gearcase housing 712 and enters the annular channel 766 formed around the perimeter of the hub 737 of the propulsor 30. Advantageously, the annular shape of the annular channel 766 maintains consistent fluid communication between the opposing channels 764 and the portions of the outlet passage 750 in the propulsor 30, thereby allowing the flow of air therethrough when the propulsor 30 is rotating.

Referring to FIG. 9, the increased air pressure due to the inflow of air via the air intake 754 further forces the air to flow through portions of the outlet passage 750 in the propulsor 30, for example along the flow path indicated by arrow 808. Air that has entered the annular channel 766 continues towards the outlet opening 752 by flowing through the linear channel 768. The air exits the outlet passage 750 through the outlet opening 752 and is ventilated from the back end of the propulsor 30. Air ventilated though the outlet opening 752 increases the local pressure directly behind the propulsor 30 relative to the pressure when no air is ventilated. Advantageously, the pressure increase caused by the ventilation of the air via the outlet passage 750 decreases the pressure differential between the low pressure zone behind the propulsion and the water flowing around the gearcase housing 712 and the propulsor 30, thereby reducing pressure drag on the lower unit 700 and increasing the efficiency of the marine drive when operating in the forward gear.

As previously mentioned, when the marine drive is operated in the reverse gear such that the marine drive travels in the reverse direction indicated by arrow 811 (FIG. 10), water is forced into the outlet passage 750 via the outlet opening 752. The backflow of water continues through the outlet passage 750 towards the upper housing 704 and the ball valve 760. This backflow of water through the outlet passage 750 may advantageously be used to clear debris away from the screen 950 in the water intake 742, as discussed in further detail below. The ball valve 760 may be configured to at least partially restrict the backflow of water from traveling past the bulkhead 762 and into the upper portion of the interior passage 710 in the upper housing 704. The backflow of water through the outlet passage 750 travels in a direction opposite to the flow of air through the outlet passage 750 illustrated in FIG. 9.

Referring to FIG. 10, The backflow of water enters the outlet passage 750 via the outlet opening 752 and flows into the annular channel 766 formed circumferentially around the hub 737 via the linear channel 768, for example along the flow path indicated by arrow 812. The backflow of water then exits the front end of the propulsor 30 and travels into the interior cavity 722 in the gearcase via the opposing channels 764 formed around the bearing carrier 734. As the marine drive continues operating in the reverse gear, the backflow of water travels upwards through the outlet passage 750, for example along the flow path indicated by arrow 814, thereby filling the interior cavity 722 in the gearcase housing 712 and the interior passage 720 in the stem 714.

As the interior cavity/passages 720, 722 in the lower housing 706 are filled by the backflow of water, said water approaches the ball valve 760. Prior to the backflow of water reaching the ball valve 760, the ball valve 760 may be in the open position (FIG. 9) due to the flow of air through the outlet passage 750 and/or the force of gravity acting on the ball 770. To restrict the flow of water past the bulkhead 762 and into the upper portion of the interior passage 710 in the upper housing 704, the ball valve 760 is configured to automatically move into the closed position under pressure from the backflow of water. With continued reference to FIG. 10, the backflow of water enters the lower portion of the interior passage 710 in the upper housing 704 and approaches the ball valve 760, for example along the flow path indicated by arrows 816. When the water reaches the ball 770 positioned at the bottom of the cage 776, the natural buoyancy of the ball 770 causes it to float on the surface of the backflowing water. Thus, the rising water level in the outlet passage 750 naturally lifts the ball 770 upwards in the seat 772 towards the retainer ring 774*a*. When the ball 770 reaches the retainer ring 774*a*, the buoyancy force acting on the ball 770 presses the ball 770 against the radially inner surface 788 of the retainer ring 774*a*, thereby placing the ball valve 760 in the closed position and restricting the backflow of water into the upper portion of the interior passage 710 in the upper housing 704.

By at least partially sealing the opening 763 through the bulkhead 762, the backflowing water cannot reach any componentry that may be positioned in the upper housing 704. By automatically moving into the closed position, the ball valve 760 is advantageously moved into and held in the closed position due to the ordinary operation of the marine drive without any additional actuators and/or control systems. In some embodiments, the ball valve 760 may be configured to completely seal the through bore 790 through the retainer ring 7741 to prevent any water from flowing through the ball valve 760 and past the bulkhead 762. Some embodiments, however, may be configured with a ball valve 760 and/or another valve device that only partially restricts the backflow of water through the ball valve 760 and past the bulkhead 762.

In the embodiments of FIGS. 9-13, the lower unit 700 of the marine drive is configured with a ball valve 760 having a ball 770 that is moved by a backflow of water into the housing 702 to automatically force the ball valve 760 into the closed position. Some embodiments may be configured with a different type of valve device that may be forced into a closed position due to the backflow of water through the outlet passage 750. Further still, some embodiments of a marine drive may be configured with a valve device that allows air to flow through the outlet passage 750 to be ventilated proximate the propulsor 30 while also preventing the backflow of water from passing the bulkhead 762 without transitioning between an open position and a closed position. For example, in some embodiments, the lower unit 700 of a marine drive may be configured with a tesla-type valve that that permits flow of the air, exhaust and/or other gas(es) out to the water at least when the marine drive is operated in a forward gear, but at least partially prevents the backflow of the water past the valve device at least when the marine drive is operated in the reverse gear.

Figure 14:
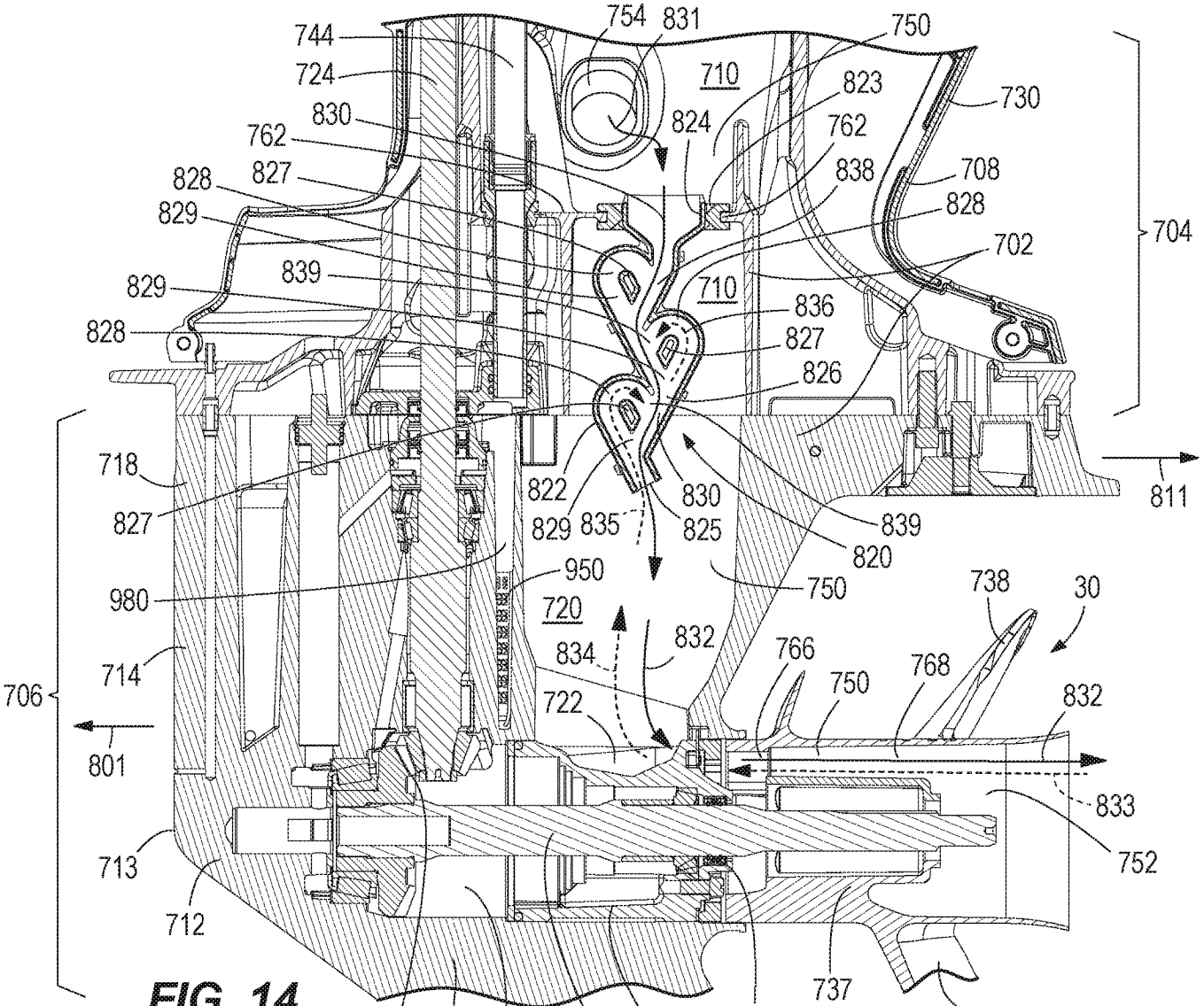
FIG. 14 is a view like FIG. 10, but showing a third embodiment of the marine drive according to the present disclosure having a first version of a tesla valve.

Referring to FIG. 14, the illustrated embodiment of a marine drive is configured with a tesla valve 820 that directs the backflow of water along multiple intersecting serpentine and redirecting paths 826, 828 to prevent the backflow of water through the tesla valve 820. The tesla valve 820 has a valve body 822 that extends between an upper opening 824, which is received in a retainer ring 823 to suspend the tesla valve 820 from the bulkhead 762, and a lower opening 825. A plurality of baffles 827 formed in the interior of the valve body 822 divide the interior space to define multiple pathways 826, 828 within the valve body 822. The illustrated tesla valve 820 includes three baffles 827 that define a serpentine path 826 extending through the tesla valve 820 between the upper opening 824 and the lower opening 825 and three redirecting paths 828 that are spaced vertically along the length of the serpentine path 828. The redirecting paths 828 are formed on alternating, opposing sides of the serpentine path 828. Each redirecting path 828 separates from the serpentine path 826 at a corresponding lower junction 829 and reconnects with the serpentine path 826 at a corresponding upper junction 839.

With continued reference to FIG. 14, the serpentine path 826 is configured to allow the flow of the air, exhaust and/or other gas(es) through the tesla valve 820, from upper opening 824 to lower opening 825, towards to outlet opening 752 of the outlet passage 750. The redirecting paths 828 are configured for redirecting the backflow of the water through the valve back towards the lower opening 825 of the tesla valve 820 and the outlet opening 752.

Referring to FIG. 14, operation of the marine drive in the forward gear propels the marine drive and the marine vessel in the forward direction indicated by arrow 801. As the marine vessel and marine drive move in the forward direction indicated by 801, air is introduced into the housing 702 via the air intake 754 formed though the perimeter wall 708 of the upper housing 704. For example, air may be forced through the air intake 754 and into the interior passage 710 along the flow path indicated by arrow 838.

Similar to the embodiments of FIGS. 8-13, a pressure gradient that forces air to flow through the outlet passage 750 to the outlet opening 752 is created by the continued flow of air into the housing 702 via the air intake 754, as shown at arrow 831. The inflowing air is then forced into the tesla valve 820 via the upper opening 824. Air flowing through the tesla valve 820 flows through the serpentine path 826 along the flow path indicated by arrow 830. Because the openings into the redirecting paths 828 at the upper and lower junctions 839, 829 generally face downward towards the lower opening 825, a majority of the airflow travels through the centrally positioned serpentine path 826. Any air that does enter one of the redirecting paths 828 is reinjected into the airflow through the serpentine path 626 in the direction of said airflow. Once the flowing air travels through the tesla valve 820 and exits through the lower opening 825, the pressure gradient continues to force the air through the outlet passage 750. For example, the airflow through the outlet passage 750 may travel from the interior passage 720 in the stem 714 to the interior cavity 722 in the gearcase housing 712 along the flow path indicated by arrows 832, around the bearing carrier 734 via one of the channels 764 around the bearing carrier 734, and through the annular channel 766 and the linear channel 768 to the outlet opening 752 at the end of the outlet passage 750 so that the air is ventilated from the outlet opening 752.

With continued reference to FIG. 14, operation of the marine drive in the reverse gear propels the marine drive and the marine vessel in the reverse direction indicated by arrow 811. As the marine vessel and marine drive move in the reverse direction indicated by 811, a backflow of water is directed into the outlet passage 750 and is forced to flow towards the tesla valve 820. For example, the backflow of water may enter the outlet path via the outlet opening 752 and travel through the hub 737 via the linear channel 768 and the annular channel 766 along the flow path indicated by arrow 833. The backflow of water then enters the gearcase housing 712, flows around the bearing carrier 734 via the channels 764 around the bearing carrier 734 and up through the interior cavity/passage 722, 720 in the gearcase housing 712, and the stem 714 along the flow path indicated by arrow 834.

While air flowing downward through the tesla valve 820 was permitted to flow freely towards the lower opening 825 and back into the outlet passage 750, the arrangement of the serpentine path 826 and the redirecting paths 828 at least partially prevents the backflow of water from moving through the tesla valve 820. After entering the tesla valve 820 via the lower opening 825, the baffle 827 forming a first redirecting path 828 (e.g., a lower redirecting path 828 in the illustrated embodiment) divides the backflow of water into two streams at the corresponding lower junction 829. One stream flows upwards through the serpentine path 826 in a direction opposite the direction indicated by arrow 830. The other stream of water is directed through the first redirecting path 828 along the path indicated by arrow 835. Water flowing up through the redirecting path 828 in the direction of arrow 835 is turned downward before being reinjected into the stream of water moving upwards through the serpentine path 826 at the corresponding upper junction 839. At the upper junction 839, the water from the redirecting path 828 is injected into the water flowing through the serpentine path 826 in a downward direction against the upward flow of water through the serpentine path 826. The collision between the streams of water flowing through the serpentine path 826 and the redirecting path 828 increases the pressure at the corresponding upper junctions 839 due to the opposing flow directions of the two streams. This pressure increase at the upper junction 839 reduces the pressure differential between the upper opening 824 and the lower opening 825 of the tesla valve 820, thereby resisting the backflow of water past said upper junction 839.

In some embodiments, a tesla valve may be configured with a single redirecting path 828 for partially or completely preventing the backflow of water from moving through the tesla valve 820. In the embodiment of FIG. 14, the tesla valve 820 includes a plurality of redirecting paths 828 arranged along the serpentine path 826. After the water flowing through the first redirecting path 828 is reintroduced into the serpentine path 826, a portion of the backflow of water may continue to flow upwards through the tesla valve 820 towards the lower junction 829 between a second redirecting path (e.g., a middle redirecting path 828 in the illustrated embodiment) and the serpentine path 826. At this lower junction 829, the baffle 827 which forms the second redirecting path 828 again spits the backflow of water into a stream moving upwards through the serpentine path 826 and a stream that travels through the second redirecting path 828 along the flow path indicated by arrow 836. Similar to the first redirecting path 828, the second redirecting path 828 injects the stream of water flowing therethrough back into the serpentine path 826 in a downward direction against the flow of water upwards through the serpentine path 826 at the corresponding upper junction 839. The collision between these two streams of water further increases the pressure at the upper junction 839, thereby further resisting the flow of water upwards through tesla valve 820.

Through repeated intersections between a serpentine path 826 and a redirecting path 828, the backflow of water through the tesla valve 820 and past the bulkhead 762 can be restricted and/or completely prevented. The tesla valve of FIG. 14 additionally includes a third redirecting path 828 (e.g., an upper redirecting path 828 in the illustrated embodiment) arranged above the second redirecting path 828. This may be useful, for example, to provide additional resistance to backflow in order to oppose the backflow of water through the outlet passage 750 in a variety of operating conditions. Some embodiments of a tesla valve 820 may include more than three redirecting paths 828. Additionally or alternatively, while the illustrated embodiments are configured with redirecting paths 828 on diametrically opposed sides of the serpentine path 826, some embodiments may be differently configured. For example, a tesla valve 820 may include redirecting paths 828 that are space circumferentially around the serpentine path 826.

Figure 15:
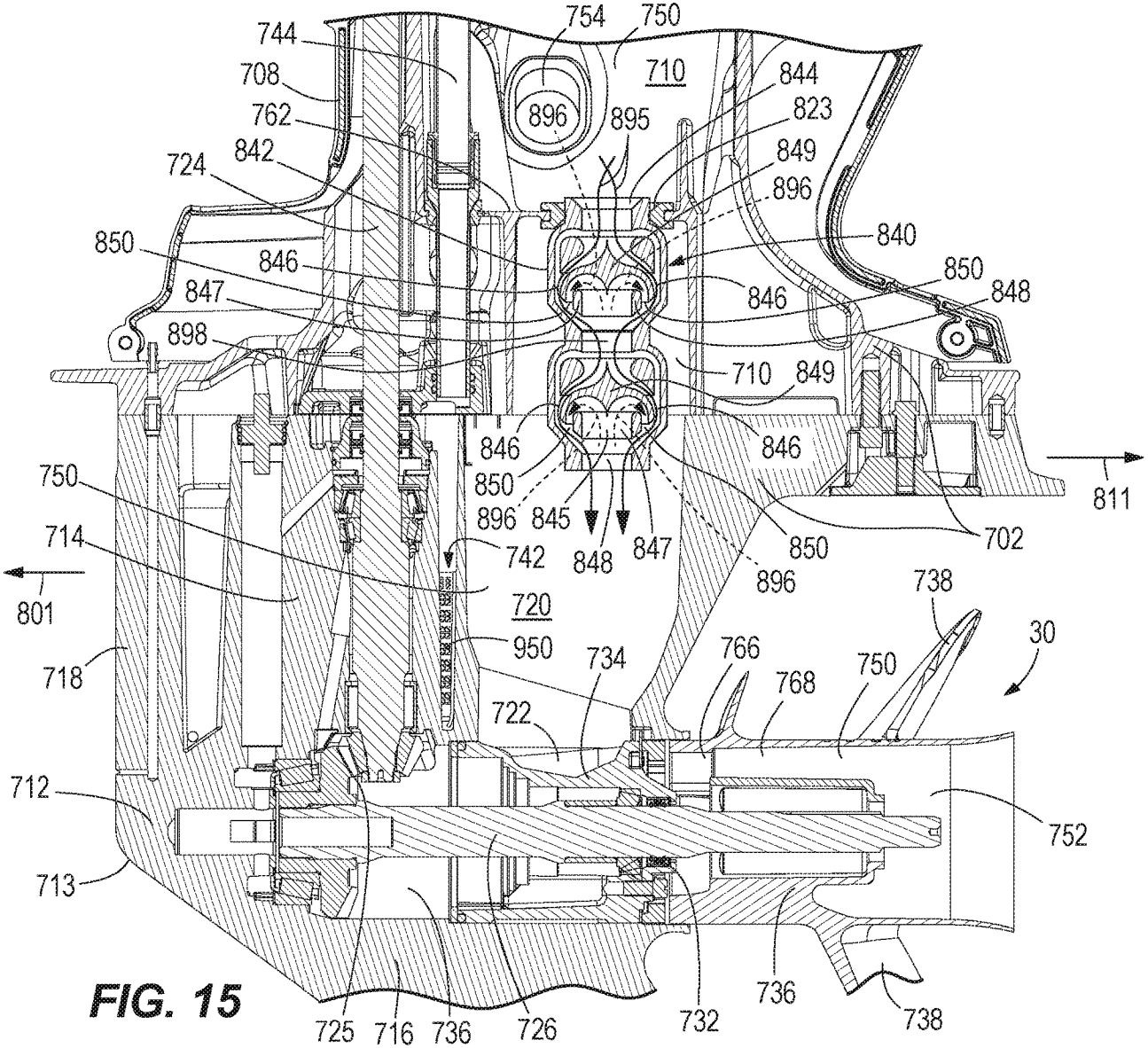
FIG. 15 is a view like FIG. 10, but showing a fourth embodiment of a marine drive according to the present disclosure having a second version of a tesla valve.

In the embodiment of FIG. 14, the tesla valve is configured with a centrally positioned serpentine path 826 with a plurality of redirecting paths 828 located on opposite sides of the serpentine path 826. Some embodiments, however, may be differently configured. Referring to FIG. 15, embodiments of a marine drive may be configured with a tesla valve 840 having a centrally positioned redirecting path 848 and serpentine paths 846 positioned on opposing sides of the redirecting path 848. The tesla valve 840 of FIG. 15 includes a body 842 that extends between an upper opening 844, which is received in a retainer ring 823 to suspend the tesla valve 820 from the bulkhead 762, and a lower opening 845. Within the body 842, a plurality of baffles 847, 849 divide the space within the body 842 to define redirecting paths 848 arranged in the center of the tesla valve 840 and serpentine paths 846 which extend around opposite sides of the redirecting paths 848. In the illustrated embodiment, a pair of serpentine paths 846 are formed on diametrically opposed sides of each centrally-located redirecting path 848. A lower baffle 847 is configured to split the backflow of water moving upwards through the tesla valve 840 into a center stream of water entering the redirecting path 828 and two streams of water that each enter into one of the serpentine paths 846. An upper baffle 849 splits the center stream of water in the redirecting path 828 into two flow paths indicated by arrows 896 and directs the two streams of water away from each other and towards one of the opposing serpentine paths 846. Similar to the tesla valve 820 of FIG. 14, the water flowing through the redirecting path 848 is directed downward towards a junction 850 where the redirected water is injected back into the backflow moving through a corresponding one of the serpentine paths 846.

With continued reference to FIG. 15, when the marine drive is operated in the forward gear, the marine drive propels the marine vessel in the forward direction indicated by arrow 801. As the marine vessel and marine drive move in the forward direction 801, air is forced into the housing 702 via the air intake 754 formed though the perimeter wall 708 of the upper housing 704. The air is then forced through the tesla valve 840 along the flow paths indicated by 895. As the air flows downward through the tesla valve 840, the upper baffles 849 split the airflow, thereby directing it into one of the serpentine paths 846. The air flows through the two serpentine paths 846 around the outer portions of the baffles 847, 849 before the serpentine paths 846 meet at a center junction 898. In the illustrated embodiment, the tesla valve 840 includes an upper set of serpentine and redirecting paths 846, 848 and a lower set of serpentine and redirecting paths 846, 848. After air flowing downward passes the upper set of serpentine paths 846 and the upper redirecting path 848, the upper baffle 849 of the lower set of paths 846, 848 divides the downward flowing air between the lower pair of serpentine paths 846, which meet again at the lower opening 845 into the tesla valve 840.

When the marine drive is operated in the reverse gear, the marine drive propels the marine vessel in the reverse direction indicated by arrow 811. As with the embodiments of FIGS. 8-14, movement of the marine drive of FIG. 15 in the reverse direction 811 forces a backflow of water into the outlet passage 750 via the outlet opening 752 at the back end of the propulsor 30 and through the outlet passage 750 towards the lower opening 845 of the tesla valve 840. After the backflow of water enters the tesla valve 840 through the lower opening 845, the lower baffle 847 splits the backflow of water into three streams of water. One stream of water travels through the center of the lower baffle 847 into the centrally positioned redirecting path 848, and the other two streams of backflowing water are directed around the lower baffle 847 into one of the serpentine paths 846 that extend around the outer portion portions of the tesla valve 840 on opposing sides of the lower and upper baffle 847, 849. Water flowing through the serpentine paths 846 flows in a direction opposite to the direction indicated by arrows 895 (i.e., up the tesla valve 840 in reverse relative to the path taken by air flowing down through the valve 840).

The stream of water directed into the redirecting path 848 is further divided into sub-streams by the upper baffle 849. The upper baffle 849 directs each of the sub-streams outward and downward in a curved path indicated by arrows 896. At the end of the redirecting path 848, each sub-stream of water flowing along one of flow paths indicated by arrows 896 is injected into one of the serpentine paths 846 against the flow of the water moving through said serpentine path 846 at a corresponding one of the junctions 850. The collision between the streams of water traveling through the serpentine paths 846 and the redirecting path 848 impedes with the flow of water through the serpentine paths 846, thereby resisting the backflow of water upwards through the tesla valve 840. After the slowed streams of water through the serpentine paths 846 pass the junctions 850, the water flowing through the outer serpentine paths 846 are redirected inward and rejoined at the center junction 898.

After passing the lower set of serpentine paths 846 and the lower redirecting path 848, the backflowing water that has reached the center junction 898 is again split between the serpentine paths 846 and the redirecting path 848 by the baffles 947, 949 that form the upper set of serpentine paths 846 and the upper redirecting path 848, thereby further resisting the backflow of water through the tesla valve 840. In the illustrated embodiment, the tesla valve 840 includes two sets of corresponding serpentine paths and redirecting paths 846, 848 arranged in sequence. Some embodiments, however, may be differently configured. For example, a tesla valve may be configured with at least one additional set of corresponding serpentine paths and redirecting paths 846, 848 arranged in sequence with the other sets of corresponding serpentine paths and redirecting paths 846, 848. Additionally or alternatively, a tesla valve may be configured with at least one set of corresponding serpentine paths and redirecting paths 846, 848 arranged in parallel with another set of corresponding serpentine paths and redirecting paths 846, 848.

Some embodiments of a marine drive including an outlet passage 750 for air may be configured with a valve device that redirects a backflow of water out of the housing 702. For example, referring to FIG. 16, the illustrated marine drive includes a valve device 880 configured as a backflow redirecting valve device 880. The backflow redirecting valve device 880 includes a tube body 881 extending from an exterior opening 882 and an interior opening 884. The tube body 881 defines a tube passage 886 extending between the exterior opening 882 and the interior opening 884 such that fluids may flow between the exterior and interior openings 882, 884 via the tube passage 886. The exterior opening 882 is connected to the air intake 754 such that fluids entering or exiting the tube passage 886 via the exterior opening 882 respectively flow into or out of the housing 702 via the air intake 754. Proximate the interior opening 884, the tube body 881 is coupled to the bulkhead 762 by a retainer ring 774*a*. Thus, fluids entering or exiting the tube passage 886 via the interior opening 884 pass through the opening 763 in the bulkhead 762 that the retainer ring 774*a* is mounted in.

Figure 16:
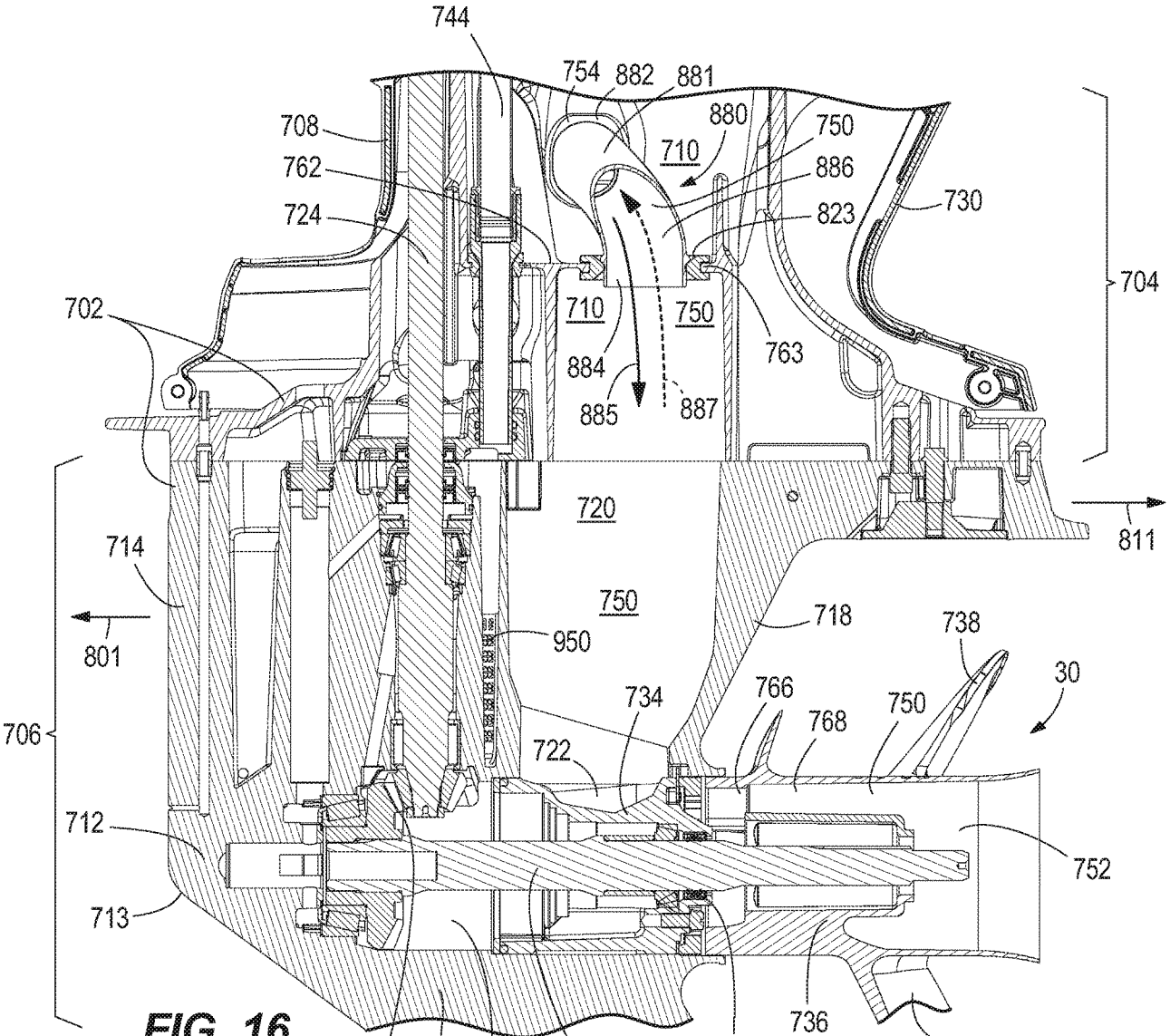
FIG. 16 is a view like FIG. 10, but showing a fourth embodiment of a marine drive according to the present disclosure.

With continued reference to FIG. 16, when the marine drive is operated in a forward gear to move the marine drive and marine vessel in the forward direction 801, air is forced into the outlet passage 750 in the housing 702 via the air intake 754. The airflow entering the housing through the air intake 754 is directed through the tube passage 886 of the backflow redirecting valve device 880 from the exterior opening 882 to the interior opening 884. Thus, the flow of air flows through the backflow redirecting valve device 880 and past the bulkhead 762 along the flow path indicated by arrow 885. Thus, the backflow redirecting valve device 880 allows air to enter into and flow through the outlet passage 750 when the marine drive is operated in a forward gear.

When the marine drive is operated in the reverse gear to move the marine drive and marine vessel in a reverse direction 811, A backflow of water forced into the outlet passage 750 via the outlet opening 752 is flows towards the interior opening 884 of the backflow redirecting valve device 880. The backflow of water then enters the tube body 881 via the interior opening 884 and is forced through the tube passage 886 to the exterior opening 882 and out of the housing 702 via the air intake 754, for example along the flow path indicated by arrow 887. Thus, the backflow redirecting valve device 880 prevents a backflow of water through the outlet passage 750 from traveling upwards into the portions of the interior passage 710 in the upper housing 704 which are above the bulkhead 762.

In the embodiments of FIGS. 8-16, the marine drive includes a valve device positioned in a section of the outlet passage 750 which is in the housing 702. Some embodiments, however, may include a valve device at another location along the outlet passage 750. For example, referring to FIGS. 17 and 18, embodiments of a marine drive may be configured with a propulsor assembly 900, 910 including a propulsor body 901, 911 that include the outlet opening 752 of the outlet passage 750 and a valve device 920. The valve device 920 permits flow of the air, exhaust and/or other gas(es) out to the water via the outlet opening 752, but at least partially prevents a backflow of the water past the valve device 920.

Figure 17:
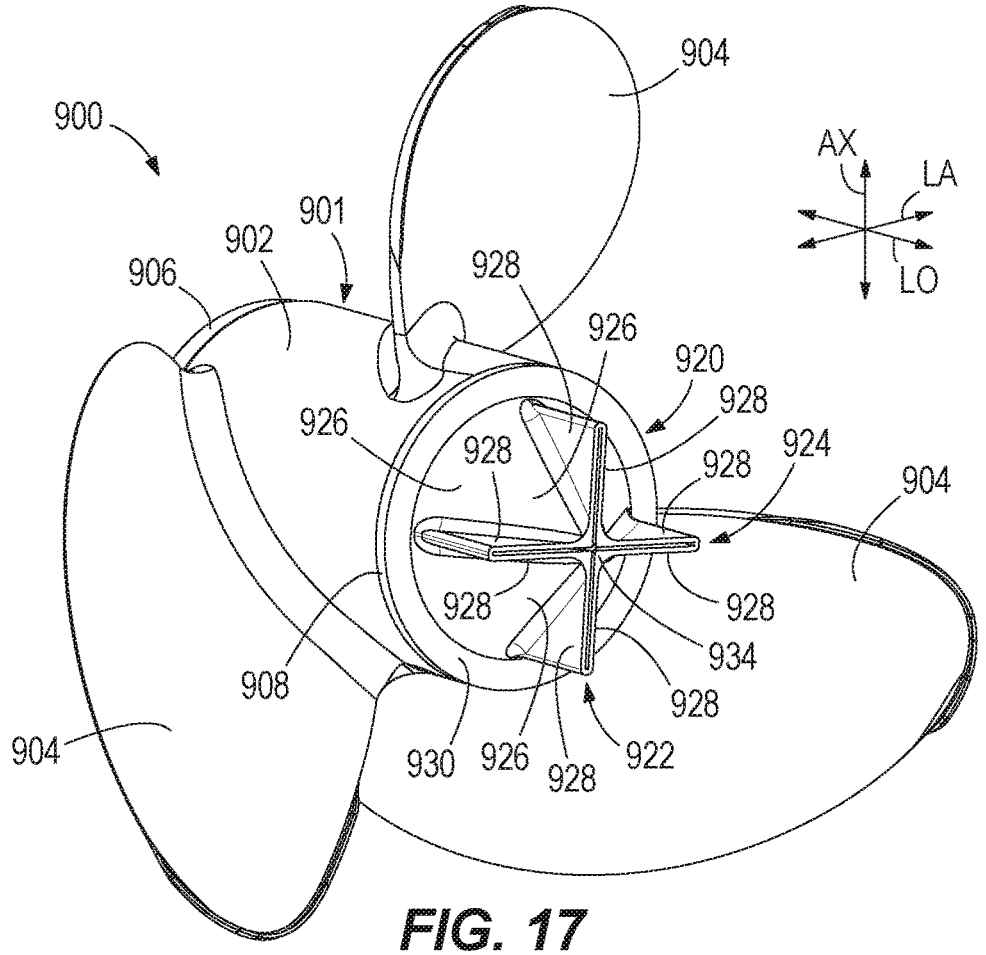
FIG. 17 is a perspective view of a first embodiment of a propulsor and a duckbill valve according to the present disclosure, the duckbill valve shown in a closed position.
Figure 18:
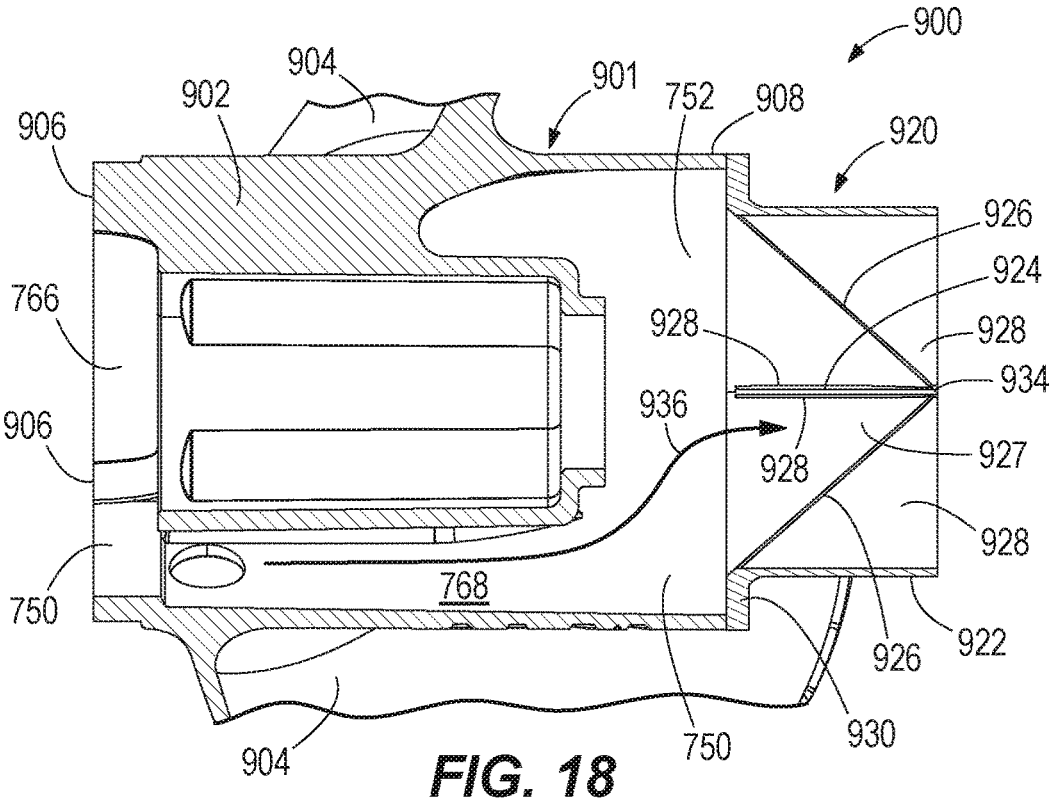
FIG. 18 is a sectional view of the duckbill valve shown in FIG. 17.

Referring to FIGS. 17 and 18, the propulsor body 901 includes a cylindrical hub 902 configured to be mounted on a propulsor shaft 726 (FIGS. 8-11 and 13-16) that protrudes from a back end of the gearcase housing 712 (FIGS. 8-11 and 13-16). Rotation of the propulsor shaft 726 causes the propulsor 30 to rotate, thereby creating a thrust force to propel the marine vessel through the water. The hub 902 extends along the longitudinal Axis LO from a front end 906 to a back end 908. A plurality of propeller blades 904 are spaced circumferentially around the outer surface of the hub 902 and extend radially outward therefrom. Similarly to the propulsors 30 of FIGS. 8-11 and 13-16, the propulsor body 901 of FIGS. 17 and 18 includes a portion of the outlet passage 750 that extends between the front and back ends 906, 908 of the propulsor body 901. An annular channel 766 is formed circumferentially around the interior of the hub 902 such that the propulsor shaft 726 can extend through the center of the annular channel 766. A linear channel 768 extends axially through the hub 902 (i.e., along the longitudinal axis LO) from the annular channel 766 to the outlet opening 752 formed in the back end 908 of the propulsor body 901. Thus, air, exhaust and/or other gas(es) may be conveyed through the annular and linear channels 766, 768 of the outlet passage 750 to be vented through the outlet opening 752.

With continued reference to FIGS. 17 and 18, the illustrated valve device 920 is configured as a duckbill valve 920 that may be force from a closed position (FIGS. 17 and 18) into an open position by the air, exhaust, and/or other gas(es) flowing through the outlet passage 750. The duckbill valve 920 includes an annular flange 930 that is coupled to the back end 908 of the propulsor body 901 on an outer end of the hub 902 and the outlet passage 750 and a plurality of lips 928 projecting rearward from the annular flange 930. In the illustrated embodiment, the lips 928 are arranged into two sets 922, 924 of opposing lips 928 that extend across the diameter of the annular flange 930. The first set 922 of lips 928 is oriented such that it extends perpendicular to the second set 924 of lips 928 and the first and second sets 922, 924 of lips 928 intersect at a midpoint 934 at the center of the duckbill valve 920, thereby subdividing each lip 928 into two parts that are on opposite sides of the intersecting set 922, 924 of lips 928. Angled connecting surfaces 926 extend from the annular flange 930 towards the midpoint 934 where the two lip sets 922, 924 intersect. Each connecting surface 926 is connected to or integrally formed with two adjacent lips 928, one lip 928 being part of the first lip set 922 and the other being part of the second lip set 924, thereby forming a generally pyramid shaped cavity 927 on the interior side of the duckbill valve 920.

The pair of opposing lips 928 in each lip set 922, 924 are configured such that they may be moved or flexed apart from each other to transition the duckbill valve 920 into the open position. In the illustrated embodiments, the duckbill valve 920 is formed from a resiliently deformable material so that the lips 928 have a shape and natural resiliency which cause the duckbill valve 920 to normally remain in the closed position until the air, exhaust, and/or other gas(es) forces the plurality of lips 928 apart. For example, as the air, exhaust, and/or other gas(es) flows through the outlet passage 750 and out the outlet opening along the flow path indicated by arrow 936, the air, exhaust, and/or other gas(es) accumulates in the cavity 927 on the interior of the duckbill valve 920. As the air, exhaust, and/or other gas(es) accumulates, the pressure within the cavity 927 builds and creates a pressure force that presses outward against the connecting surfaces 926. The outward pressure force is resisted by the natural resiliency of the connecting surfaces 926 and lips 928 of the duckbill valve 920. Once the pressure of the air, exhaust, and/or other gas(es) has increased such that the pressure force exceeds the resistive force due to the resiliency of the duckbill valve 920, the connecting surfaces 926 are forced outward and the opposing lips 928 are forced apart from each other, thereby placing the duckbill valve 920 in the open position. Thus, when the marine drive is operated in the forward gear, the air, exhaust, and/or other gas(es) flowing through the outlet passage 750 forces the duckbill valve 920 into the open position to permit the air, exhaust, and/or other gas(es) to be vented from the outlet opening 152 at the back end 908 of the propulsor body 901.

When the pressure within the interior cavity 927 has decreased, for example when operation of the marine drive is ceased or the marine drive is changed into and operated in the reverse gear, the natural resiliency of the duckbill valve 920 forces the duckbill valve 920 into a closed position, thereby preventing a backflow of the water past the duckbill valve 920 and into the outlet passage 750. Advantageously, the duckbill valve 920 automatically moves between the open and closed positions due to the operation of the marine drive without the use of without any actuators and/or control systems. Further, the position of the duckbill valve 920 on the exterior of the propulsor body 901 allows for easy access to the duckbill valve for maintenance and/or to replace the duckbill valve 920.

In some embodiments, the properties of the duckbill valve 920 may be selected in order to tune the force required to force the duckbill valve 920 into the open position. For example, the material of the duckbill valve 920, the thickness of the lips 928 and/or the connecting surfaces 926, the size of the cavity 927, and/or another property of the duckbill valve 920 may be selected based on a desired outward pressure force required to force the duckbill valve 920 into the open position. Some embodiments of a propulsor assembly 900 may be configured with a valve device 920 that is coupled to the propulsor body 901. Other embodiments, however, may be configured with a valve device 920 having at least a portion thereof that is integrally formed with the propulsor body 901.

In some embodiments, there may be a thin gap between opposing pairs of lips 928 such that some of the air, exhaust and/or other gas(es) may be permitted to escape through the gap(s) to be ventilated from the outlet passage 750 while the duckbill valve 920 is in the closed position. In such an embodiment, some backflowing water may be permitted to enter the outlet passage through the duckbill valve 920 in the closed position when the marine drive is operated in the reverse gear. Other embodiments, however, may be configured with opposing lips 928 that abut each other to completely seal the duckbill valve 920.

Figure 19:
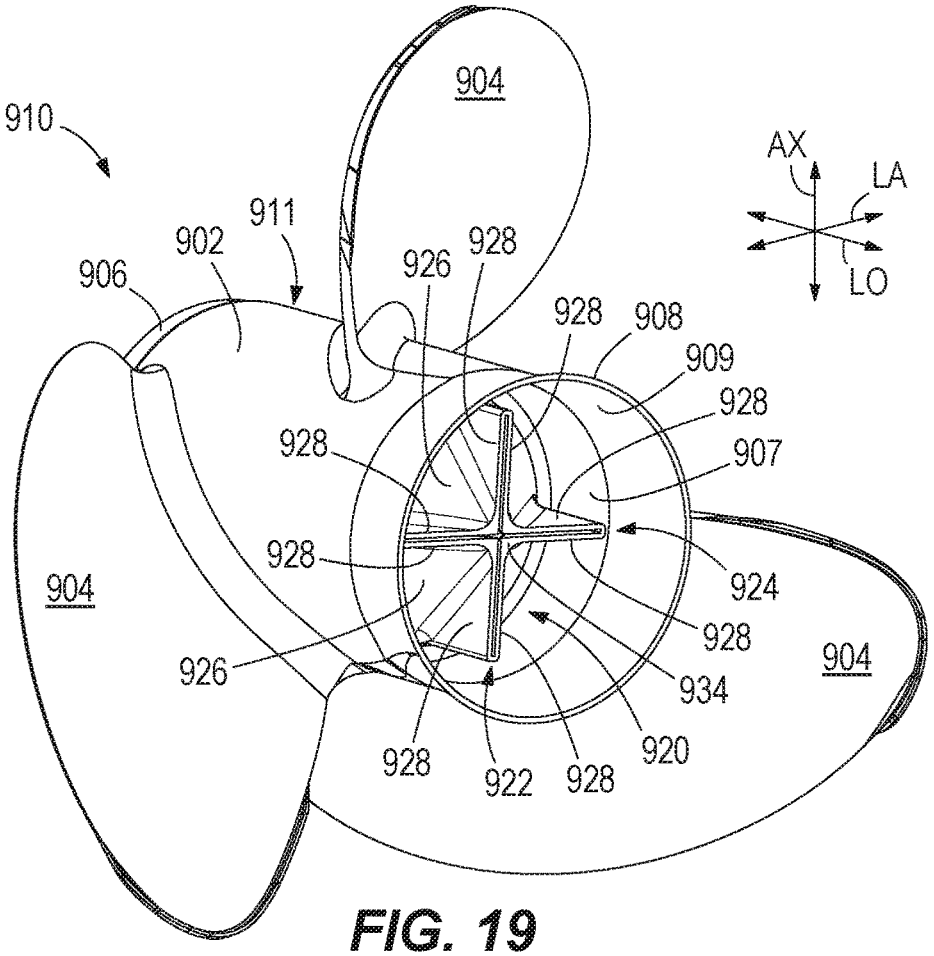
FIG. 19 is a perspective view of a second embodiment of a propulsor and a duckbill valve according to the present disclosure, the duckbill valve shown in a closed position.
Figure 20:
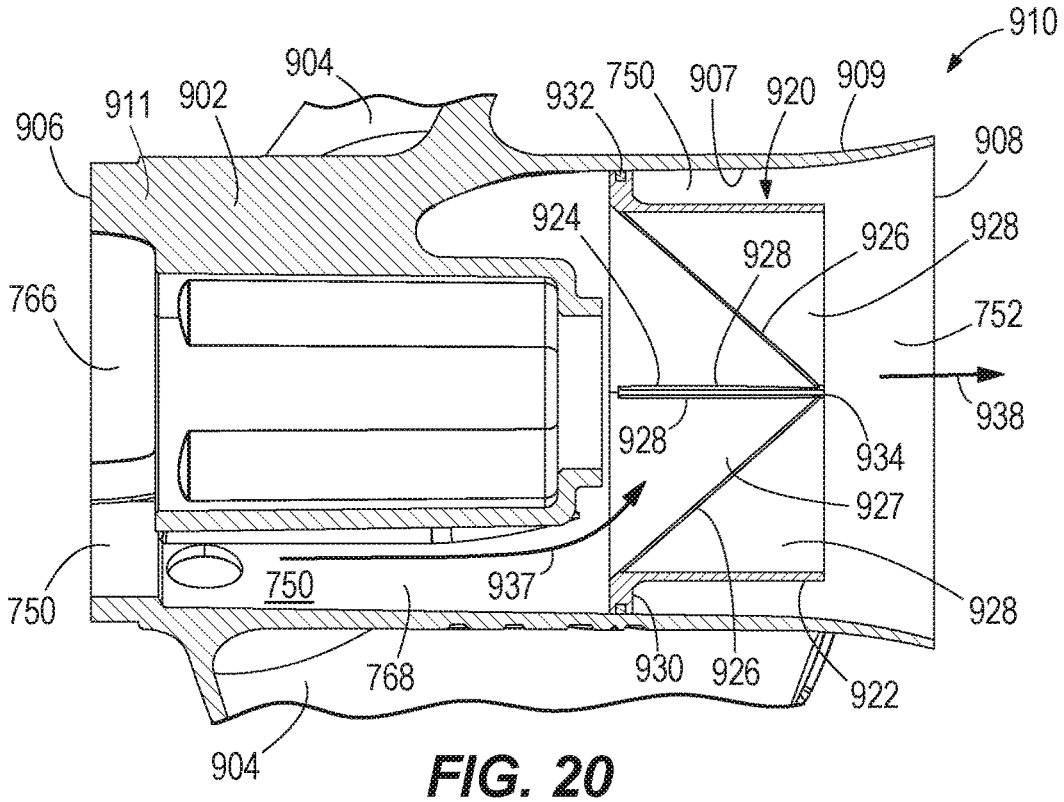
FIG. 20 is a sectional view of the duckbill valve shown in FIG. 19.

In the embodiment of FIGS. 17 and 18, the valve device 920 is secured to the back end 908 of the propulsor body 901. Some embodiments, however, may include a valve device that is at least partially positioned within the propulsor body. For example, FIGS. 19 and 20 illustrate an embodiment of a propulsor assembly 910 configured with a valve device 920 that is positioned inside the propulsor body 901. Similar to the propulsor assembly 900 of FIGS. 17 and 18, the propulsor assembly 910 of FIGS. 19 and 20 includes a propulsor body 911 and a valve device 920 configured as a duckbill valve 920. Unlike the embodiments of FIGS. 16 and 17, however, the duckbill valve 920 is located within the outlet passage 750 proximate the outlet opening 752.

Referring to FIGS. 19 and 20, the propulsor body 911 includes a cylindrical hub 902 configured to be mounted on a propulsor shaft 726 (FIGS. 8-11 and 13-16) such that rotation of the propulsor shaft 726 causes the propulsor 30 to rotate, thereby creating a thrust force to propel the marine vessel through the water. The hub 902 extends from a front end 906 to a back end 908, and a plurality of propeller blades 904 are spaced circumferentially around the outer surface of the hub 902 and extend radially outward therefrom. A portion of the outlet passage 750 extends through the hub 902 from an annular channel 766 proximate the front end 906 of the propulsor body 901 to an outlet opening 752 proximate the back end 908 of the propulsor body 901. air, exhaust and/or other gas(es) may be conveyed through the annular and linear channels 766, 768 of the outlet passage 750 to be vented through the outlet opening 752.

With continued reference to FIGS. 19 and 20, the duckbill valve 920 includes an annular flange 930, two intersecting sets 922, 924 of opposing lips 928 projecting outward from the annular flange 930, and connecting surfaces 926 that are joined with the adjacent lips 928 and extend from the annular flange 930 towards the midpoint 934 where the two lip sets 922, 924 intersect. The illustrated duckbill valve 920 is positioned inside the hub 902 such that a portion of the outlet passage 750 that includes the outlet opening 752 is downstream from the duckbill valve 920 in the outlet passage 750. The duckbill valve 920 is coupled to the hub 902 via the annular flange 930, which has a radially outer surface that abuts a radially inner surface 907 of the outlet passage 750 proximate the outlet opening 752. In the illustrated embodiment, an O-ring 932 is sandwiched between the annular flange 930 and the radially inner surface 907 of the outlet passage 750 to form a seal between the annular flange 930 and the propulsor body 911.

The duckbill valve 920 is formed from a resiliently deformable material so that the lips 928 and/or connecting surfaces 926 have a shape and natural resiliency which cause the duckbill valve 920 to normally remain in the closed position. When air, exhaust and/or other gas(es) is directed to flow through the outlet passage 750, said air, exhaust, and/or other gas(es) flows through the hub 902, for example along the flow path indicated by arrow 937, and accumulates in the interior cavity 927 of the duckbill valve 920. The pressure increase caused by the continued flow of the air, exhaust, and/or other gas(es) through the outlet passage 750 and into the cavity 927 creates an outward pressure force the forces the opposing lips 928 in the first and second lip sets 922, 924 apart from each other thereby moving forcing the duckbill valve 920 into the open position. Once the duckbill valve 920 is in the open position, the air, exhaust, and/or other gas(es) continues to flow through the duckbill valve 920 and out of the outlet opening 752 of the outlet passage 750, for example along the flow path indicated by arrow 938. When the pressure within the interior cavity 927 has decreased, for example when operation of the marine drive is ceased or the marine drive is changed into and operated in the reverse gear, the natural resiliency of the duckbill valve 920 forces the duckbill valve 920 into a closed position, thereby preventing a backflow of the water past the duckbill valve 920 and into the outlet passage 750. Thus, the duckbill valve 920 automatically moves between the open and closed positions due to the operation of the marine drive without the use of without any actuators and/or control systems. The location of the duckbill valve 920 within the hub 902 of the propulsor body 911 limits the possibility for impacts with objects in the water while still providing easy access to the duckbill valve 920.

In the embodiment of FIGS. 19 and 20, the propulsor body 911 of the propulsor assembly 910 includes an outlet nozzle 909 at the back end 908 of the hub 902 and the outlet opening 752 of the outlet passage 750. As the air, exhaust, and/or other gas(es) is ventilated from the outlet opening 752 under pressure, the expanding air, exhaust, and/or other gas(es) may press against the interior surface of the outlet nozzle 909, thereby increasing the thrust force generated by the marine drive. In the illustrated embodiment, the outlet nozzle 909 is integrally formed with the hub 902 of the propulsor body. Some embodiments, however, may include a separate nozzle that is coupled to the back end 908 of the hub 902. Additionally or alternatively, embodiments of the propulsor body 911 may omit the outlet nozzle, as in the propulsor assembly 900 of FIGS. 17 and 18.

Some embodiments of a propulsor assembly, such as the propulsor assemblies 900, 910 of FIGS. 17-20, may be configured with a plurality of fins (not shown) which facilitate a swirling flow of water relative to the propulsor. This may be useful, for example, to counteract the reduction in the thrust force from the propeller blades 904 which may result from the ventilation of air, exhaust, and/or other gas(es) proximate the propulsor. In some embodiments, the fins may be formed on the exterior surface of the propulsor hub. Some embodiments may be configured with a duckbill valve (or other valve device) that includes fins which create the swirling flow of water. Additionally or alternatively, the lips of a duckbill valve may be configured to double as fins which create the swirling flow of water at the back end of the propulsor.

As described herein above and as disclosed in the figures, it will be understood by those having ordinary skill in the art that the valve device 760 disclosed and claimed herein may have many different independent configurations from what is shown and described, including but not limited to a valve device comprising one or more ball valves, one or more tesla valves, one or more duckbill valves, one or more flapper valves, and/or any other type of suitable one-way valve(s) which provides the functionality described herein. Also, the valve device 760 may be located in a variety of different locations relative to the marine drive, as evidenced by the illustrated embodiments showing the valve device at different locations, including both inside and outside of the marine drive.

In the embodiments of FIGS. 1-7, the stern drive 12 utilizes a control system 500 to automatically modify the operation of the electric pump 310 of the cooling system 330 to clear debris from the water intake 300. As previously discussed, the control system 500 may decrease the speed of the electric (or otherwise powered) electric pump 310 and/or reverse the direction of the electric pump 310 to facilitate clearance of debris from the water intake 300. In the embodiments of FIGS. 8-10 and 13-16, the water intakes 742 in the housing 702 include a screen 950 configured to filter debris from the cooling water entering the cooling system 740 via the water intakes 742. Some embodiments of an outboard motor, such as the embodiments of FIGS. 8-10 and 13-16 may be configured with a control system that controls the operation of the cooling water pump 746 (FIG. 9) according to a control method, such as the method 600 of FIG. 7, to clear debris from the screen 950. Some embodiments of a marine drive, however, may be differently configured. For example, a marine drive including an outlet passage 750 may use a backflow of water into the housing 702 of the marine drive to clear debris from the screen 950 and away from the water intake 742. This may be useful, for example, to provide a method for rerouting a backflow of water received in the housing 702 to the cooling water intake 742 so that the backflow of water clears debris from the cooling water intake 742.

Figure 21:
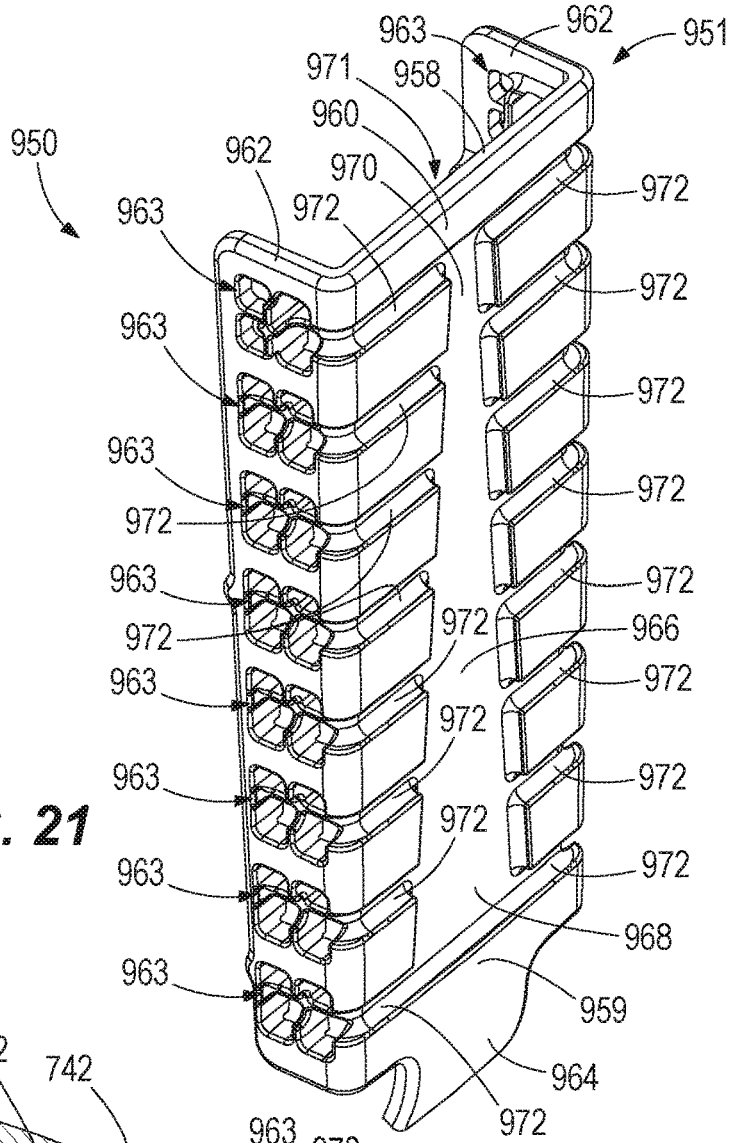
FIG. 21 is a view of a first embodiment of an insert having a screen and a baffle for redirecting a backflow of water.

Referring to FIG. 21, some embodiments of a screen 950 may be configured as a screen insert 951. The screen insert 951 has a body with a generally rectangular rear panel 960 extending from an upper end 958 to a lower end 959. Two lateral panels 962 are formed along the lateral edges of the rear panel 960 and project forward therefrom. The rear panel 960 and the lateral panels 962 form a generally U-shaped profile of the screen insert 951 and define a space 971 between the opposing lateral panels 962. A tab 964 projects downward from the lower end 959 of the rear panel 960 and may be configured to assist in positioning the screen insert 951 in the cooling water intake passage 980. A plurality of screen openings 963 are formed through each of the lateral panels 962 and are spaced vertically along the lateral panels 962. As discussed in more detail below, the screen insert 951 is configured to be positioned in a cooling water intake passage 980 fluidically connected to the water intakes 742 (FIG. 22), and the screen openings 963 are configured to allow cooling water from the cooling water intakes 742 to flow through the lateral panels 962 and into the cooling water intake passage 980 and the space 971 between the lateral panels 962.

With continued reference to FIG. 21, a plurality of channels 966, 972 are formed along the back surface of the rear panel 960. The channels 966, 972 are configured to guide a backflow of water across the back surface of the rear panel 960 to the screen openings 963 on the lateral panels 912. A vertical channel 966 is formed in the back surface of the rear panel 960 and extends from a lower end 968 proximate the lower end 959 of the rear panel 960 to an upper end 970 proximate the upper end 958 of the rear panel 960. The vertical channel 966 has a generally trapezoidal shape that tapers from the wide lower end 968 to the comparatively narrow upper end 970. A plurality of lateral channels 972 are formed in the rear panel 962 and extend horizontally across the rear panel 960 from the lateral sides of the vertical channel 966 to the lateral panels 962. Each lateral channel 972 is positioned in vertical alignment with a screen opening 963 on one of the lateral panels 962. The lateral channels 962 extend around the corner between the rear panel 962 and one of the lateral panels 962 and each open onto an outer surface of the corresponding one of the screen openings 963.

Figure 22:
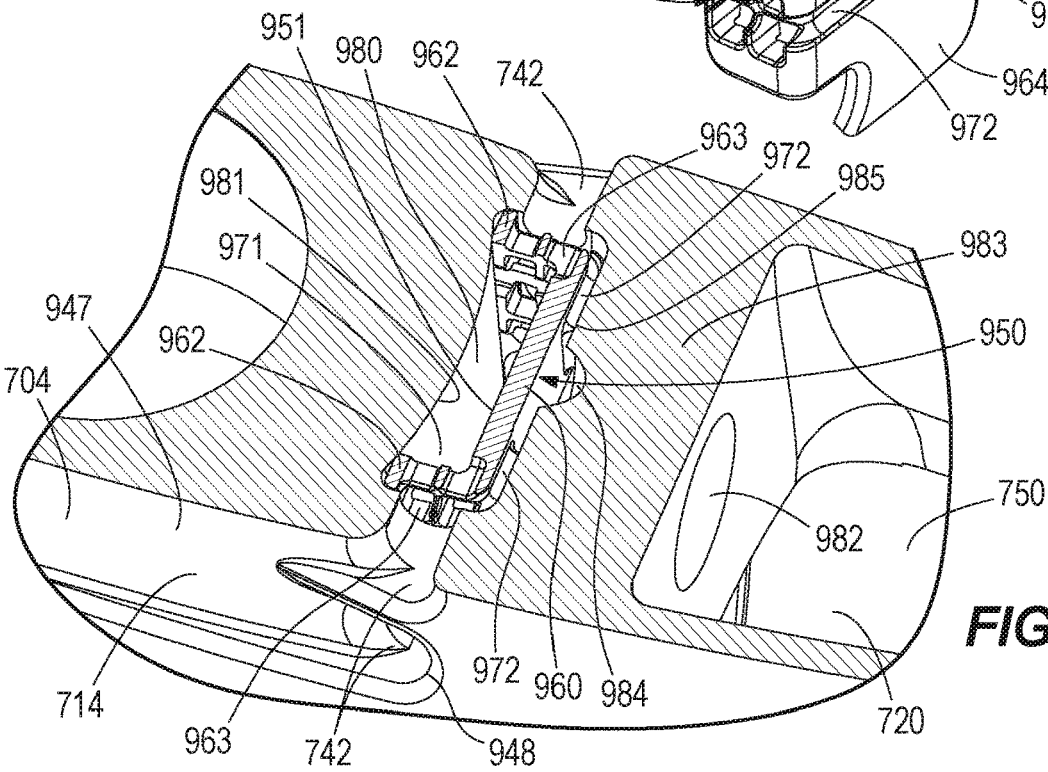
FIG. 22 is a sectional view showing the insert shown in FIG. 21 installed in a water intake.

Referring to FIG. 22, the screen insert 951 is configured to be received in a cooling water intake passage 980 formed in the stem 714 of the marine drive. The cooling water intake passage 980 is part of the cooling system 740 (FIG. 9) and connects the water intakes 742 to the conduit 744. As illustrated in FIG. 9, for example, the cooling water intake passage 980 is formed in the stem 714 and has an upper end that is connected to the conduit 744 of the cooling system 740. Referring to FIGS. 21 and 22, the water intakes 742 located on the lateral sides of the stem 714 each extend through the side walls of the stem 714 and open into the cooling water intake passage 980. A recessed scoop surface 947 is formed in the stem 714 and tapers laterally inward between a front end of the scoop surface 947 to a back end at the water intakes 742. A deflector surface 948 is positioned behind each of the water intakes 742 and is configured to guide water from the body of water into the cooling water intake passage 980 through the water intakes 742. The screen insert 951 is configured to be positioned in the cooling water intake passage 980 with the rear panel 960 positioned against a rear surface 985 of the cooling water intake passage 980. The lateral panels 962 extend forward from the rear panel 960 along the lateral sides of the cooling water intake passage 980 and the forward edges of the lateral panels 962 abut a front wall 981 of the cooling water intake passage 980. In the illustrated embodiment, the front wall 981 is curved and bows inward into the space 971 between the lateral panels 962. This may be useful, for example, to assist in positioning the screen insert 951 within the cooling water intake passage 980. In some embodiments, the screen insert 951 may be inserted into the cooling water intake passage 980 via the upper end of the cooling water intake passage 980 before the lower housing 706 is coupled to the upper housing 704.

Figure 23:
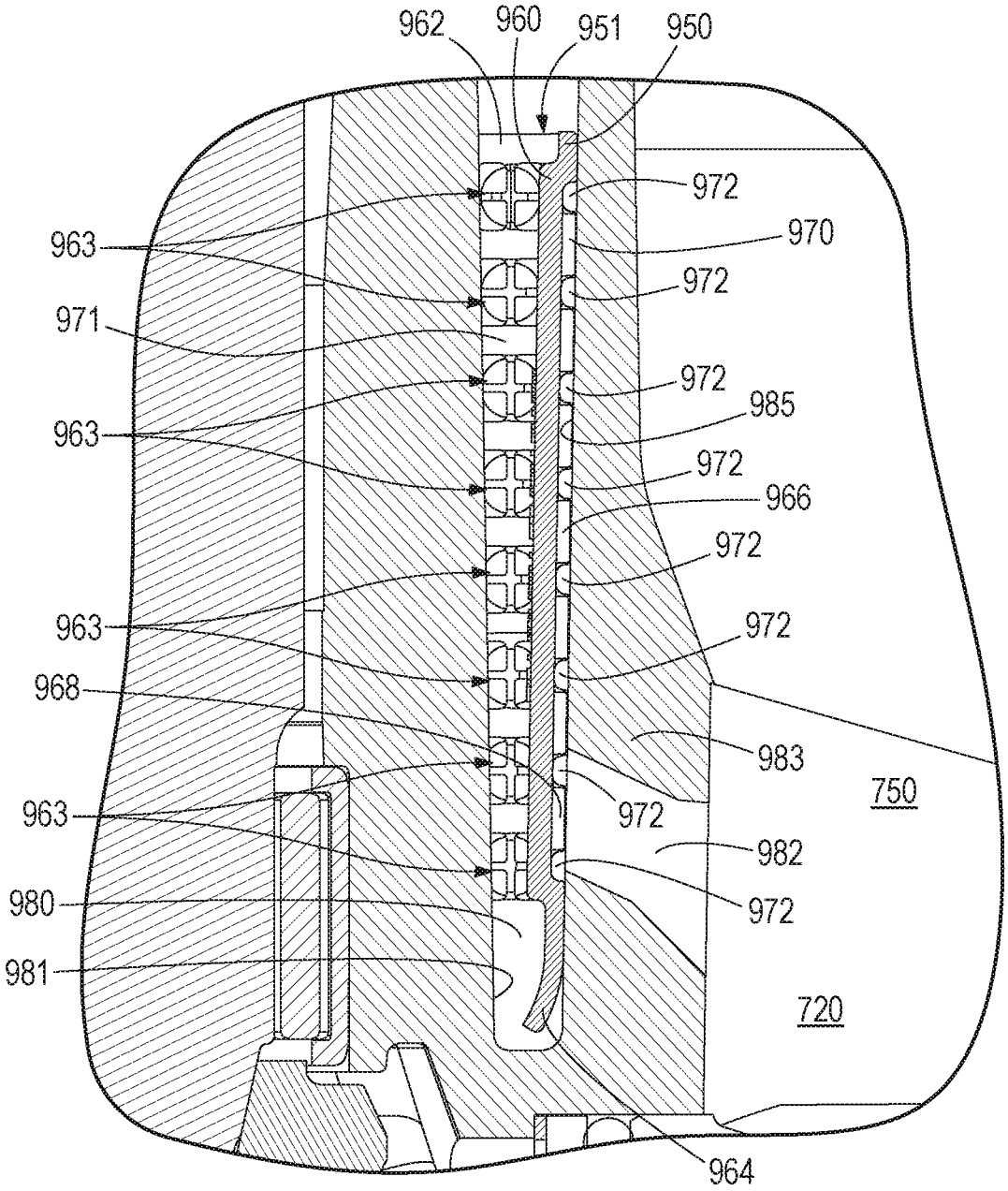
FIG. 23 is another sectional view showing the insert shown in FIG. 21 installed in the water intake.

Referring to FIGS. 21-23, the housing 702 (FIGS. 8 and 9) may be configured to route the backflow of water received from the body of water to clear debris from the cooling water intake 742. As illustrated in FIG. 22, for example, the stem 714 of the lower housing 704 may include a passage 982 that extends through a wall 983 between the outlet passage 750 and the cooling water intake passage 980 to fluidically connect the outlet passage 750 to the cooling water intake passage 980. When the marine drive is operated in the reverse gear as discussed above, at least a portion of the backflow of water entering the outlet passage 750 via the outlet opening 752 (FIG. 10) flows through the passage 982 extending through the wall 983 from the interior passage 720 in the stem 714 to the cooling water intake passage 980. The backflowing water that passes through the passage 982 collides with the rear panel 960 of the screen insert 951 and flows into the vertical channel 966 defined in the rear panel 960. As the backflow of water continues to flow through the passage 982, the pressure of water in the vertical channel 966 increases, thereby forcing water to fill the vertical channel 966. In the illustrated embodiment, a channel 984 defined in the rear surface 985 of the cooling water intake passage 980 may provide additional space for the water to flow along and fill the vertical channel 966 in the screen insert 951. Some embodiments, however, may omit the channel 984 in the rear surface 985 of the cooling water intake passage 980.

With continued reference to FIGS. 21-23, the backflow of water in the vertical channel 966 flows into the lateral channels 972 that extend from opposing sides of the vertical channel 966. The lateral channels 972 redirect the backflow of water around the lateral sides of the rear panel 960 to the cooling water intakes 742. As the backflow of water exits the lateral channels 972 on the outer surface of the lateral panels 962 of the screen insert 951, the backflow of water flows across the corresponding screen opening 963 at the end of the lateral channel 972. The backflow of water across the outer side of the screen openings 963 clears debris from the screen openings 963 and forces the debris out of the housing 702 via the water intakes 742. Thus, the backflow of water into the outlet passage 750 automatically clears debris from the cooling water intakes 742 in response to the normal operation of the marine drive in the reverse gear. Advantageously, the screen insert 951 prevents the backflow of water from entering the space 971 between the opposing lateral panels 962, which is the space within the cooling water intake passage 980 from which cooling water is drawn into the cooling water conduit 744 extending up to the cooling water pump 746 (FIG. 8). This may be useful, for example, so that the backflow of water into the water intake chamber does not interfere with the operation of the cooling system 740.

Some embodiments of a screen insert may be configured differently than the screen insert 951 of FIGS. 21-23. For example, as illustrated in FIGS. 24-26, embodiments of a screen 1000 may be configured as a screen insert 1001 that includes a valve 1024 which, in a closed position, prevents the backflow of water from clearing the debris from the cooling water intakes 742 (FIG. 9) and, in an open position, permits the backflow of water to clear the debris from the cooling water intakes 742.

Figure 24:
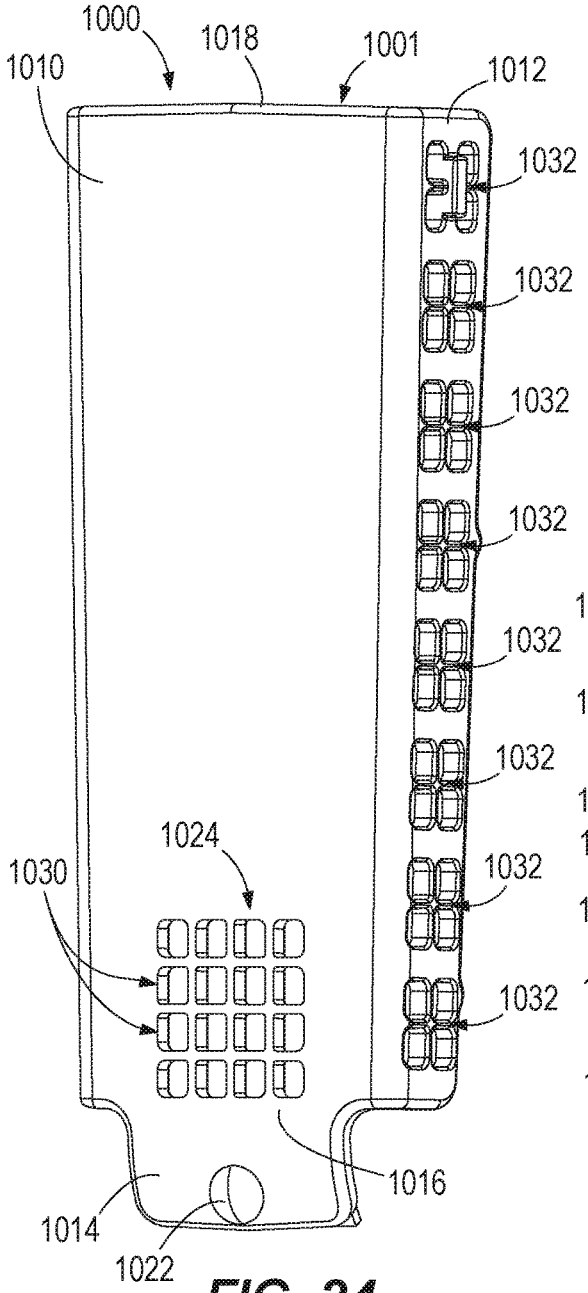
FIG. 24 is a front perspective view of a second embodiment of an insert having a screen and a valve for redirecting backflow of water to the water intake.
Figure 25:
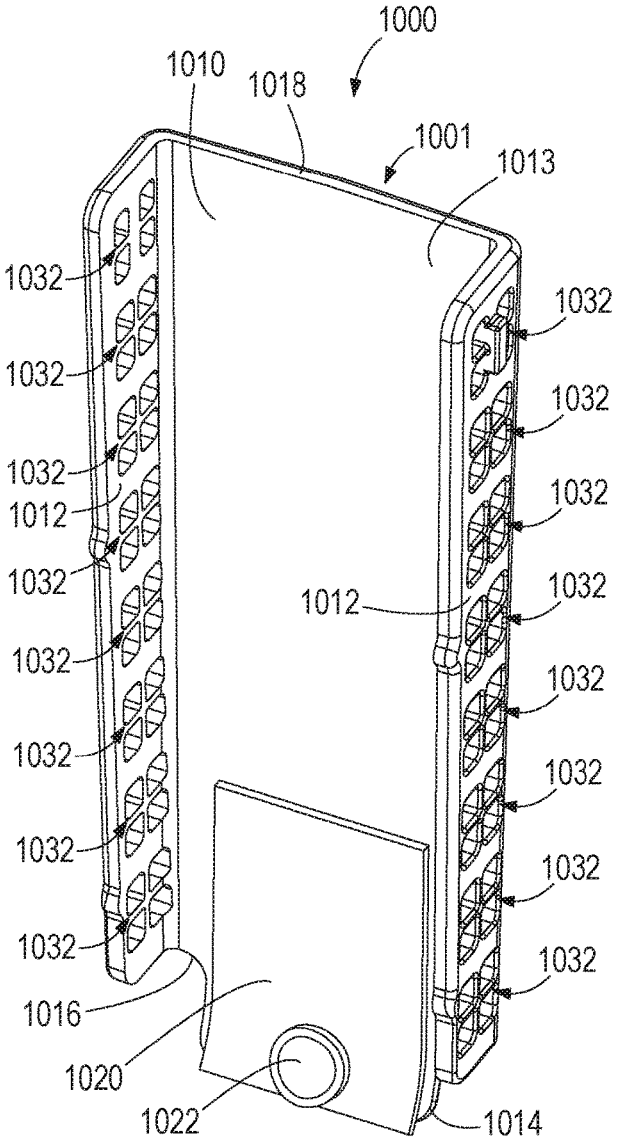
FIG. 25 is a rear view of the second embodiment of the insert and valve.

Referring to FIGS. 24 and 25, the screen insert 1001 includes a generally rectangular rear panel 1010 extending from an upper end 1018 to a lower end 1016. Two lateral panels 1012 are formed along the lateral edges of the rear panel 1010 and project forward therefrom. The rear panel 1010 and the lateral panels 1012 form a generally U-shaped profile of the screen insert 1001 and define a space 1013 between the opposing lateral panels 1012. A tab 1014 projects downward from the lower end 1016 of the rear panel 1010 and may be configured to assist in positioning the screen insert 1001 in the cooling water intake passage 980. A plurality of screen openings 1032 are formed through each of the lateral panels 1012 and are spaced vertically along the lateral panels 1012.

With continued reference to FIGS. 24 and 25, the screen insert 1001 includes a valve 1024 positioned proximate the lower end 1016 of the rear panel 1010. The valve 1024 is positioned so that, when the screen insert 1001 is received in the cooling water intake passage 980, the valve 1024 is aligned with the passage 982 which fluidically connects the outlet passage 750 to the cooling water intake passage 980 (FIG. 26). The valve 1024 includes a plurality of valve openings 1030 formed through the rear panel 1010 and a flapper 1020 coupled to the front side of the rear panel 1010 in the space 1013 between the lateral panels 1012. The flapper 1020 is at least partially formed from a resiliently deformable material and is secured to the rear panel 1010 by a fastener 1022 extending through the tab 1014 at the lower end 1016 of the rear panel 1010. Other embodiments, however, may include a flapper 1020 that is secured to the rear panel 1010 at another location and/or using a different type of fastener, or a flapper with at least a portion that is integrally formed with the rear panel 1010.

Figure 26:
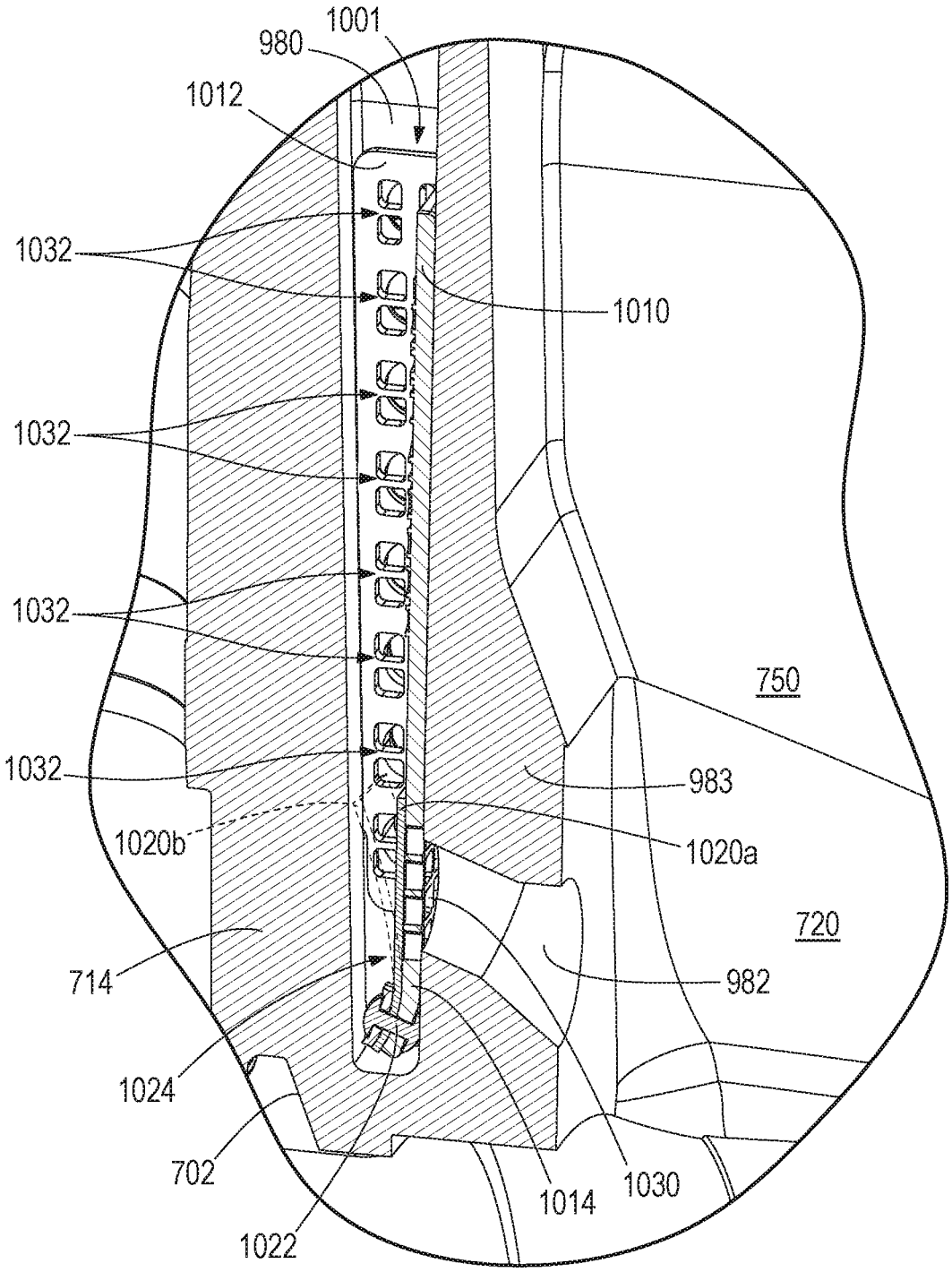
FIG. 26 is a sectional view showing the second embodiment of the insert installed in the water intake.

Referring to FIG. 26, the flapper 1020 is normally in the closed position (Illustrated with solid lines as flapper 1020*a* in FIG. 26). In the closed position, the flapper of the valve 1024 prevents the cooling water in the cooling water intake passage 980 from entering the outlet passage 750 via the passage 982 through the wall 983. This may be useful, for example to prevent cooling water from entering the outlet passage 750 as air, exhaust and/or other gas(es) are flowing through the outlet passage 750 to be ventilated from the outlet opening 752 (FIG. 9). Further, the valve 1024 may advantageously prevent a reduction in water pressure within the cooling water intake passage 980 due to the flow of cooling water into the outlet passage 750, thereby maintaining the water pressure in the cooling water intake passage 980 to prevent interference with the operation of the cooling system 740 (FIG. 9).

With continued reference to FIG. 26, when the marine drive is operated in the reverse gear, the ram pressure of the backflow of water taken into the outlet passage 750 may force the flapper 1020 to flex away from the rear panel 1010 and into the open position (Illustrated with dashed lines as flapper 1020*b* in FIG. 26). When the flapper 1020*b* is in the open position, at least a portion backflowing water in the outlet passage 750 is routed to the cooling water intake passage 980 via the passage 982 and through the valve openings 1030 formed in the rear panel 1010 so that the backflow of water may enter the cooling water intake passage 980 from the outlet passage 750 extending through the housing 702. As the backflow of water passes through the valve openings 1030 into the cooling water intake passage 980, the water pressure in the cooling water intake passage 980 increases and the backflowing water is forced out of the cooling water intake passage 980 via the screen openings 1032 and back into the body of water via the cooling water intakes 742. The flow of water out of the cooling water intake passage 980 through the screen openings 1032 clears debris from the screen 1000 and the cooling water intakes 742. When the backflow of water through the outlet passage 750 is ceased, for example when the marine drive is operated in the forward gear, the natural resiliency of the flapper 1020 causes the flapper to flxx back towards the rear panel 1010, thereby moving the valve 1024 back into the closed position. Advantageously, the use of the flapper valve 1024 utilizes the backflow of water into the housing to automatically clear debris from the screen 1000 in response to the normal operation of the marine drive.

The screen insert 1001 of FIGS. 24-26 is configured with a valve 1024 that includes a resiliently deformable flapper 1020 that flexes to move into and between the open and closed positions. Some embodiments, however, may be differently configured. For example, embodiments of a screen insert 1001 may include a valve with a rigid flapper that pivots about a hinge to move between the open and closed positions. Additionally or alternatively, some embodiments of a screen insert 1001 may include a different type of valve device, such as a ball valve, a tesla-type valve, and/or any other type of valve.

In embodiments of a marine drive that include a control system configured to modify the operation of the cooling water pump, the housing may be configured such that a backflow of water into the cooling water intake passage clears debris from the screen when the operation of the cooling water pump has been modified. For example, the backflow of water received from the body of water may be routed to clear debris from the cooling water intake when the operation of the pump is not drawing the cooling water into the cooling water intake. Some embodiments, however, may be configured such that the backflow of water received from the body of water is routed to clear debris from the cooling water intake regardless of whether the pump is drawing cooling water into the cooling water intake.

Figure 28:
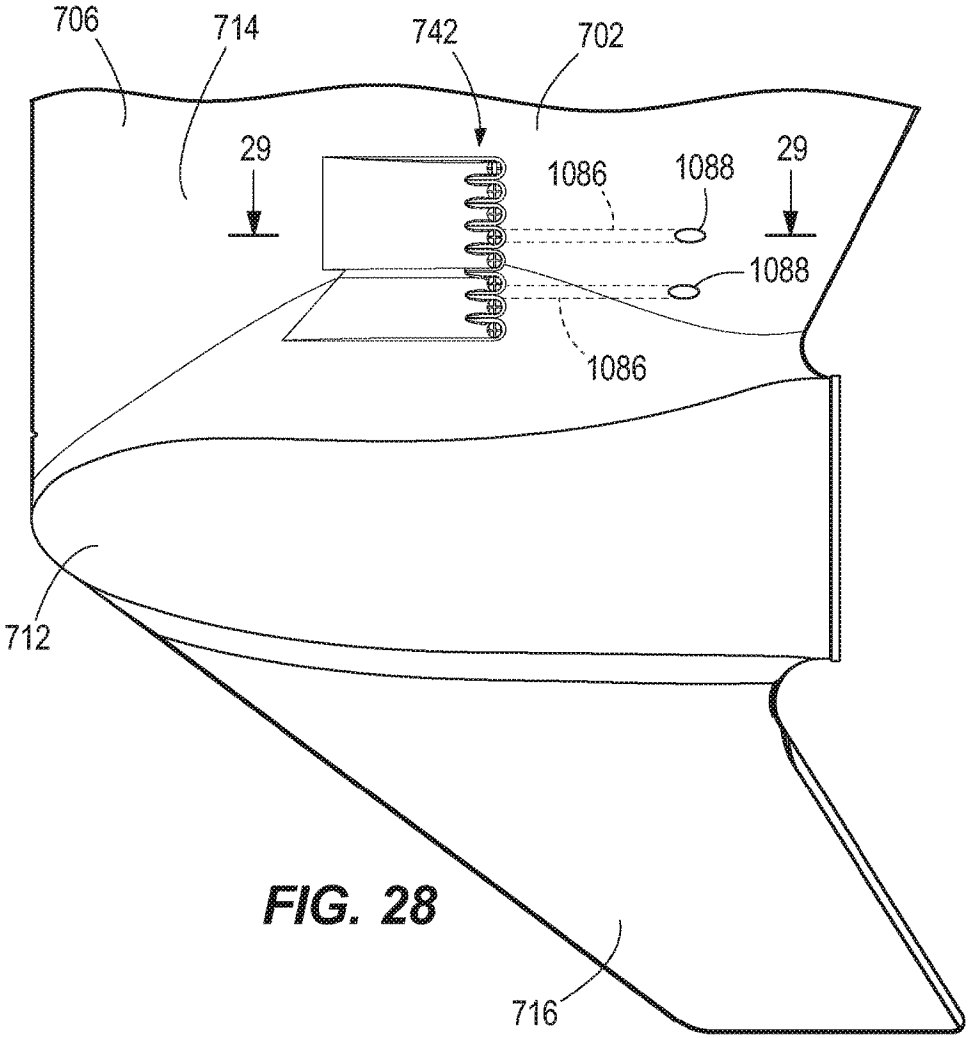
FIG. 28 is a side view of a fifth embodiment of a marine drive according to the present disclosure.
Figure 29:
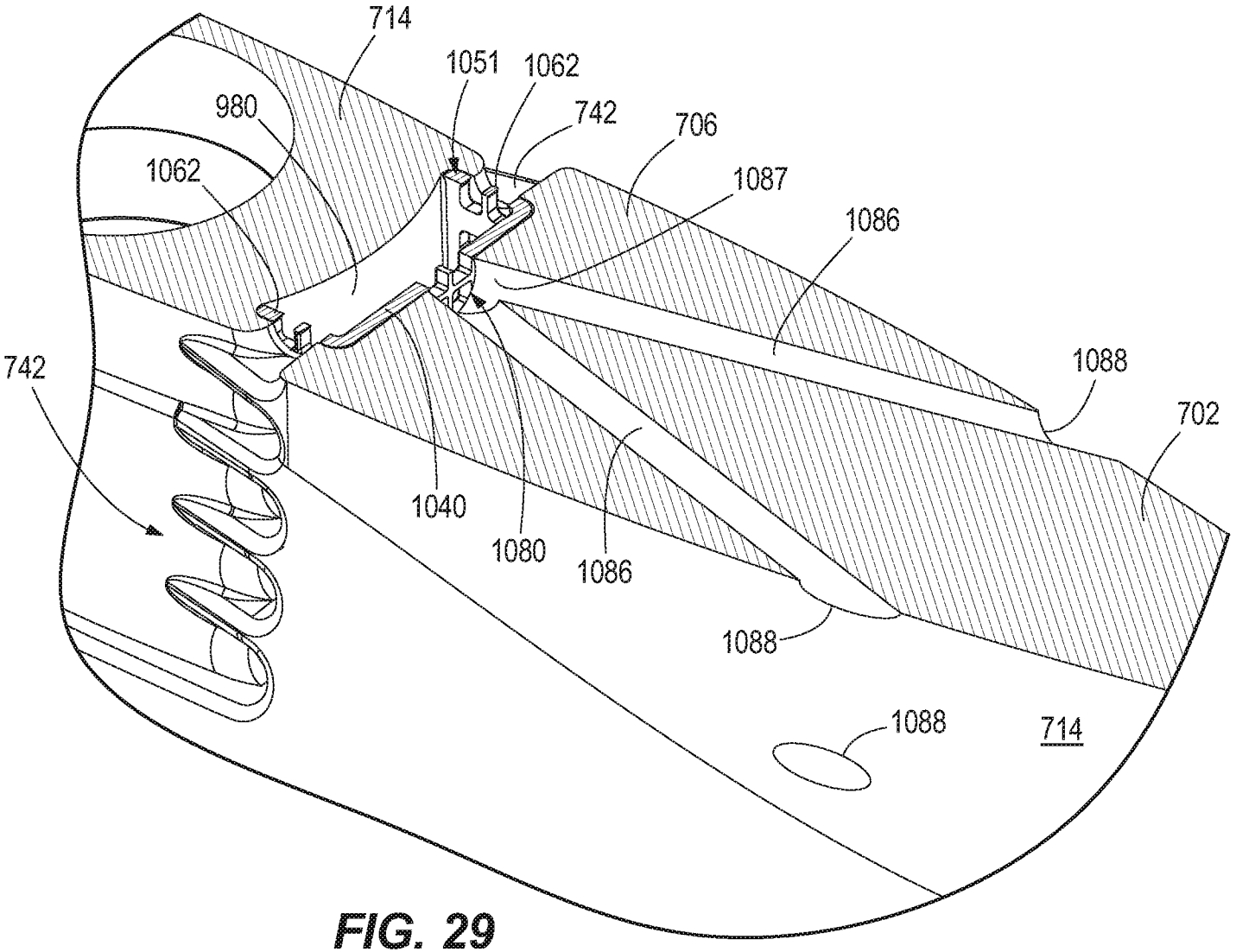
FIG. 29 is a view of section 29-29, taken in FIG. 28
Figure 30:
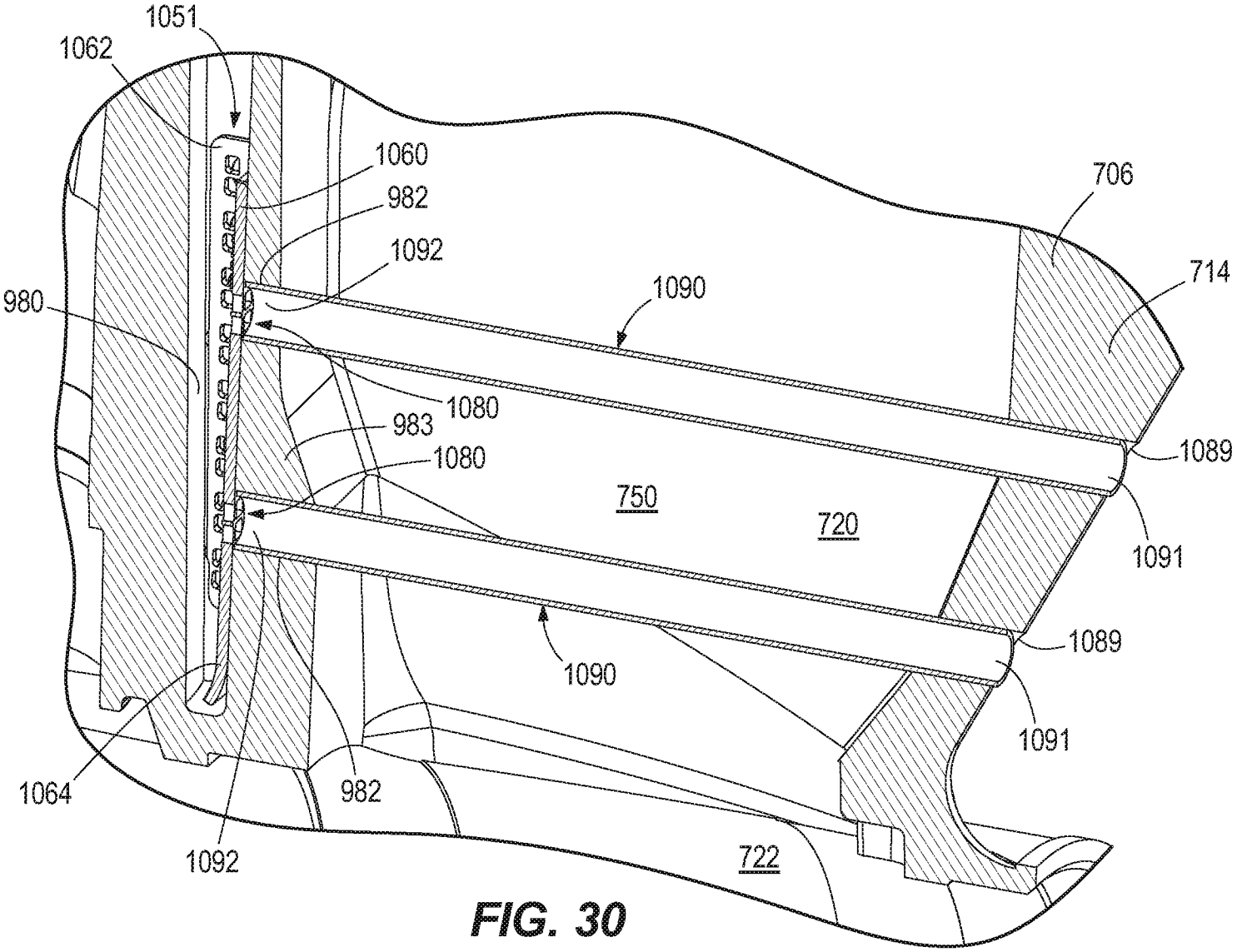
FIG. 30 is another sectional view of the fifth embodiment of the marine drive.

In the embodiments of FIGS. 22, 23, and 26, the screens 950, 1000 are illustrated in use with a marine drive that includes an outlet passage 750 uses a backflow of water through the outlet passage 750 to clear debris from the cooling water intakes 742. Some embodiments of a marine drive, however, may be configured to use water flowing into the housing 702 via another path to clear debris from the cooling water intakes. In such an embodiment, the screen inserts 951, 1001 may be used with the marine drives. Some embodiments may include a differently configured screen insert. For example, as illustrated in FIGS. 28-30, a marine drive may be configured with alternative passages 1086, 1090 for routing water to a screen insert 1051.

Figure 27:
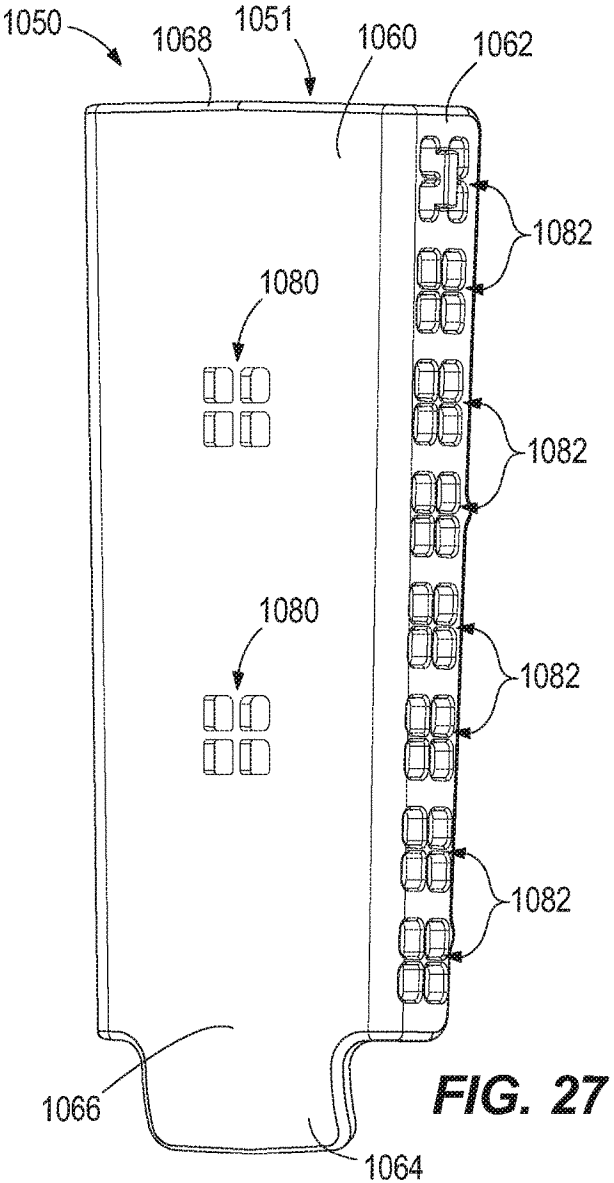
FIG. 27 is a front perspective view of a third embodiment of an insert for redirecting a backflow of water to a water intake.

Referring to FIG. 27, an embodiment of a screen 1050 may be configured as a screen insert 1051 with multiple openings 1080 spaced vertically in the rear panel 1060 for allowing water to pass through the rear panel 1060 of the screen insert 1051 and into the cooling water intake passage 980. The screen insert 1051 includes a generally rectangular rear panel 1060 extending from an upper end 1068 to a lower end 1066. Two lateral panels 1062 are formed along the lateral edges of the rear panel 1060 and project forward therefrom. The rear panel 1060 and the lateral panels 1062 form a generally U-shaped profile of the screen insert 1051 and define a space between the opposing lateral panels 1062. A tab 1064 projects downward from the lower end 1066 of the rear panel 1060 and may be configured to assist in positioning the screen insert 1051 in the cooling water intake passage 980. A plurality of screen openings 1082 are formed through each of the lateral panels 1062 and are spaced vertically along the lateral panels 1062.

The screen insert 1051 may be configured for use with a marine drive having multiple passages 1086, 1090 for routing water through the housing 702 of the marine drive to clear debris from at least one cooling water intake 741. For example, referring to FIGS. 28 and 29, the screen insert 1051 may be used with a marine drive may include a housing 702 that does not include an outlet passage for conveying air, exhaust, and/or other gas(es) to be ventilated from the housing 702. In the illustrated embodiments, the lower housing 706 includes a stem 714 with a plurality of passages 1086 that each extend from an inlet opening 1088 positioned on a lateral side of the stem 714 to a junction 1087 that is centrally positioned in front of one of the openings 1080 formed through the rear panel 1060 of the screen insert 1051. In the illustrated embodiment, each opening 1080 through the rear panel 1060 of the screen insert 1051 is aligned with a junction 1087 between two passages 1086 formed through the stem 714. Some embodiments, however, may include at least one opening 1080 in the screen insert 1051 that is aligned with a junction between more than two passages 1086. Additionally or alternatively, at least one opening 1080 in the screen insert 1051 may be fluidically connected to only one passage 1086 for routing water from the body of water into the cooling water intake passage 980.

The screen insert 1051 of FIG. 27 may be used with a marine drive with a housing 702 that does include an outlet passage, such as the housing 702 and outlet passage 750 of FIGS. 8-10 and 13-16. Referring to FIG. 30, the housing 702 of a marine drive may include conduits 1090 configured to route water from the body of water to the openings 1080 in the rear panel 1060 of the screen insert 1051. In the illustrated embodiment, each opening 1080 in the rear panel 1060 is aligned with a conduit 1090 that extends from an exterior end 1091 that is received in an inlet opening 1089 formed through the lower housing 702 to an interior end 1092 aligned with the opening 1080. Each of the conduits 1090 extends through the interior passage 720 in the stem 714. Some embodiments, however, may include a conduit that extends across a different portion of the outlet passage 750. Additionally or alternatively, at least one of the openings 1080 in the rear panel 1060 may be aligned with more than one conduit 1090.

When the marine drives of FIGS. 28-30 are operated in the reverse gear, the ram pressure at the back side of the housing 702 forces a backflow of water into the housing 702 via an inlet opening 1088, 1089. The backflow of water is forced to flow through via a passage 1086 or conduit 1090 to a corresponding opening 1080 in the screen insert 1051. The backflow of water then enters the cooling water intake passage 980 and flows out of the housing 702 via the screen openings 1082 and the cooling water intakes 742. Thus, the housing 702 routes the backflow of water through the screen insert 1051 to clear debris from the screen openings 1082 and the cooling water intakes 742.

Figure 31:
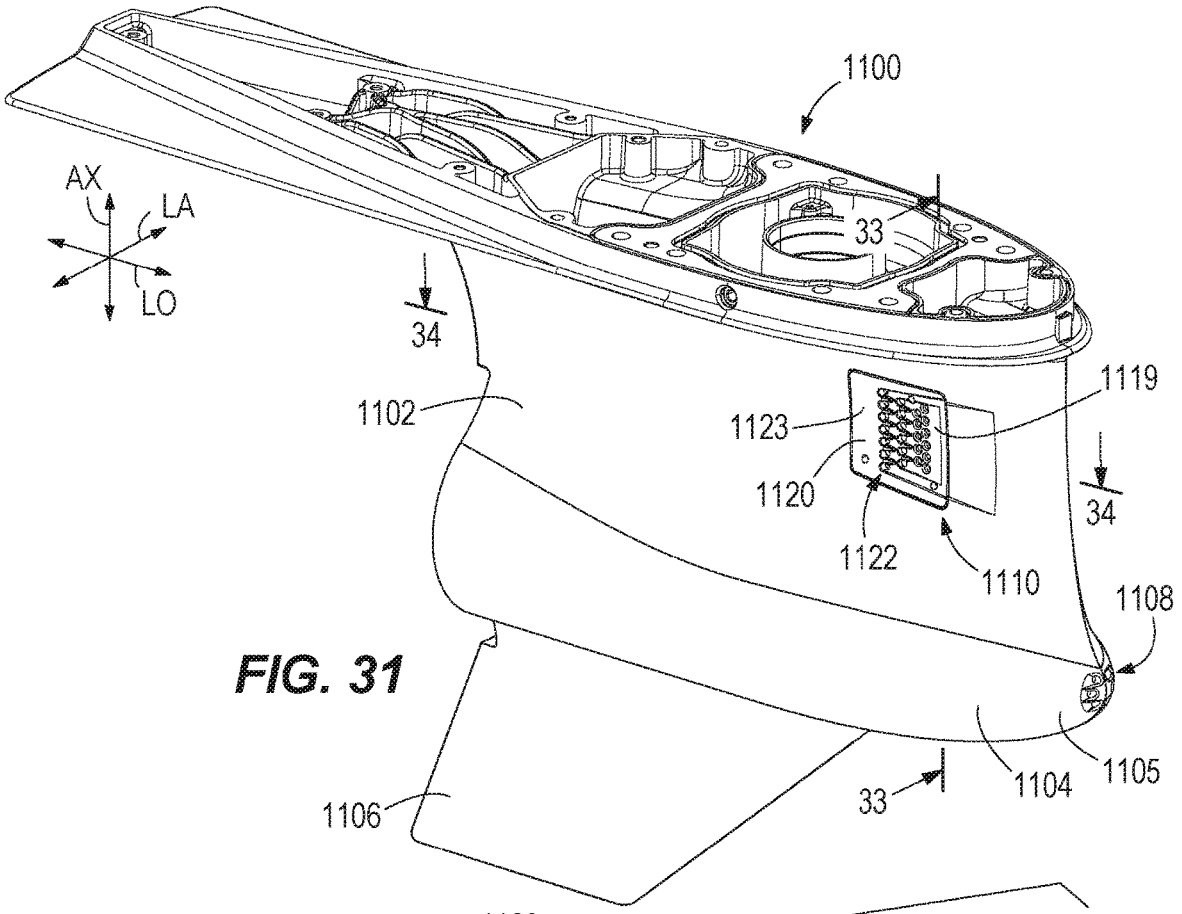
FIG. 31 is a perspective view of a sixth embodiment of a marine drive according to the present disclosure.

Some embodiments of a marine drive may be configured with a cooling water intake arrangement that utilizes multiple water intakes at different locations on the marine drive to supply cooling water to a cooling system. For example, FIG. 31 illustrates an embodiment of a lower unit 1100 of a marine drive that includes multiple cooling water intakes 1108, 1110. In the illustrated embodiment, the lower unit 1100 extends from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO. The lower unit 1100 includes a gearcase housing 1104 with a generally smooth outer surface that forms a nosecone 1105 and transitions to a downwardly extending skeg 1106 and an upwardly extending stem 1102. To draw water into the cooling system, the lower unit 1100 includes lateral cooling water intakes 1110 formed on opposite sides lateral sides of the stem 1102 and a gearcase cooling water intake 1108 formed through the tip of the nosecone 1105.

Figure 32:
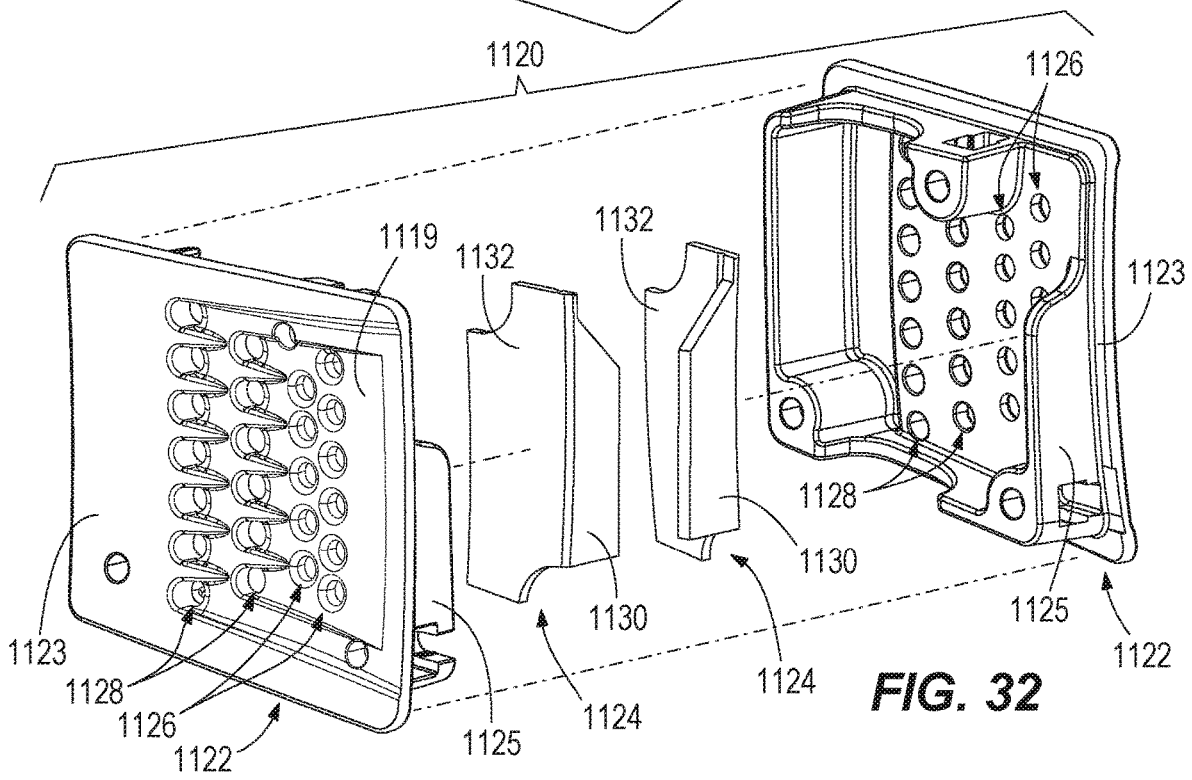
FIG. 32 is an exploded view of portions of a water intake, screen and flapper valves of the sixth embodiment.

Referring to FIG. 32, the lateral cooling water intakes 1110 are part of a cooling water housing 1120 including inlet plates 1122 that are positioned on the lateral sides of the stem 1102 and which may be coupled to each other. The inlet plates 1122 each include a plate body 1123 with a recessed scoop surface 1119 configured to route water to a set of forward intake openings 1126 and rear intake openings 1128. The intake openings 126, 128 allow cooling water to be drawn into the lower unit 1100 and the cooling system from the body of water in which the marine drive is situated. The cooling water housing 1120 also includes valve devices 1124 configured to selectively allow water to flow through the intake openings 126. The illustrated valve devices 1124 are configured as flapper valves that include a mounting flange 1130 configured to support the valve device 1124 on a front wall 1125 of each inlet plate 1122 and a flapper member 1132 that is at least partially formed from a resiliently deformable material.

Figure 33:
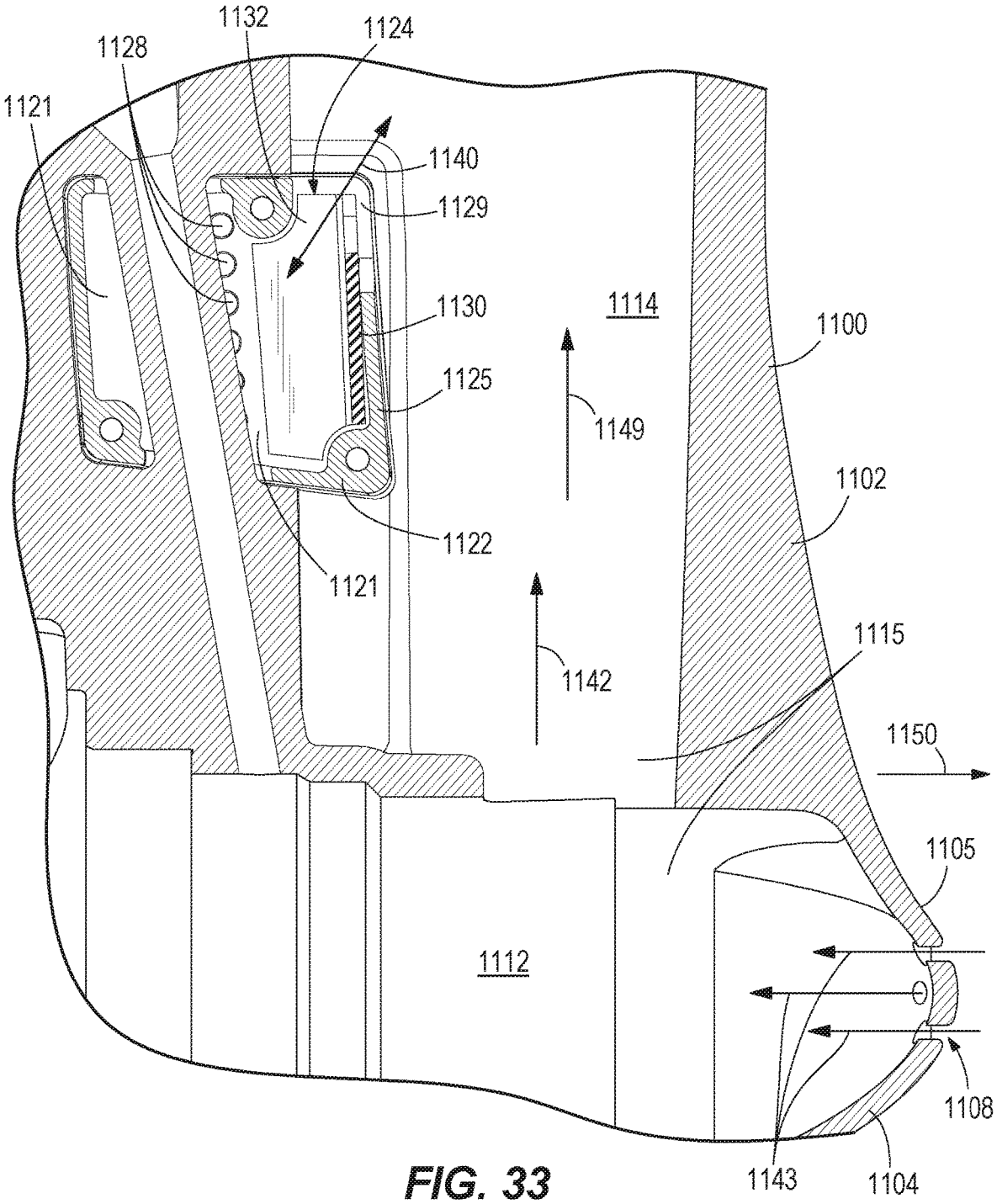
FIG. 33 is a view of section 33-33, taken in FIG. 31.

Referring to FIG. 33, the inlet plate 1122 of the cooling water housing 1120 defines a cooling water intake chamber 1121 within the cooling water housing 1120. Water drawn into the cooling water housing 1120 through the forward or rear intake openings 1126, 1128 flows into the cooling water intake chamber 1121. The cooling water intake chamber 1121 is fluidically connected to the cooling system by a conduit (not shown) extending between the cooling water intake chamber 1121 and the other parts of the cooling system. As previously mentioned, the cooling water system is configured to receive cooling water that flows into the lower unit 1100 via the gearcase cooling water intake 1108 formed through the nosecone 1105. With continued reference to FIG. 33, the lower unit 1100 includes an interior passage 1115 including a gearcase passage 1112 formed in the gearcase housing 1104 and a stem passage 1114 formed in the stem 1102. The stem passage 1114 is fluidically connected to the gearcase passage 1112. The inlet plates 1122 define an opening 1129 through a front side of the assembled cooling water housing 1120, thereby fluidically connecting the interior passage 1115 to the cooling water intake chamber 1121.

With continued reference to FIG. 33, water is selectively drawn into the cooling water system via the lateral cooling water intakes 1110 and/or the gearcase cooling water intake 1108 based on the speed of the marine drive. When the marine drive is operated in the forward gear to propel the marine vessel and marine drive in the forward direction indicated by arrow 1150, a ram pressure at the tip of the nosecone 1105 forces water to flow into the interior passage 1115 via the gearcase cooling water inlet 1108, for example along the flow paths indicated by arrows 1143. As the water flows into the interior passage 1115, it accumulates in the gearcase passage 1112 before flowing up into the stem passage 1114 due to the ram pressure and continued inflow of water via the gearcase cooling water intake 1108, for example along the flow path indicated by arrow 1142.

Figure 34:
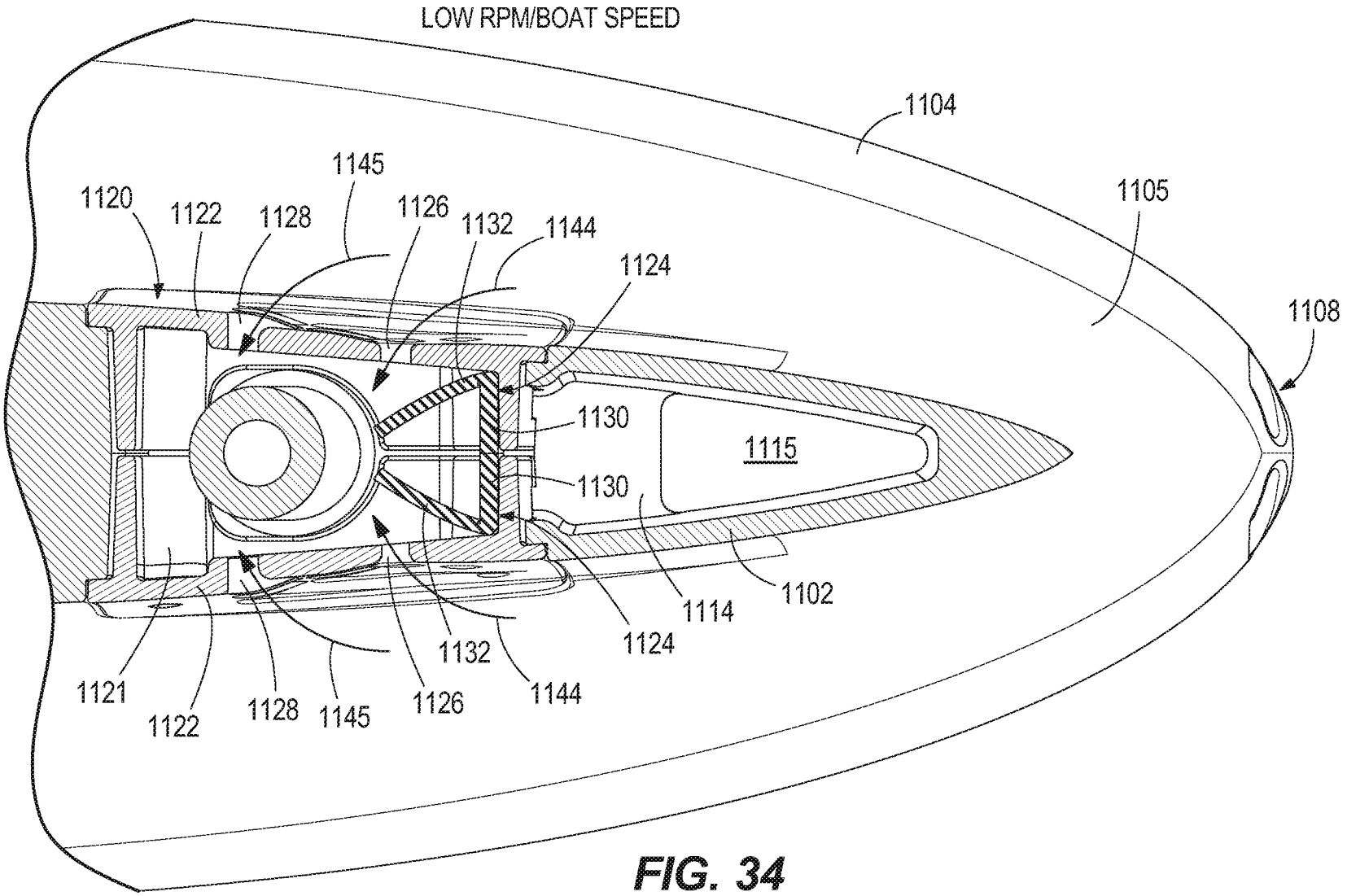
FIG. 34 is a view of section 34-34, taken in FIG. 31, showing the flapper valves in an open position.

Referring to FIGS. 33 and 34 when the marine drive is operating with a relatively low motor RPM and marine vessel speed, the ram pressure of the cooling water flowing into the interior passage 1115 is not high enough to force the cooling water in the inlet passage to flow upward in the stem passage 1114 to the opening 1129 in the cooling water housing 1120. As such, the cooling water is drawn into the cooling water system primarily through the lateral cooling water intakes 1110 (FIG. 31). Referring to FIG. 33, the water pressure on the exterior side of the inlet plates 1122 forces cooling water to flow into the cooling water intake chamber 1121 via the forward intake openings 1126 and the rear intake openings 1128. The cooling water flowing through the forward intake openings forces the flap members 132 of the valve devices 1124 to flex away from the inlet plate 1122 to which said valve device 1124 is secured, thereby allowing the inflow of water through the forward intake openings 1126. The cooling water may then be drawn into the conduit of the cooling water system from the cooling water intake chamber 1121. This may be useful, for example, to ensure that enough cooling water is drawn into the cooling water system via the lateral cooling water intakes 1110 when the ram pressure is insufficient to force cooling water from the gearcase cooling water intake 1108 into the cooling water intake chamber 1121. Excess cooling water in the cooling water intake chamber 1121 may be discharged from the cooling water housing 1120 into the interior passage 1115 via the opening 1129 at the front of the cooling water housing 1120, for example along the flow path indicated by arrow 1140.

When the marine drive is operating with a relatively high motor RPM and marine vessel speed, the ram pressure of the cooling water flowing into the interior passage 1115 becomes high enough to force the cooling water further up the stem passage 1114 to the opening 1129 in the cooling water housing 1120, for example along the flow path indicated by arrow 1149 (FIG. 33). As such, cooling water is drawn into the cooling water system through the gearcase cooling water intake 1108 as well as the lateral cooling water intakes 1110 and less cooling water from the lateral cooling water intakes 1110 is required.

Figure 35:
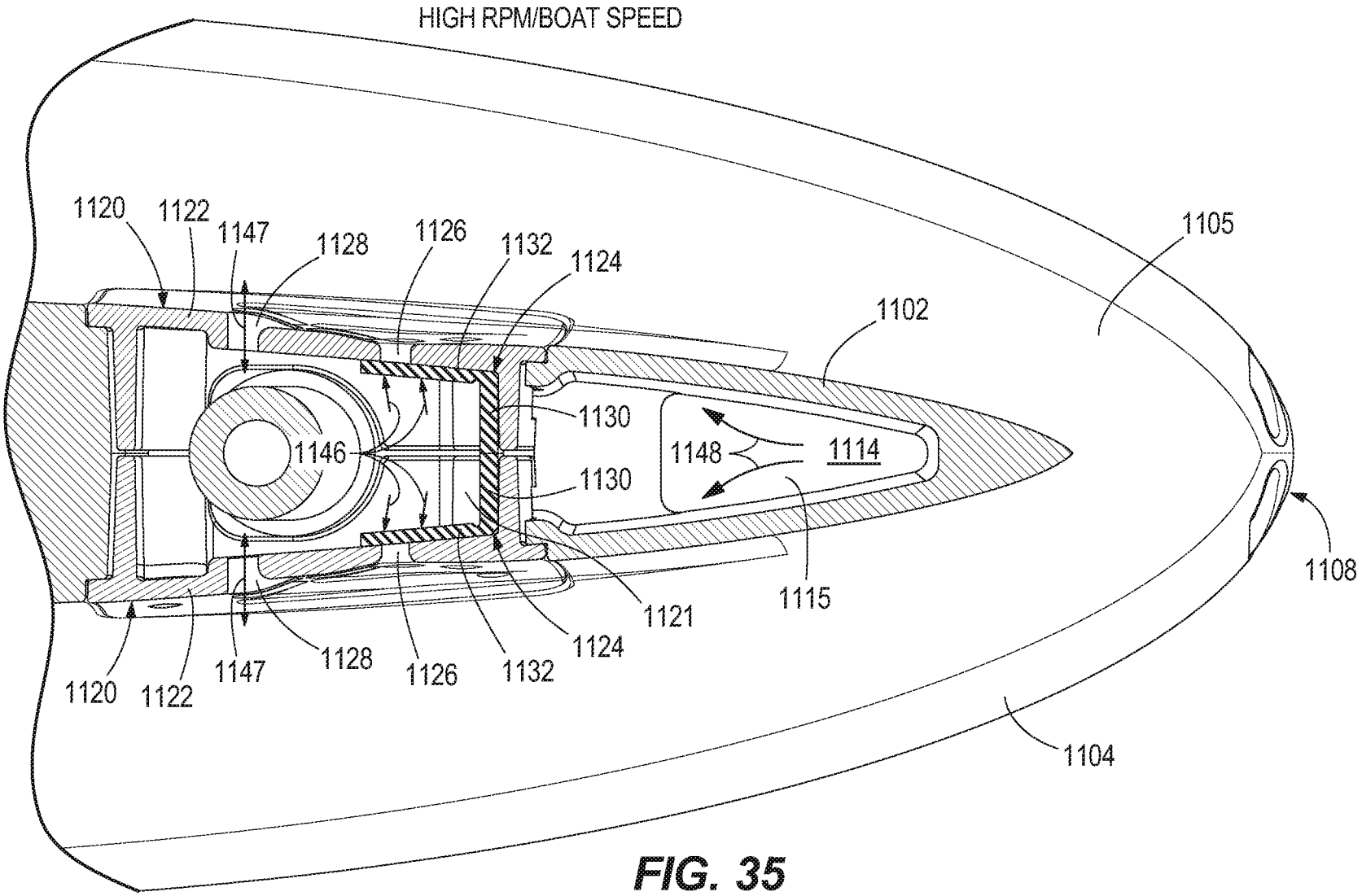
FIG. 35 is a view like FIG. 34, showing the flapper valves in a closed position.

Referring to FIGS. 33 and 35, at high motor RPMs and marine vessel speeds, cooling water from the gearcase cooling water intake 1108 flows through the stem passage 1114, for example along the flow paths indicated by arrow 1142, (FIG. 33) arrow 1149 (FIG. 33), and arrows 1148 (FIG. 35). Water in the stem passage 1114 is then forced to flow into the cooling water intake chamber 1121 via the opening 1129 in the cooling water housing 1120 along the flow path indicated by arrow 1140 (FIG. 33). Continued inflow of water via the opening 1129 in the cooling water housing 1120 causes an increase in water pressure within the cooling water intake chamber 1121. The increase in water pressure forces the flapper members 1132 of the valve devices 1124 to flex back towards the corresponding intake plate 1122, thereby sealing the forward intake openings 1126. This may be useful, for example, in order to prevent the ram pressure of the cooling water from the gearcase cooling water intake 1108 from forcing cooling water out from the forward intake openings 1126 when the marine vessel is traveling at high speeds.

This written description uses examples to disclose the invention and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A marine drive for propelling a marine vessel in water, the marine drive comprising:

a housing configured to support a propulsor for generating a thrust force in the water;

an outlet passage configured to discharge air, exhaust, and/or other gas(es) to the water proximate the propulsor;

a ball valve configured to permit a flow of the air, exhaust and/or other gas(es) out of the outlet passage when the marine drive is operated in a forward gear, and to at least partially prevent a backflow of the water past the ball valve when the marine drive is operated in a reverse gear, and wherein at least one of gravity and the air, exhaust and/or other gas(es) forces the ball valve into an open position and wherein the backflow of the water to the housing forces the ball valve into a closed position.

2. The marine drive according to claim 1, wherein the ball valve includes a ball and a seat.

3. The marine drive according to claim 2, wherein the ball valve includes a cage containing the ball.

4. A marine drive for propelling a marine vessel in water, the marine drive comprising:

a housing configured to support a propulsor for generating a thrust force in the water;

an outlet passage configured to discharge air, exhaust, and/or other gas(es) to the water proximate the propulsor;

a tesla valve configured to permit a flow of the air, exhaust and/or other gas(es) out of the outlet passage when the marine drive is operated in a forward gear, and to at least partially prevent a backflow of the water past the tesla valve when the marine drive is operated in a reverse gear, and wherein the tesla valve includes a serpentine path for the flow of air, exhaust and/or other gas(es) and a redirecting path for redirecting the backflow of the water towards the outlet, the redirecting path being positioned centrally in the tesla valve and the serpentine path being one of a pair of serpentine paths on opposite sides of the redirecting path.

5. The marine drive according to claim 1, wherein the housing includes a lower housing and an upper housing on which the lower housing is suspended, and the ball valve is in the upper housing.

6. A marine drive for propelling a marine vessel in water, the marine drive comprising:

a housing configured to support a propulsor for generating a thrust force in the water;

an outlet passage configured to discharge air, exhaust, and/or other gas(es) to the water proximate the propulsor; and a duckbill valve configured to permit a flow of the air, exhaust and/or other gas(es) out of the outlet passage when the marine drive is operated in a forward gear, and to at least partially prevent a backflow of the water past the duckbill valve when the marine drive is operated in a reverse gear.

7. The marine drive according to claim 6, wherein the air, exhaust and/or other gas(es) forces the duckbill valve into an open position in which the duckbill valve permits the flow of the air, exhaust and/or other gas(es) and wherein a natural resiliency of the duckbill valve forces the duckbill valve into a closed position preventing the backflow of the water back past the duckbill valve.

8. The marine drive according to claim 7, wherein the duckbill valve includes a plurality of lips having a natural resiliency that cause the duckbill valve to normally remain in the closed position until the air, exhaust and/or other gas(es) forces the plurality of lips apart.

9. The marine drive according to claim 6, further comprising the propulsor, wherein the duckbill valve is coupled to the propulsor.

10. The marine drive according to claim 9, wherein the duckbill valve includes a plurality of fins configured to facilitate a swirling flow of the water relative to the propulsor.

11. The marine drive according to claim 6, further comprising the propulsor, wherein the propulsor includes a propeller including a hub and a plurality of blades on the hub, and wherein the duckbill valve is coupled to the hub.

12. The marine drive according to claim 11, wherein the duckbill valve is coupled to an outer end of the hub.

13. The marine drive according to claim 11, wherein the duckbill valve is at least partially inside the hub.

14. The marine drive according to claim 1, wherein the housing has at least one air intake configured to allow air to enter the outlet passage and flow through the housing for discharge to the water.

15. The marine drive according to claim 4, wherein the housing has at least one air intake configured to allow air to enter the outlet passage and flow through the housing for discharge to the water.

16. The marine drive according to claim 6, wherein the housing has at least one air intake configured to allow air to enter the outlet passage and flow through the housing for discharge to the water.

17. The marine drive according to claim 1, wherein the ball valve includes a ball configured to float in the water.

18. The marine drive according to claim 4, wherein the housing includes a lower housing and an upper housing on which the lower housing is suspended, and the tesla valve is in the upper housing.

19. The marine drive according to claim 6, wherein the duckbill valve has two sets of opposing lips.

20. The marine drive according to claim 6, wherein the duckbill valve is located outside of the propulsor.

* * * * *